US005258916A

United States Patent [19]

Langheinrich et al.

[11] Patent Number: 5,258,916

[45] Date of Patent: Nov. 2, 1993

[54] METHOD FOR SELECTING ROTOR SPINNING DEVICE COMPONENTS AND THEIR OPERATIONAL CHARACTERISTICS

[75] Inventors: Dieter Langheinrich, Wegberg; Karl Gosejacob, Nettetal, both of Fed. Rep. of Germany

[73] Assignee: W. Schlafhorst & Co., Moenchengladbach, Fed. Rep. of Germany

[21] Appl. No.: 510,282

[22] Filed: Apr. 16, 1990

[51] Int. Cl.[5] ..... G06F 15/46

[52] U.S. Cl. ..... 364/470; 57/264; 364/148; 364/188

[58] Field of Search ..... 364/470, 188, 189, 148; 57/264, 265

[56] References Cited

U.S. PATENT DOCUMENTS

| | | | |
|---|---|---|---|
| 4,408,447 | 10/1983 | Sloupensky et al. | 364/470 X |
| 4,534,042 | 8/1985 | Marsicek et al. | 364/470 X |
| 4,835,699 | 5/1989 | Mallard | 364/470 |
| 4,916,625 | 4/1990 | Davidson et al. | 364/470 |

*Primary Examiner*—Joseph Ruggiero
*Attorney, Agent, or Firm*—Shefte, Pinckney & Sawyer

[57] ABSTRACT

The present invention provides a method for selecting components of a rotor spinning device of a textile machine such that the operational characteristics of the components are optimally suited for the spinning of a yarn to be used in a predetermined fabric application. The method includes several prompting steps during which a user is prompted for information regarding the predetermined fabric application. In response to the information inputted by the user concerning the predetermined fabric application, the user is interrogated concerning the preferred characteristics of the predetermined fabric application. The method additionally includes prompting the user to provide information relating to the raw material of the yarn to be used in the predetermined fabric application and the yarn count of the yarn. In accordance with the method, selected values of yarn characteristics including the yarn length, the yarn fineness, and the debris content are displayed to the user in response to information concerning the raw material. The user then selects the desired yarn characteristics and, based upon the selected yarn characteristics, the method determines a selection of components of the rotor spinning device which will work optimally together to spin a yarn to be used in the predetermined fabric application.

3 Claims, 10 Drawing Sheets

| Ser. No. | Article | Yarn count □Nm □NeC □lex | Twist factor □αm □αe |
|---|---|---|---|
| | Conf. flat woven | | |
| 15 | popelline for coats | | |
| 16 | working clothes | | |
| 17 | denim<br>□ warp □ filling<br>□ branded product □ normal product<br>□ distinct □ indistinct appearance<br>□ open-width dyeing □ ballwarp dyeing | | |
| 18 | linings | | |
| 19 | napped fabrics | | |
| 20 | industrial yarns | | |
| 21 | home furnishings | | |
| 22 | gauze | | |
| | Pile fabrics □ ground warp □ ground filling<br>□ pile warp □ pile filling | | |
| 23 | corduroy | | |
| 24 | velours | | |
| 25 | terry fabrics | | |
| | Special yarns | | |
| 26 | crepe | | |
| 27 | elastic gauze | | |
| 28 | piled yarn | | |
| 29 | others:<br>(please specify) | | |

Fig. 4A

C. Raw Materials Data

1 2 3 4 5 6 7 8 9 10 11 12 13 14 15 16 17 18 19 20 21 22 23 24 25 26 27 28 29

| SYNTHETICS | polyester (PES) | acrylics (PAN) | others (Please specify) |
|---|---|---|---|
| Percentage | % | % | % |
| Fiber length ☐ mm ☐ inch | | | |
| Fiber fineness ☐ dtex ☐ den | | | |
| Fiber type | | | |
| Trade name | | | |
| max. rotor rpm (see footnote) | | | |

Fig. 4B 1 2 3 4 5 6 7 8 9 10 11 12 13 14 15 16 17 18 19 20 21 22 23 24 25 26 27 28 29

| CELLULOSICS (BRIGHT) | rayon (CV) | modal(CMD) | others (Please specify) |
|---|---|---|---|
| Percentage | % | % | % |
| Fiber length ☐ mm ☐ inch | | | |
| Fiber fineness ☐ dtex ☐ den | | | |
| Fiber type | | | |
| Trade name | | | |

Fig. 4C

Yarn Character Requirements

Hairness
__ Very high
__ High
__ Medium
__ Low

Soft Handle
__ Yes
__ No

Incidence of fiber wraps
__ Very low
__ Low
__ Acceptable

Bulkiness
__ Great
__ Medium
__ Moderate

Evenness
__ Very Good
__ Good
__ Moderately good

Warp strength
__ Very good
__ Good
__ Low

Opening behavior
__ Good
__ Average
__ None

Twist level
__ Low
__ Medium
__ High

Raising property
__ Very Good
__ Good
__ Moderately good
__ No

Yarn strength
__ Low
__ Medium
__ High
__ Very high

Crinkling tendency
__ High
__ Medium
__ Low

Fig. 5

METHOD FOR SELECTING ROTOR SPINNING DEVICE COMPONENTS AND THEIR OPERATIONAL CHARACTERISTICS

BACKGROUND OF THE INVENTION

The present invention relates to a method for selecting rotor spinning device components and their operational characteristics.

The character of a yarn produced by a rotor spinning process is predominantly influenced by the raw material from which the yarn is produced. In this regard, it is essential that a proper combination of rotor spinning device components be provided and, moreover, that the operational characteristics of these components be optimized in accordance with the selected raw material and the desired yarn product. Typically, the selection of the optimum rotor spinning device components and their optimal operational characteristics is determined through a process which involves consultation between the yarn manufacturer and technical experts having familiarity with rotor spinning devices and their capabilities. In this regard, the validity of the recommended optimum rotor spinning device components and their operational characteristics has depended upon the particular individual knowledge of the technical experts consulted for such advice, their availability and other limitations what are inherent in any decision making process relying solely on the knowledge and experience of particular individuals. Accordingly, the need exists for a method for selecting the optimum rotor spinning device components and their operational characteristics in a relatively more reliable repeatable, comprehensive and relatively more available than the prior art method of consultation with technical experts.

SUMMARY OF THE INVENTION

The present invention provides a method for specifying the optimum rotor spinning device components and their operational characteristics with respect to a predetermined fabric application. The method of the present invention provides improvements in the repeatability, comprehensiveness and availability of the methods of the type for providing such information.

Briefly described, the present invention provides a method for selecting components of a rotor spinning device of a textile machine and their operational characteristics for the spinning of a yarn to be used in a predetermined fabric application. According to one aspect of the present invention, the method includes providing a processing unit having the capability to prompt a user for information and to accept information inputted thereto by the user, prompting a user for information regarding the predetermined fabric application and, in response to the inputted information concerning the predetermined fabric application, interrogating the user concerning the preferred characteristics of the predetermined fabric application. Additionally, the method includes prompting the user to provide information relating to the raw material of the yarn to be used in the predetermined fabric application, prompting the user to provide information relating to the yarn count of the yarn and, in response to the user's selection of the raw material, prompting the user to specify selected ones of a group of yarn characteristics including the yarn length, the yarn fineness and the debris content.

The method further includes calculating selected dimensional values of the rotor spinning device in response to the inputted information relating to the selected ones of the yarn characteristics. Also, the method includes prompting the user to input information relating to the sliver count and, in response to the inputting of information relating to the sliver count, calculating a drafting range based upon a predetermined sliver count.

The one aspect of the method of the present invention also preferably includes comparing the calculated drafting range with a predetermined drafting range, calculating a value for the number of fibers in the cross section of the yarn and comparing the calculated value with a predetermined value and prompting the user to modify the inputted information concerning the yarn if the calculated drafting range is not in agreement with the predetermined drafting range. Moreover, the method includes prompting the user to modify the inputted information concerning the yarn in the event that the calculated value of the number of fibers in the cross section of the yarn is not in agreement with the predetermined fiber number value. Finally, the method includes compiling an initial list of acceptable rotor spinning device components from a selected group of rotor spinning components and identifying selected ones of the acceptable rotor spinning device components and predetermined operational characteristics thereof.

According to a further aspect of the present invention, the selecting of predetermined ones of the acceptable rotor spinning device components includes selecting a spinning rotor in correspondence with information concerning the relative quality level of the yarn to be spun by the spinning rotor, the rotor spinning rate and the yarn count range.

According to an additional aspect of the present invention, the compiling of an initial list includes identifying acceptable yarn withdrawal components in consideration of information concerning the preferred characteristics of the yarn and information relating to the raw material.

BRIEF DESCRIPTION OF THE DRAWINGS

FIGS. 4A, 4B, and 4C constitute an example of an information organizing check list for use in the method of the present invention; and FIG. 5 is an example of a listing of yarn characteristics for use with the method of the present invention.

DETAILED DESCRIPTION OF THE PREFERRED EMBODIMENT

Figure 1:
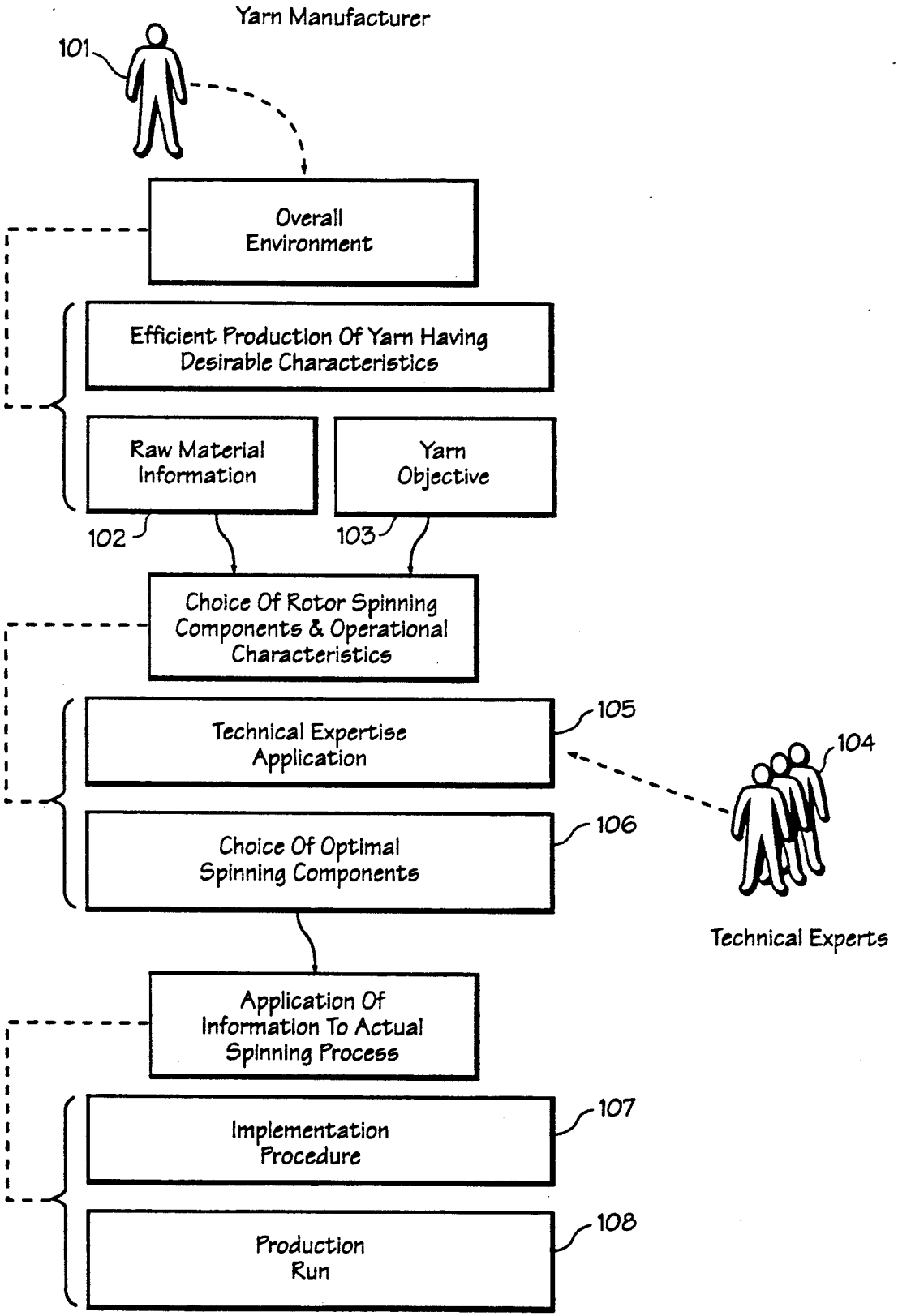
Fig. 1 (Prior Art)
FIG. 1 is a schematic diagram of a prior art method.

In FIG. 1, a prior art method for determining the optimum spinning components for a rotor spinning process is illustrated. A yarn manufacturer 101 provides information 102 relating to the raw material of the fibers which will comprise the yarn and a desired yarn objective 103 to the technical experts 104 of a rotor spinning component manufacturer. The known fiber information 102 can include, for example, information relating to the yarn fineness, length or blending of fiber raw materials. The desired yarn 103 includes the type of yarn which the yarn manufacturer 101 desires to produce. The technical experts 104 apply their technical expertise in a technical expertise application 105 which may include conducting several experimental tests with various yarn spinning processes in which the components of the spinning rotor are varied in each process. These experimental tests may be confirmed through supplementary confirmatory testing by the technical experts 104.

Ultimately, the technical experts 104 determine a choice 106 of the optimal spinning components and this information is provided to the yarn manufacturer 101 for an implementation procedure 107 in the rotor spinning process in which the suggested optimal spinning components are installed and/or adjusted as recommended. The yarn manufacturer 101 then conducts a production run 108 using the suggested optimum spinning components.

Figure 2:
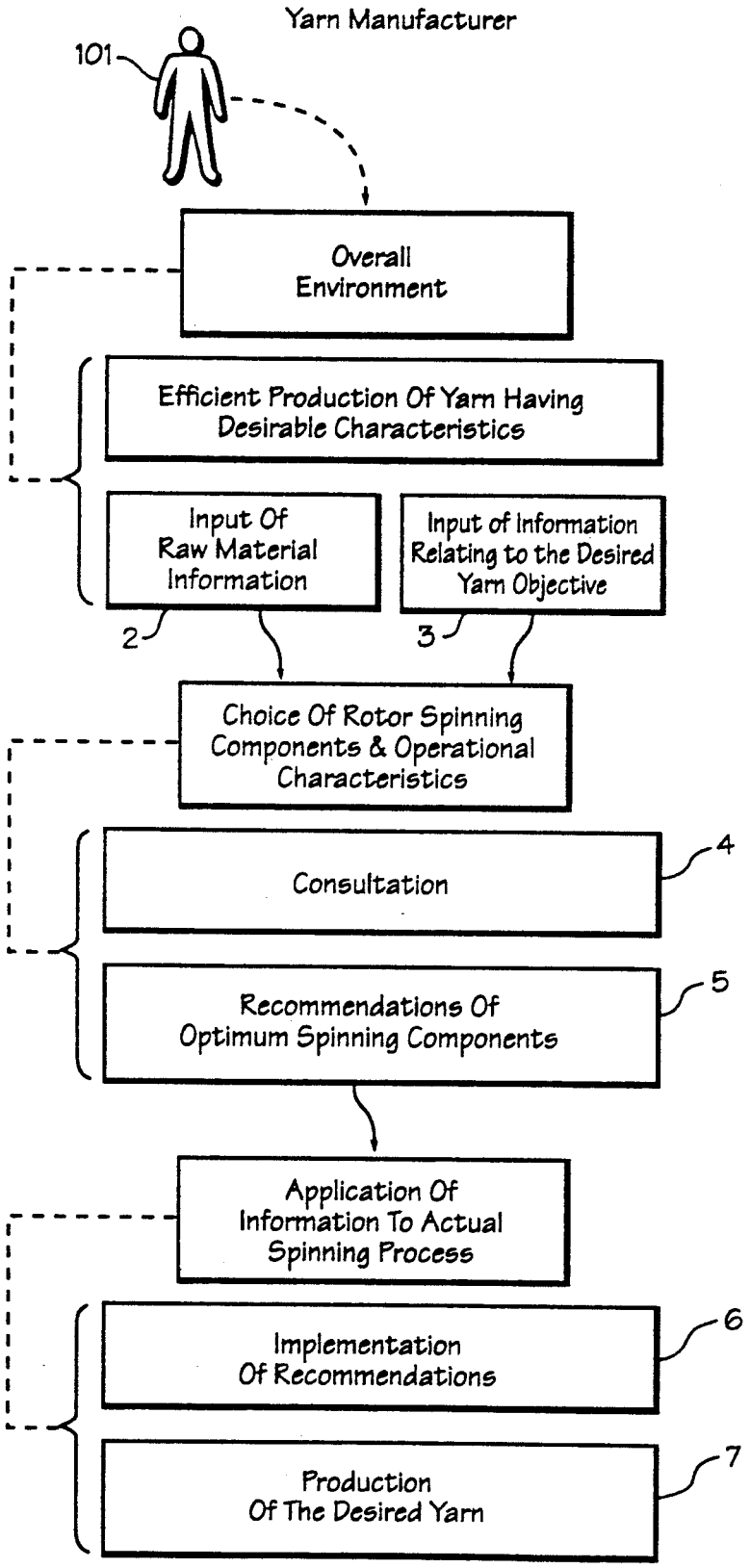
Fig. 2 (Prior Art)
FIG. 2 is a schematic diagram of the method of the present invention.
Figure 3A:
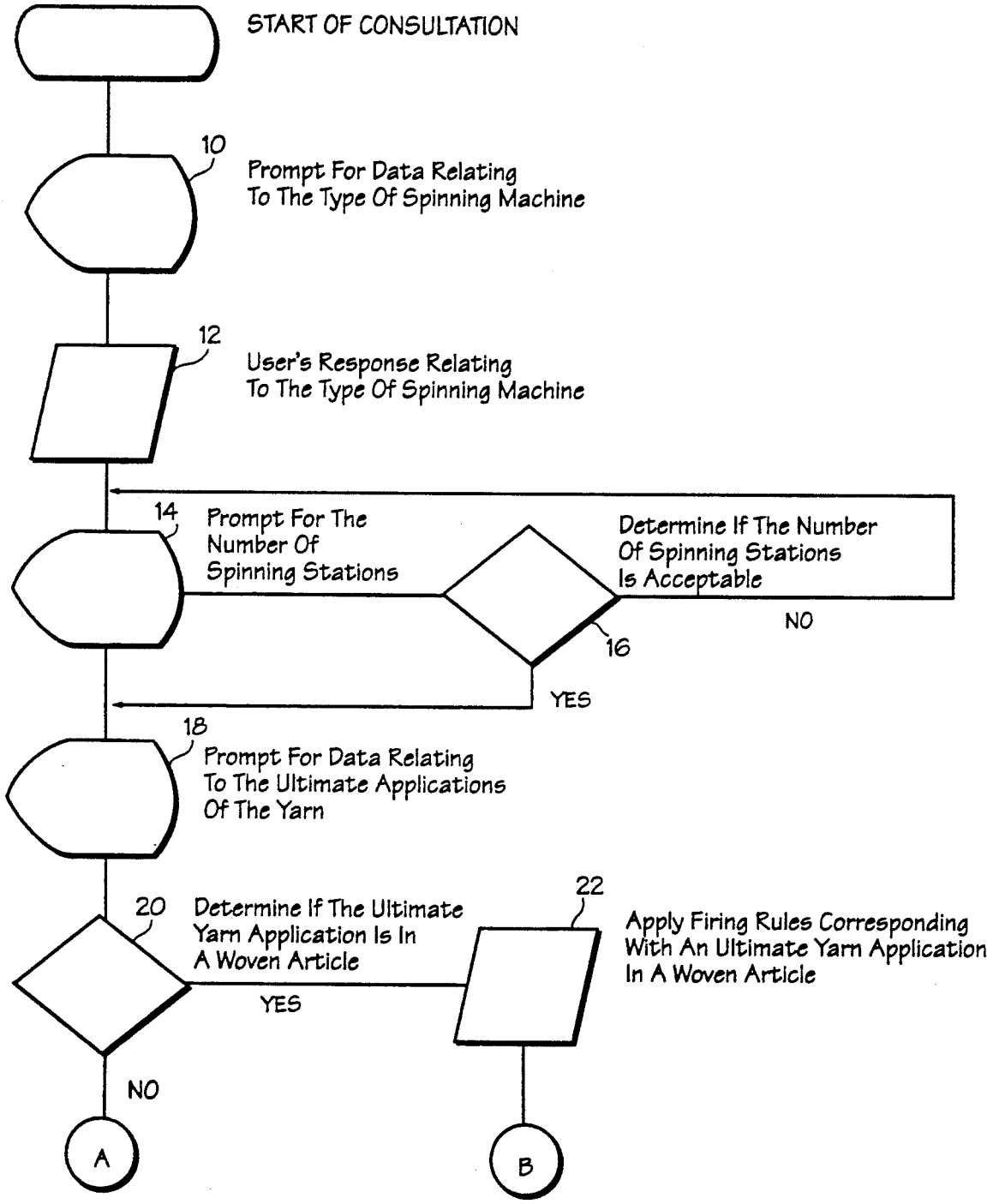
FIGS. 3*a*–3*d* are each a portion of a single flow diagram of the software operation performed in a representative consultation conducted in accordance with the method of the present invention.
Figure 3B:
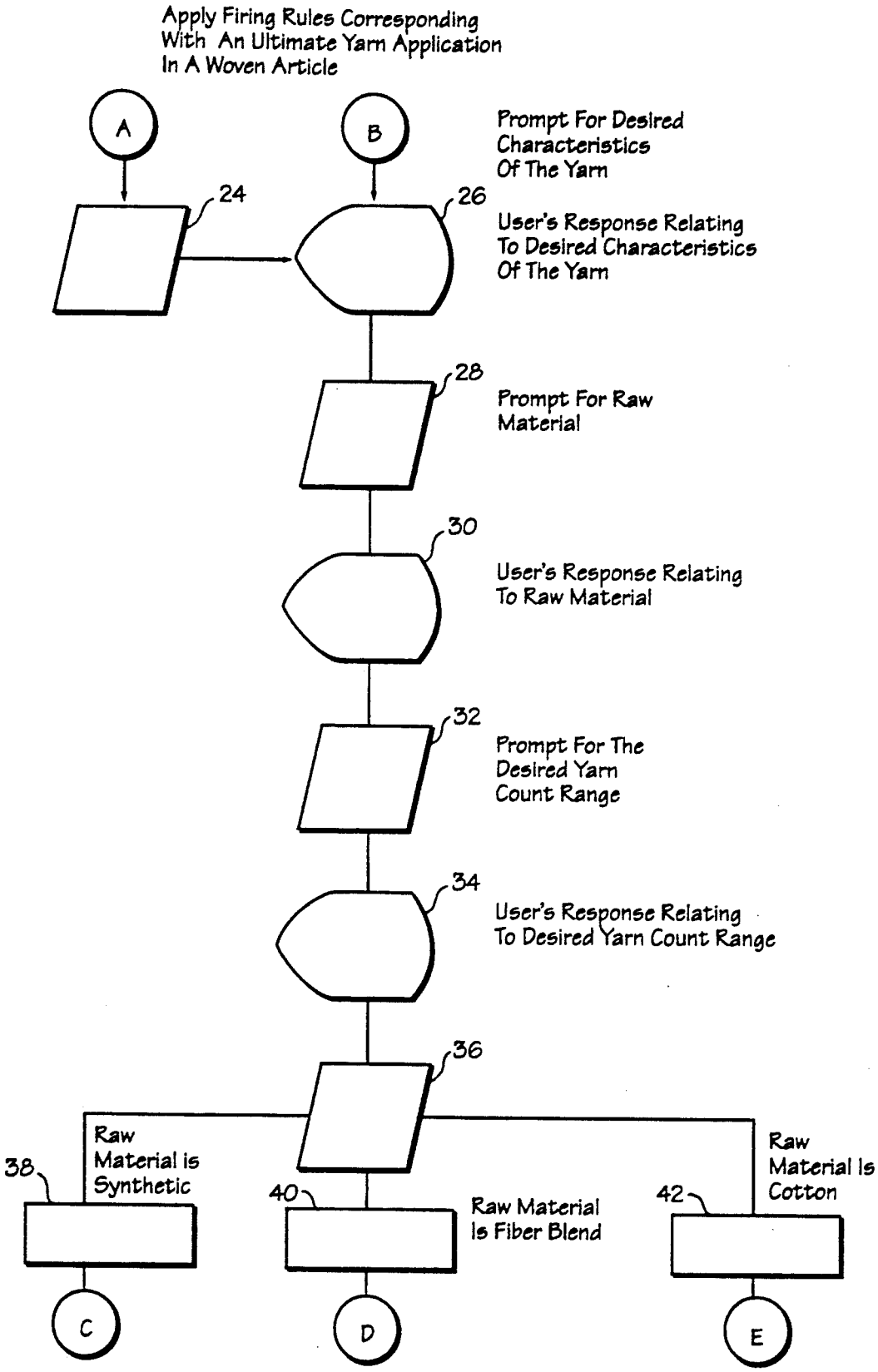
Figure 3C:
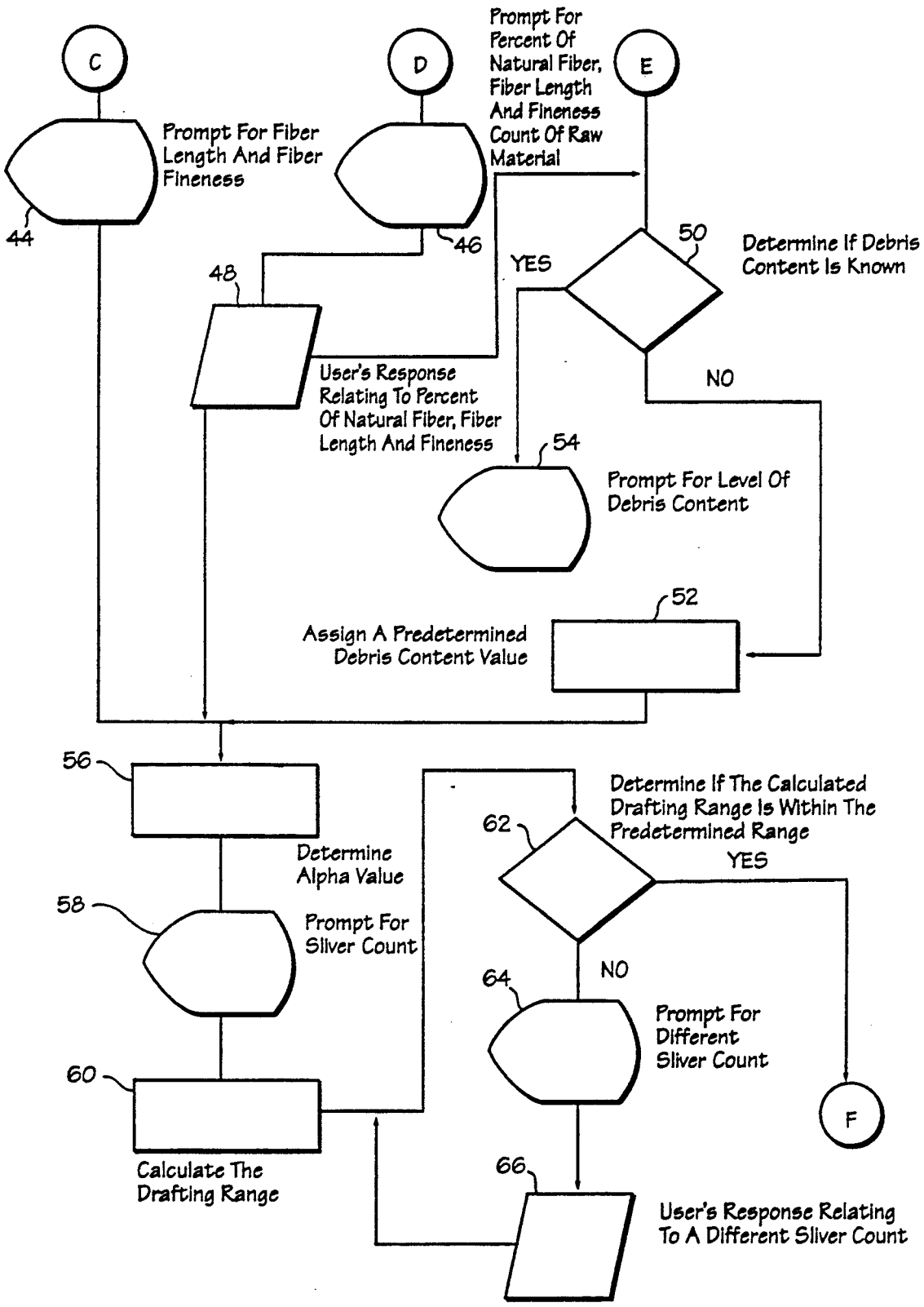
Figure 3D:
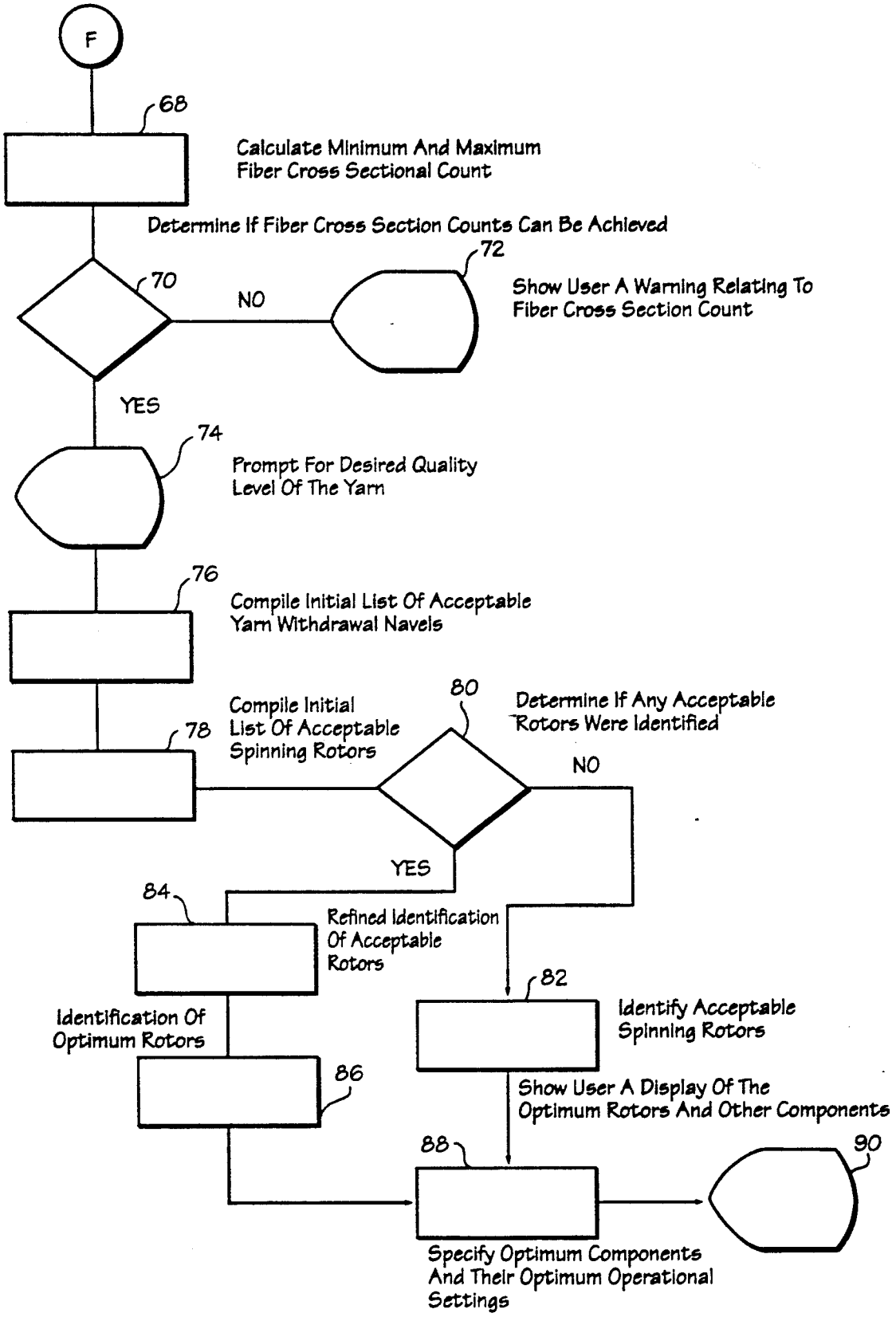

FIG. 2 is a schematic general overview of the interrelation of the rotor spinning knowledge system of the present invention and a yarn manufacturer 1. In similar manner to the prior art process discussed with respect to FIG. 1, the yarn manufacturer 1 provides information 2 relating to the raw material from which the desired yarn will be manufactured and information relating to a desired yarn objective 3. However, instead of providing this information to the technical experts of a rotor spinning component manufacturer for their consideration of the information to determine the optimum rotor spinning components and their operational characteristics, the yarn manufacturer 1 consults the rotor spinning knowledge system in a consultation 4. The consultation 4 includes the inputting of the known yarn information 2 and the desired yarn objective 3, in accordance with certain prescribed formats to be discussed later, into a conventional digital computer which is loaded, for example, with a software version of the rotor spinning knowledge system of the present invention.

The consultation 4 involves a series of questions to be answered by the yarn manufacturer 1 to obtain information for processing by the rotor spinning knowledge system of the present invention. The inputted data is processed by the computer under the control of the rotor spinning knowledge system and recommendations including suggested optimum spinning components for use in the rotor spinning process 5 are ultimately presented to the yarn manufacturer The yarn manufacturer implements the suggestions provided by the rotor spinning knowledge system through an implementation 6 which may include installation and/or adjustment of the identified optimum spinning components and the production 7 of the desired yarn.

The series of information gathering questions and responses, commonly referred to as the consultation, are graphically shown in the flow diagram of FIG. 3 which additionally schematically shows the processing steps executed by the digital computer in accordance with the commands of the rotor spinning knowledge system. To further explain the operation of the rotor spinning expert system of the present invention, a representative consultation involving the processing of input information provided by a user by the rotor spinning knowledge system of the present invention will now by discussed. An Appendix A, attached to and part of the present specification, is a typescript of a representative consultation. As can be seen, the typescript is comprised of certain information input by the user, questions asked of the user by the rotor spinning knowledge system, listings of various rules, and display of values determined in accordance with rules including values assigned by the rules corresponding to user-provided information and values determined by the rules in default circumstances in which no user information has been provided.

The typescript of the representative consultation in Appendix A should be viewed in the context of FIG. 3 which is a flow chart of the control sequence of the rotor spinning knowledge system. It should be understood, however, that the rotor spinning knowledge system of the present invention is designed to operate in the manner of conventional so-called expert systems and accordingly includes the application of backward and forward chaining rules, control blocks, and other conventional characteristics of such expert systems. The rotor spinning knowledge system has been implemented in a practical application through the use of conventional expert system software in the form of IBM and of Expert System Environment Software. First, the user is prompted for information relating to the type and production capacity of the spinning machine in which the spinning components recommended by the rotor spinning knowledge system will be used. This prompting activity is designated by the block 10 in FIG. 3. In response to the prompt of the block 10, the user identifies the type of spinning machine. The user may organize the information which will be requested during the consultation on a hand marked sheet such as representatively shown in FIG. 4. Thus, the user would refer to the heading under "A Machine Data" and, specifically, to the entry "Type of Spin Box" to input the information which the user has previously hand marked on the sheet into the computer. The knowledge base of the rotor spinning knowledge system supplies a default value corresponding to a predetermined type of spinning machine if no information is provided by the yarn manufacturer 1. For example, in the representative consultation in Appendix A, the rotor spinning knowledge system commands the computer to assign a default value corresponding to a spinning machine of the type denominated as "SE 8" in response to the absence of a response from the user to the prompt of block 10. A block 12 in FIG. 3 depicts the inputting of the spinning machine type information by the user.

The next step of the control sequence illustrated in FIG. 3 is a prompt, depicted by the block 14, for data relating to the number of spinning stations. This prompt is denominated as ANZ SPINNST in the control sequence in Appendix A. If desired, the knowledge system can include a rule that the number of spinning stations must be divisible by a predetermined number, such as, for example, 24. If such a rule applies, the knowledge system makes a determination, illustrated by the block 16 in FIG. 3, whether the number of spinning stations inputted by the user satisfies the rule. If the number of spinning stations inputted by the user is not divisible by the predetermined number, the knowledge system assigns a default number of spinning stations. The default number of spinning stations can be tested at a later step in the control sequence to determine if the number is appropriate.

The next step in the control sequence is a prompt, illustrated by the block 18, for information relating to the ultimate product application of the yarn. The rules in the knowledge system relating to the ultimate product application of the yarn are denominated in the typescript in Appendix A as "EINSATZZWECK M" and "EINSATZZWECK W". Each of the two rules includes a so-called firing rule which is applied to exclude the application of the other rule if one of the pair of rules is satisfied by the information provided by the user. Specifically, in replying to the prompt illustrated in the block 18, the user must specify that the ultimate product application of the yarn is either a weaving application or a knitting application, with each respective application satisfying one of the two rules. Accordingly, if the user were to indicate, for example, that the ultimate product application of the yarn is a weaving application, the premise of the rule "EINSATZ-ZWECK W" is satisfied and the firing rule is applied to preclude the knowledge system from considering parameters associated with the other application (in this example, the knitting application) during the remaining course of the consultation.

The user is presented with a number of questions concerning predetermined characteristics of the yarn in correspondence with the ultimate product application of the yarn. In this regard, the knowledge base of the knowledge system includes factual knowledge relating to those yarn characteristics which are preferably taken into consideration with regard to the particular ultimate yarn product application. For example, as seen in the typescript of the representative consultation in Appendix A, the user is presented with a prompt requesting information concerning certain yarn characteristics associated with a yarn to be used in a weaving application and this prompt is illustrated by the block 26. FIG. 5 is a listing of selected yarn characteristics that a user may desire in a yarn which will ultimately be used in a weaving application. The knowledge system permits the user to choose the relative frequency or significance of the particular yarn character in the yarn. For example, the user can indicate that one desired yarn characteristic is a high degree of hairiness. The rotor spinning knowledge system includes rules which relate the yarn characteristics of the ultimate product which will comprise the yarn, the quality characteristics of the yarn and the type of raw material from which the yarn will be produced. Reprinted below is an example of one such rule illustrated in the typescript of the representative consultation shown in Appendix A:

```
                    71
1 -- Trying Rule WEITERVER_LUFTD of EINGABE(1) --
                    47

                    0
4   IF ((art_w = 'Corduroy'
                    58
5   and (a_d_hfp_cord = 'Pile filling'
                    58
5   or a_d_hfp_cord = 'Ground filling'))
                    58
```

-continued

```
5   or (art_w = 'Velours'
                    58
6   and (a_d_hfp_velour = 'Pile filling'
                    58
5   or a_d_hfp_velour = 'Ground filling'))
                    58
5   or (art_w = 'Terry towel'
                    58
6   and a_d_hfp_frot = 'Ground filling')
                    58
5   or (art_w = 'Denim (classical)'
                    58
6   and a_d_hfp = 'Weft')
                    58
6   and warenbild is known
                    58
6   and markenart is known )
                    58
6   and wv_i_w = 'Air jet'
                    58
4   THEN gch_h = 'Medium'
                    33

                    0
1   Unknown parameter(s) in the premise:
                    36
1   A_D_HFP of AUTOCORO(1) (Current State:UnProcessed)
                    50
1   WARENBILD of EINGABE(1) (Current State:UnProcessed)
                    51
1   MARKENART of EINGABE(1) (Current State:UnProcessed)
                    51
1   WV_I_W of EINGABE(1) (Current State:UnProcessed)
                    48
```

The rule "WEITERVER LUFTD OF EINGABE (1)" specifies that if: 1) the ultimate product is a "corduroy" woven article (identified in the rule as "art W='Corduroy'"); 2) the yarn to be spun will be processed into an intermediate "pile filling" work-in-process-product from which the "corduroy" article will ultimately be produced (identified in the rule as "A D HFP CORD='pile Filling'"); 3) other characteristics of the ultimate product are known such as, for example, the brand style of the ultimate product (identified in the rule as "MARKENART IS KNOWN"), then the preferred hairiness characteristic of the yarn is a "medium" hairiness characteristic. This is identified in the conclusion of the rule as "THEN gch h=Medium".

Following the application of such rules as are necessary to identify the desirable yarn characteristic, the rotor spinning knowledge system assigns a selected relative grade of each of the desired characteristics. For example, if denium is the type of woven article to be produced with the yarn and the yarn will be intermediately processed into a warp work-in-process, the rotor spinning knowledge system may apply a rule as follows:

```
                    71
1 -- Trying Rule AUFM_DENIM_KETTE_VW_MA of EINGABE(1) --
                    54

                    0
4   If art_w            = 'Denim (classical)'
                    58
4   and
                    58
4   a_d_hfp             = 'Warp'
                    58
4   and
                    58
4   warenbild           = 'Indistinct'
                    58
4   and
                    58
```

-continued

```
4   markenart          = 'yes'
                58
4   then
                58
4   gch_bba            = 'acceptable'    ,
                58
4   gch_kri            = 'Low'    ,
4   gch_gl             = 'Moderately good'    ,
                58
4   gfk_g_m_h          = 'Very high'    ,
                58
4   gch_d              = 'High'    ,
                58
4   moegl_qualitaet    = 'Service life'    ,
                58
4   rs_art             = 'Cotton'  ,
                58
4   moegl_rs_art_bw    = ('100%','Regenerated','Comber noils'
                58
22                         ,'Blends thereof')
                39

                 0
1   >>>> GCH_BBA
                12
3   assigned = 'acceptable' (1).
                71

                 5
1   >>>> Resulting value after assignment:
                38
1   'acceptable' (1)
                16
1   >>>> GCH_KRI
                12
3   assigned = 'Low' (1).
                71

                 5
1   >>>> Resulting value after assignment:
                38
1   'Low' (1)
                 9
1   >>>> GCH_GL
                11
3   assigned = 'Moderately good' (1).
                71

                 5
1   >>>> Resulting value after assignment:
                38
1   'Moderately good' (1)
                21
```

The application of the above-displayed rule "AUFM DENIM KETTE VW MA OF EINGABE (1)" results in the knowledge system assigning: 1) a relative grade level of "acceptable" to the frequency of fiber wraps (identified in the rule as "GCH BBA"); 2) a relative grade "low" to the yarn characteristic of tendency toward snarling (identified in the rule as "GCH KRI"); and 3) a relative grade of "moderately good" to the yarn characteristic of evenness (identified in the rule as "GHC GL").

In the next step, the rotor spinning knowledge system prompts the user to provide information relating to the raw material from which the yarn will be produced, illustrated by the block 30 in FIG. 3. The user can provide a response, illustrated by the block 32, that the raw material of the yarn to be produced is, for example, a synthetic material, a blend of synthetic and natural fibers or cotton. Reprinted below is a portion of the typescript in the Appendix A which indicates that the selected raw material in the representative consultation is "cotton".

```
1 >>>> RS_ART
                11
3 assigned = 'Cotton' (1).
                71

                 5
1 >>>> Resulting value after assignment:
                38
1 'Cotton' (1)
                12
1 && Trying monitor rules for RS_ART of EINGABE(1) &&
                51
```

Once the user has provided information concerning the raw material from which the yarn will be produced, the rotor spinning knowledge system applies so-called "MONITOR" rules which block the knowledge system from considering parameters associated with raw materials other than the selected raw material. Reprinted below is an excerpt from the typescript of the representative consultation in Appendix A.

-continued

```
1 -- Trying Monitor Rule AUFM_MISCH of EINGABE(1) --
                    50

                    0
4   if rs_art is not 'Fiber blends'
                    58
4   then dont consider gr_mischungen
                    35

                    0
1 >>>> DONT CONSIDER set for Parameter RS_ART_MIWO(1) of FCB AUTOCORO(1).
                    71
1 >>>> DONT CONSIDER set for Parameter RS_ART_MICH(1) of FCB AUTOCORO(1).
                    71
1 >>>> DONT CONSIDER set for Parameter RS_ART_MISY(1) of FCB AUTOCORO(1).
                    71
1 >>>> DONT CONSIDER set for Parameter RS_ART_MIBW(1) of FCB AUTOCORO(1).
                    71
1 >>>> DONT CONSIDER set for Parameter MIWO_PROZ(1) of FCB AUTOCORO(1).
                    69
1 >>>> DONT CONSIDER set for Parameter MISY_PROZ(1) of FCB EINGABE(1).
                    68
1 >>>> DONT CONSIDER set for Parameter MICH_PROZ(1) of FCB EINGABE(1).
                    68
1 >>>> DONT CONSIDER set for Parameter MIBW_PROZ(1) of FCB EINGABE(1).
                    68
```

The above-depicted monitor rule "AUFM MISCH OF EINGABE (1)" blocks the knowledge system from considering parameters associated with fiber blends if the selected raw material is not a fiber blend (i.e.—a blend of synthetic and natural fibers). To block consideration of the parameters relating to the non-selected raw material, the knowledge system implements several "DONT CONSIDER" blocking rules relating to each of the non-selected raw materials. In the representative consultation depicted in Appendix A, the non-selected raw materials include raw materials comprised of a mixture of synthetic and wool fibers and a mixture and synthetic and cotton fibers.

The knowledge system additionally includes control blocks comprising rules which insure that the cumulative total of the percentages of the respective raw materials equal 100%.

Additionally, the rotor spinning knowledge system can be configured to prompt the user for the desired or preferred yarn count range, as illustrated by the block 34 in FIG. 3. If such information is requested, the user provides the information, as illustrated by the block 36.

The rotor spinning knowledge system then presents inquiries to the user concerning characteristics of the selected raw material. Depending upon the selected raw material, a predetermined chain of rules are applied. For example, if the selected raw material is a synthetic, the rotor spinning knowledge system applies a predetermined set of rules, as illustrated by the block 38. Alternatively, if the raw material is a fiber blend, the rotor spinning knowledge system applies a different chain of rules, as illustrated by the block 40. As an additional alternative, the rotor spinning knowledge system will branch to yet another predetermined chain of rules upon receiving information that the raw material is cotton, as illustrated by the block 42 in FIG. 3.

FIG. 3 illustrates possible control sequences followed by the rotor spinning knowledge system in correspondence with the identification of the raw material as a synthetic, a fiber blend or cotton raw material. As illustrated by the block 44 in FIG. 3, the knowledge system ca prompt the user for information concerning the characteristics of the synthetic fibers such as, for example, the preferred fiber length and the preferred fiber fineness. Alternatively, if the knowledge system is informed that the raw material is a fiber blend, the knowledge system prompts the user, as illustrated by the block 46, for information concerning the percent of natural fiber, the percent of synthetic fiber, the preferred fiber length and the preferred fiber fineness. For example, the knowledge system may prompt the user for information concerning the minimum acceptable yarn fineness count. Reprinted below is an excerpt from the type script of the representative consultation in Appendix A illustrating the prompt by the knowledge system for such information.

```
2 +++ Ask Values +++
                    19
5 value of GFH_MIN_EING ( 1)(1)
                    34
5 value of RS_ART ( 1)(1)
                    28
1 --Focus On
                    10
1 --Ignore
                     8
1 --Dont Ask
                    10
1 ==> Asking for the value of GFH_MIN_EING
                    40
1 Value of GFH_MIN_EING(1) Before User Interaction:
                    49
3 (No values assigned to the parameter at this time.)
                    53
1 >>>> User response:
                    19
3 assigned = 'Nm' (1).
                    71
                     5
1 >>>> Resulting value after assignment:
                    38
1 'Nm' (1)
                     8
1 >>>> User response:
                    19
3 assigned = 14 (1).
                    71
                     5
```

As depicted above, the knowledge system requests a value of "GFH MIN EING" and thereafter assigns a minimum yarn fineness count value corresponding to the user response of "14". In yet another control sequence, if the knowledge system receives information that the raw material is 100% cotton or, as illustrated by the block 48, receives information that the natural fiber content of the selected fiber blend is cotton, the knowledge system prompts the user for information concerning the debris or trash content of the cotton raw material.

As illustrated by the block 50, the knowledge system prompts the user to confirm that the debris or trash content of the cotton raw material is known. If the debris or trash content of the cotton raw material is not known, the knowledge system assigns a predetermined debris content value, as illustrated by the block 52, and displays this predetermined debris content value to the user. Alternatively, if the user responds affirmatively to the prompt illustrated in block 50 that the debris or trash content of the cotton raw material is known, the knowledge system prompts the user for information concerning the preferred or desired level of the debris or trash content of the cotton raw material. In this regard, the user can supply information in any conventionally accepted unit such as, for example, the Shirley Trash Seperatorals. If desired, the knowledge system can be configured to display the operational limits of individual rotor types and sizes with respect to the maximum level of trash or debris of the cotton raw material which can be accepted in the cotton raw material to be handled by the particular individual type or size of rotor.

The default assignation of a predetermined debris or trash value is indicated in the Appendix A by the typescript "E P FLAG" in which a predetermined value is assigned as "0".

The rotor spinning knowledge system then determines values for the dust content and trash content of the raw material from which the yarn will be produced. As shown in the below-excerpted passage from the typescript in Appendix A, if the raw material is a synthetic material or a fiber blend which does not comprise any cotton, the knowledge system sets the dust and trash content to a value of 0.

The conclusion of the above illustrated rule is "rdv trashf=0", indicating that the rotor spinning knowledge system has set the dust and trash content at a value of 0.

Similarly, the knowledge system sets the trash and dust content to 0 if the user does not state a preferred content level. In this regard, if the raw material is cotton or is a fiber blend comprising cotton and the dust and trash content each have a value of 100 on a scale of 0 to 100, the knowledge system displays an appropriate caution to the user that the proposed raw material (i.e. sliver) is not suitable and that no appropriate rotor can be identified. The following excerpt from the typescript of Appendix A reprinted below illustrates this control sequence.

```
                0
4 if ( rs_art = 'Cotton'
                58
4 or currently mibw_proz > 0)
                58
4 and vorwerk = 'inadequate for rotor spinning'
                58
4 and (art_w is not 'Bed linen, napped (flanelle)'
                58
9 or not there is art_w)
                58
4 then rdv_dust = 100
                58
4 and rdv_trash = 100
                58
4 and show 'As the sliver is unsuitable due to unsufficie
                58
4 nt spinning preparation, a suitable rotor could not be
                58
4 found. :br
                58
4 Please make sure that your spinning preparation meets t
                58
```

The knowledge system includes an exception to the above-described control sequence which results in a caution to the user regarding the lack of a suitable rotor. If the ultimate product to be produced from the yarn is

```
                71
1 --Trying Rule P_R_BANDREINHEIT_N_BW of PLAUSIBILITAETSPRUEFUNG(1)--
                69
                 0
4 IF (rs_art =    ('Cellulosic fibers',
                58
10 'Synthetic fibers (e.g. PES, PAC)',
                58
10 'Wool (not yet implemented) ')
                58
5 or (rs_art =    'Fiber blends'
                58
10 and mibw_proz = 0 ))
                58
4 THEN rdv_dustf = 0
                58
5 and summe_dust = 0.00
                58
5 and r_bw_dust_500 = 0.0
                58
5 and r_bw_dust_15 = 0.0
                58
5 and r_bw_dust_50 = 0.0
                58
5 and r_bw_dust_100 = 0.0
                58
5 and r_bw_trash_gem = 0.0
                58
5 and r_bw_trash_gem_sh = 0.0
                58
5 and rdv_trashf = 0
                23
```

napped or flannel bed linen, then the knowledge system does not present a caution to the user. This is shown in the above-depicted excerpt as "AND (ART W IS NOT "BED LINEN, NAPPED) (FLANELLE" or not there is ART W)".

If the dust and trash content of the raw material is not specified, as noted above, the knowledge system sets the content value of the dust and trash to a value of 0 which corresponds to raw material which is virtually free of any dust or trash. Consequently, virtually all rotors are suitable for processing such highly dust and trash-free raw material; characteristics other than the dust and trash content of the raw material will therefore influence the determination by the knowledge system of the appropriate coating and opening roller of the rotor.

The knowledge system then determines the value for the degree of twist to be imparted to the yarn, commonly referred to as an "Alpha" value and illustrated by the block 56 in FIG. 3. More specifically, the knowledge system determines an "Alpha" value based upon the ultimate product to be produced with the yarn, the yarn strength and other appropriate characteristics. Reprinted below is an excerpt from the typescript in Appendix A showing one possible rule which the knowledge system ma apply to determine an "Alpha" value.

```
4 IF currently art_w = 'Denim (classical)'
                58
4 and rs_art = 'Cotton'
                58
4 and (gfh_nm_min + gfh_nm_max) / 2
                58
8 is in interval >= 8 : <= 17
                58
4 then
                58
4 gdbw_a_met = 150
                20
```

-continued

```
                0
1 Unknown parameter(s) in the premise:
                36
1 GFH_NM_MIN of EINGABE(1) (Current State:UnProcessed)
                52
1 GFH_NM_MAX of EINGABE(1) (Current State:UnProcessed)
                52
```

The rule depicted above indicates that if the type of woven material is "denim" ("if currently ART W=Denim (classical)") and the selected raw material is cotton ("and RS ART ="Cotton",) and, further, if the value of the minimum fineness count of the yarn plus the maximum fineness count of the yarn divided by two is greater than or equal to 8 and less than or equal to 17 ("and (GFH NM MIN+GFH NM MAX)/2 is an integral greater than or equal to 8 and less than or equal to 17"), then the Alpha value is set at 150 ("then GDBH A MET+150").

Following the determination of the yarn twist or "Alpha" value, the knowledge system prompts the user for information concerning the desired sliver count, as illustrated by the block 58 in FIG. 3. Specifically, the user is asked to provide information concerning the maximum rotational speed of the opening roller. In this regard, the knowledge system applies a plurality of rules by which the maximum rotational speed of the opening roller is set to a predetermined value depending upon the certain yarn characteristics such as a fiber fineness count below a predetermined value or a fiber length value below a predetermined value. If one or several of these fiber characteristics is present to satisfy the rule, then the maximum rotational speed of the opening roller is set to a predetermined value such as, for example, 100,000 rotations per minute. Reprinted below is an excerpt from the typescript in Appendix A of the representative consultation showing one such rule.

```
                71
1 -- Trying Rule P_R_N_MAX_100_EING of PLAUSIBILITAETSPRUEFUNG(1) --
                66
                 0
4   IF rs_art = ('Cotton','Cellulosic fibers')
                58
5   or ( currently rs_art_sy = 'Polyacrylic'
                58
5   or currently rs_art_misy = 'Polyacrylic')
                58
5   and (( currently ffh_sy_eing <= 1.0
                58
10  and currently fl_syn <= 32 )
                58
6   or currently ffh_sy2 <= 1.0
                58
10  and currently fl_syn2 <= 32 )
                58
4   THEN n_max_syn_eing = 100000
                31

                 0
1   >>>> N_MAX_SYN_EING
                19
3   assigned = 100000 (1).
                71

                 5
1   >>>> Resulting value after assignment:
                38
1   100000 (1)
                11
1   Premise of Rule P_R_N_MAX_100_EING of PLAUSIBILITAETSPRUEFUNG(1)
                65
1   succeeded with certainty (1).
```

-continued

29

Following the determination of the maximum rotational speed of the opening roller, the knowledge system calculates the drafting range in correspondence to the desired yarn strength and the assigned maximum rotational speed of the opening roller, as illustrated by the block 60 in FIG. 3. If the calculated drafting range is a value outside a range of standard values such as, for example, a range of standard values from 30 to 212, the knowledge system applies a rule to determine whether the calculated drafting range is within the predetermined range, as illustrated by the block 62 in FIG. 3. If the calculated drafting range is outside of the predetermined range, the knowledge system prompts the user to consider whether another drafting rang can be used which includes, for example, a rotor having a larger withdrawal navel, as illustrated by the block 64 in FIG. 3. If desired, the knowledge system can be configured to provide the user with a single opportunity for indicating if the proposed alternative drafting range is acceptable, such as illustrated by the block 66, and the knowledge system will thereafter automatically select a higher drafting range in the event that the user chooses not to select the proposed alternate drafting range. For example, the knowledge system may automatically select a drafting range of between 39 to 276.

As a further step, the knowledge system calculates the minimum fiber cross sectional count and the maximum fiber cross-sectional count, as illustrated by the block 68 in FIG. 3. The minimum fiber cross-sectional count is expressed as a value per 100 fibers in cross-section. The knowledge system then compares the calculated minimum fiber cross-sectional count and the maximum fiber cross-sectional count with preset values to determine if these fiber counts are operationally achievable, as illustrated by the block 70 in FIG. 3. If the calculated fiber cross-sectional count cannot be achieved, the knowledge system provides a display, as illustrated by the block 72 in FIG. 3, to the user to prompt the user to select or stipulate to a suitable fiber cross-section count. Reprinted below is an excerpt from the typescript in the Appendix A illustrating such a display.

```
                    71
1 -- Trying Monitor Rule FASERANZAHL_NICHT_AUSR of
                    49
1   PLAUSIBILITAETSPRUEFUNG(1) --
                    29

                    0
4   if fz_i_q_min < mfaz
                    58
4   then
                    58
4   show  'The yarn count cannot be achieved, as the fibers
                    58
5   are too coarse, i.e. the minimum number of fibers in
                    58
4   the cross-section is too small. :br
                    58
4   If you want to go on with the consultation, :br
                    58
4   ENTER key. :br
                    58
4   If not, press PF3-key twice to terminate.'
                    45
```

If the desired yarn cannot be produced from the selected raw material, the user may choose to end the consultation.

Thereafter, the knowledge system prompts the user for information concerning the desired quality level of the yarn to be produced, as illustrated by the block 74 in FIG. 3. The knowledge system provides three quality levels. One quality level is denominated as "service life" and yarns produced to this quality level have high durability and are of relatively average quality. The next higher quality level is denominated as "quality" and refers to a relatively high quality level which is achieved while the opening roller rate of rotation is relatively high. The highest quality level is denominated as "extra quality" and refers to the relatively highest quality of yarn achievable (this quality level is probably only achievable through an opening roller rate of rotation less than the maximum possible rate of rotation). The user's election of one of these three desired quality levels influences the type of spinning components which can be suggested as a result of the consultation. For example, the selection of the quality level "service life" will likely result in the ultimate recommendation of spinning components such as a rotor and opening roller which are provided with special coatings. On the other hand, the selection of the "extra quality" level of quality would likely result in a recommendation that the recommended opening roller be operated at less than its maximum rate of rotation.

The rotor spinning knowledge system then compiles an initial list of acceptable yarn withdrawal navels, as illustrated by the block 76 in FIG. 3. The initial list of acceptable yarn withdrawal navels is compiled based on information which has previously been provided by the user or otherwise designated during the course of the consultation relating to the raw material, the characteristics of the raw material and the selected quality level of the yarn. Reprinted below is an excerpt from the typescript in Appendix A of the representative consultation showing the application of a rule to determine one possible yarn withdrawal navel:

```
                    71
1 -- Trying Rule S_R_ALW_BW_N_V of SPINNMITTEL(1) --
                    50

                    0
4   if verschleiss is not 'Service life'
                    58
4   and rs_art = 'Cotton'
                    58
4   and (gfh_nm_max >= 40
                    58
5   or rdv_trashf <= 40
                    58
5   or sl_bw_fuenfzig >= 13 )
                    58
4   then alw = 'B 20'
                    20

                    0
1   >>>> ALW
                    8
3   assigned = 'B 20' (1).
                    71
```

The rule depicted above indicates that if the desired quality level of the yarn is not "service life" (if PERSCHLEISS is not "service life"), the selected raw material is cotton (and RS ART="Cotton") and in further consideration of other characteristics of the raw material such as the trash content, then the yarn withdrawal navel designated as "B 20" is initially chosen ("assigned equal 'B 20'").

In connection with compiling an initial list of acceptable yarn withdrawal navels, the rotor spinning knowledge system compiles an initial list of acceptable spinning rotors. In this regard, the knowledge system take into consideration information concerning the percent of the dirt content of a cotton raw material, the fiber length and the characteristics of the yarn to be produced in determining an appropriate initial list of acceptable spinning rotors. Additionally, the rotor spinning knowledge system can be configured to determined the appropriate coating characteristic of the selected acceptable spinning rotors. For example, if "aggressive" cotton is the raw material, a borid coated rotor would typically be included in the list of acceptable spinning rotors. Reprinted below is an excerpt from the typescript in Appendix A illustrating a rule for selecting an appropriate rotor coating:

```
1 -- Trying Rule BESCH_B_ROTOR of SPINNMITTEL(1) --
                49

                 0
4   IF verschleiss = 'Service life'
                58
5   or ((rs_art = 'Cotton'
                58
5   or (rs_art = 'Fiber blends'
                58
8   and currently mibw_proz > 0 ))
                58
5   and currently rs_bw_verschmutz =
                58
8   ('aggressive Veschmutzung (z.B. Sand)',
                58
9   'sticky (such as honeydew, seed oil)'))
                58
4   THEN besch = 'B'
```

The rule depicted above indicates that if the desired quality level of the yarn is "service life" and the raw material is cotton or fiber blends and, further, that the dirt content is sticky than the coating designated as "B" would be suggested.

Reprinted below is an excerpt from the typescript in Appendix A illustrating the application of a rule which evaluates a particular spinning rotor as a possible candidate for the initial list of acceptable spinning rotors:

```
                71
1 -- Trying Rule ROT_G_36 of SPINNMITTEL(1) --
```

-continued

```
                44
                 0
4   IF  rs_art        = 'Cotton'
                58
4   and rdv_trashf <= 40
                58
4   and rdv_dustf  <= 40
                58
4   and spinnb_typ is not 'SE 7'
                58
4   and rs_fl_mm    <= 40
                58
4   and ffh_max_sy_ch <= 2.25
                58
4   and (gch_bba = 'acceptable' or not there is gch_bba)
                58
4   and (gch_kri     = 'Low'    or not there is gch_kri)
                58
4   and (gch_gl is not 'Very good' or not there is gch_gl)
                58
4   and (gch_goe     = 'no'     or not there is gch_goe)
                58
4   and (gch_r       = 'no'     or not there is gch_r)
                58
4   and (gch_vol is not 'Great' or not there is gch_vol)
                58
4   and (gch_wg      = 'yes'    or not there is gch_wg)
                58
4   and (gch_k       = 'Low'    or not there is gch_k)
                58
4   and (gch_h  is not 'High'     or not there is gch_h)
                58
4   then
                58
4   rot_f    = 'G'   ,
                58
4   rot_d    = 26    ,
                58
```

The rule depicted above indicates that if the raw material is cotton ("if RS ART="Cotton"; the trash value is below 40; the tendency towards snarling is low; and if other predetermined yarn characteristics are present then a rotor designated as "G" having a diameter of 36 is suggested.

Following the compilation of an initial list of acceptable spinning rotors, the rotor spinning knowledge system determines if, in fact, any acceptable rotors were identified, as illustrated by the block 80 in FIG. 3. If no acceptable rotors were identified, the rotor spinning knowledge system designates a rotor by default, taking into account information concerning the acceptable dirt content of the cotton raw material, the yarn strength, and the yarn characteristics of uniformity and tendency toward snarling, as illustrated by the block 82 in FIG. 3.

Reprinted below is an excerpt from the typescript of the representative consultation of Appendix A illustrating the application of a rule to identify a representative acceptable rotor.

```
1 -- Trying Rule ROT_T_36_TST of SPINNMITTEL(1) --
                48
                 0
4   IF rot_hilfspar is not known
                58
4   and  rdv_trashf  <= 35
                58
4   and  rdv_dustf   <= 75
                58
4   and  spinnb_typ is not  'SE 7'
                58
4   and  rs_fl_mm    <= 40
                58
4   and  ffh_max_sy_ch <= 2.25
                58
4   and (gch_k is not 'Very good' or not there is gch_k)
                58
```

-continued

```
4   and (gch_bba is not 'Very low' or not there is gch_bba)
                58
4   and (gch_kri is not 'High'      or not there is gch_kri)
                58
4   and (gch_goe   is not 'gut'    or not there is gch_goe)
                58
4   and (gch_r    is not 'Very good' or not there is gch_r)
                58
4   and (gch_vol     =     'Great' or gch_vol = 'Medium'
                58
27                              or not there is gch_vol)
                58
4   and (gch_wg     = 'yes'        or not there is gch_wg)
                58
4   and (gch_h = 'High' and gch_d = 'Low'
                58
5   and (azd = 'KN /R 4' or azd = 'KN 4/R 4')
                58
5    or gch_h    = 'Medium' or not there is gch_h)
                58
4    then
                58
4    rot_f   = 'T'    ,
                58
4    rot_d   = 36    ,
                58
4    rot_b   = besch,
                58
4    rot_ts     = 'TS ..',
                58
4    rot_n_max    = 90000,
                58
4    rot_n_min    = 80000,
                58
4    ep_rot_gfh_max_q = 90,
                58
4    ep_rot_gfh_min_q = 26,
                58
4    ep_rot_gfh_max_s = 90,
                58
4    ep_rot_gfh_min_s  = 20,
                58
4    e_p_r_help = 1
                17
                 0
1 >>>> ROT_F
                10
3    assigned = 'T' (1).
                71
                71
1 -- Trying Rule AR_R_ROT_ABGL_K_TS of ABGL_ROT(1) --
                 0
4   IF   n_max                >=  element a_p_nr from rot_n_max
                58
4   and  n_rot_abzug_v     >=  element a_p_nr from rot_n_max
                58
4   and (Verschleiss is not  'Service life'
                58
4   and (gfh_nm_max   <=   element  a_p_nr  from  ep_rot_gfh_max_q
                58
4   and a_p_anz_rot = 1
                58
5    or a_p_gfh_nm_hp     <=  element a_p_nr from
                58
34                                        ep_rot_gfh_max_q
                58
4   and a_p_anz_rot = 2)
                58
4   and (gfh_nm_min    >=   element  a_p_nr  from  ep_rot_gfh_min_q
                58
4   and a_p_anz_rot = 1
                58
5    or a_p_gfh_nm_hp    >=   element a_p_nr from
                58
37                                         ep_rot_gfh_min_q
                58
12             and a_p_anz_rot = 2)
                58
5    or   Verschleiss = 'Service life'
                58
4   and (gfh_nm_max   <=   element  a_p_nr  from  ep_rot_gfh_max_s
                58
4   and a_p_anz_rot = 1
```

-continued

```
                58
5   or a_p_gfh_nm_hp  <=  element a_p_nr from
                58
34                                  ep_rot_gfh_max_s
                58
4  and a_p_anz_rot = 2)
                58
4  and (gfh_nm_min  >=  element a_p_nr from ep_rot_gfh_min_s
                58
9      and a_p_anz_rot = 1
                58
5   or a_p_gfh_nm_hp  >=  element a_p_nr from
                58
37                                  ep_rot_gfh_min_s
                58
12         and a_p_anz_rot = 2))
                58
4  Then ar_p_rot_f = element a_p_nr from rot_f
                58
5  and ar_p_rot_d = element a_p_nr from rot_d
                58
5  and ar_p_rot_b = element a_p_nr from rot_b
                58
5  and ar_p_rot_ts = element a_p_nr from rot_ts
                58
5  and ar_p_drehz  = element a_p_nr from rot_n_max
                58
5  and ar_p_rot_ts_abgl  = '-'
                58
5  and ar_p_flag = 1
                58
5  and a_p_aus_f    =  element a_p_nr from rot_f
                58
5  and a_p_aus_d    =  element a_p_nr from rot_d
                58
5  and a_p_aus_b    =  element a_p_nr from rot_b
                58
5  and a_p_aus_ts   =  element a_p_nr from rot_ts
                58
5  and a_p_aus_drehz = element a_p_nr from rot_n_max
                54
                 0
1 Premise failed because ...
                26
1 Clause #2 failed.
                17
```

As seen in the above-illustrated rule, the rotors spinning knowledge system takes into consideration parameters such as the trash content of the raw material ("RDV TRASHF=35"), the tendency towards snarling ("GCH CRI is not 'High' or not . . . ") and other parameters which have previously been specified or selected by default in determining that one acceptable type of rotor is a "T" rotor.

As illustrated by the block 84 in FIG. 3, one or more acceptable rotors have been identified, a refined list of rotors is assembled from the list of identified rotors. In this operation, the rotor spinning knowledge system takes into consideration the rate of rotation of the identified rotors in relation to the selected raw material. Additionally, the knowledge system considers the specified quality parameters such as standard, quality or extra quality as well as the yarn count range. Illustrated below is an excerpt from the typescript of a representative consultation in Appendix A illustrating the application of one such rule for further refining the list of identified acceptable rotors.

```
                71
1  -- Trying Rule AR_R_ABGL_ROT_K_TS of ABGL_ROT(2)  --
                51
                 0
4     IF  n_max              >=  element a_p_nr from rot_n_max
                58
4     and n_rot_abzug_v   >=  element a_p_nr from rot_n_max
                58
4     and (Verschleiss is not 'Service life'
                58
4     and (gfh_nm_max  <= element a_p_nr from ep_rot_gfh_max_q
                58
4     and a_p_anz_rot = 1
                58
```

During this refined searching for acceptable rotors, if no acceptable rotors are found within a relatively broad yarn count range at a particular quality level, the rotor spinning knowledge system applies further rules to determine if an acceptable rotor is available in the relatively large yarn count range as a lesser relative quality level. Thus, the rotor spinning knowledge system determines if a rotor capable of operating in the given yarn count range can be identified which produces a yarn of lesser quality than the initially identified quality level. In the event that no acceptable rotors are identified, the rotor spinning knowledge system presents a display to the user to alert the user to this information.

From the refined list of identified acceptable rotors, the rotor spinning knowledge system further identifies those rotors which are optimum for the production of the desired yarn and the ultimate fabric application, as illustrated by the block 86 in FIG. 3. In this regard, the rotor spinning knowledge system takes into consideration the productivity characteristics and the special characteristics of the desired yarn in identifying the optimum rotors. In addition to identifying the optimum rotors, the rotor spinning knowledge system identifies suitable components for use with the identified optimum rotors such as, for example, appropriate yarn withdrawal navels.

To complete the consultation, the rotor spinning knowledge system specifies the optimum rotor spinning device components and their optimum operational settings, as illustrated by the block 88 in FIG. 3. In this regard, the rotor spinning knowledge system can be configured to specify the rotor type, the rotor diameter and the preferable rotor coating. The last step of the consultation involves the display of the identified optimum components and their optimum operational settings to the user, as illustrated by the block 90 in FIG. 3. In addition to providing information relating to the optimum rotor, the rotor spinning knowledge system can provide information concerning the preferred type of opening roller, the rotor coating, the rotor housing, preventing of cleaning, a navel cleaner, a torque stop and the maximum possible rate of rotation of the optimum rotor.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

```
1  ------------------------------------------------------------------
                    71
1  Knowledge Base name   : COROAS12
                    31
1  Run date and time     : 12/02/89 10:42:22
                    40
1  ESDE  version and date : 2.0 05/31/89
                    37
1  ------------------------------------------------------------------
                    71

                     0

                     0
1  ==> FCB AUTOCORO(1) instantiated
                    32
1  ==> FCB AUTOCORO(1) queued to pending FCB list
                    46
1  ==> Reply to initial instance query for FCB AUTOCORO is YES.
                    60
1  ==> Control blocks built
                    24
1  ==> Control given to FCB (AUTOCORO)
                    35
2   +++ Display Values +++
                    23
5      value of D_Z (  1)(1)
                    25
1  --Focus On
                    10
1  --Ignore
                     8
1  ==> Display Results
                    19
```

```
7        value of D_Z (  1)(1)
                27
1  ==> Screen: BS_AUTOCORO
                23
1  ==> End of Task set for FCB AUTOCORO(1) TCB DISPLAY
                51
1  ==> FCB AUTOCORO(1) queued to pending FCB list
                46
1  ==> Control given to FCB (AUTOCORO)
                35
2   +++ Determine Values
                21
5      value of SL_BW_KUERZER_ZWOELF (  1)(1)
                42
5      value of REIFEGR_BR (  1)(1)
                32
5      value of FL_WOL (  1)(1)
                28
5      value of SPINNB_TYP (  1)(1)
                32
5      value of A_P_DATUM_KONSUL (  1)(1)
                38
5      value of A_P_UHRZEIT (  1)(1)
                33
1  --Focus On
                10
1  --Ignore
                 8
1  --Dont Ask
                10
5      value of SPINNB_TYP (  1)(1)
                32
5      value of REIFEGR_BR (  1)(1)
                32
1  --Dont Acquire
                14
1  --Dont Infer
                12
1  --Use Rules
                11
1  ==> Backward Chaining for
                25
7        value of SL_BW_KUERZER_ZWOELF (  1)(1)
                44
7        value of REIFEGR_BR (  1)(1)
                34
7        value of FL_WOL (  1)(1)
                30
7        value of SPINNB_TYP (  1)(1)
                34
7        value of A_P_DATUM_KONSUL (  1)(1)
                40
7        value of A_P_UHRZEIT (  1)(1)
                35

                 0
1  ** Determining SL_BW_KUERZER_ZWOELF of AUTOCORO(1) **
                53

                 0
1  >>>> SL_BW_KUERZER_ZWOELF
                25
3    assigned = 0  (1).
                71

                 5
1  >>>> Resulting value after assignment:
                38
1  0  (1)
                 6
```

```
1  -- Trying to resolve Default Constraint
                    39

                     0
4      = 0.0
                     8

                     0
1  Default Constraint resolution successful
                    40
1  -- Default constraint applied
                    29

                     0
1  ** Processing of SL_BW_KUERZER_ZWOELF of AUTOCORO(1) completed **
                    65

                     0
1  ** Determining REIFEGR_BR of AUTOCORO(1) **
                    43

                     0
1  >>>> REIFEGR_BR
                    15
3    assigned = 0.84  (1).
                    71

                     5
1  >>>> Resulting value after assignment:
                    38
1  0.84  (1)
                     9
1  -- Trying to resolve Default Constraint
                    39

                     0
4      = 0.84
                     9

                     0
1  Default Constraint resolution successful
                    40
1  -- Default constraint applied
                    29

                     0
1  ** Processing of REIFEGR_BR of AUTOCORO(1) completed **
                    55

                     0
1  ** Determining FL_WOL of AUTOCORO(1) **
                    39

                     0
1  >>>> FL_WOL
                    11
3    assigned = 0  (1).
                    71

                     5
1  >>>> Resulting value after assignment:
                    38
1  0  (1)
                     6
1  -- Trying to resolve Default Constraint
                    39
```

```
                    0
4     = 0
                    7

                    0
1  Default Constraint resolution successful
                   40
1  -- Default constraint applied
                   29

                    0
1  ** Processing of FL_WOL of AUTOCORO(1) completed **
                   51

                    0
1  ** Determining SPINNB_TYP of AUTOCORO(1) **
                   43

                    0
1  >>>> SPINNB_TYP
                   15
3    assigned = 'SE 8' (1).
                   71

                    5
1  >>>> Resulting value after assignment:
                   38
1  'SE 8' (1)
                   10
1  -- Trying to resolve Default Constraint
                   39

                    0
4     = 'SE 8'
                   11

                    0
1  Default Constraint resolution successful
                   40
1  -- Default constraint applied
                   29

                    0
1  ** Processing of SPINNB_TYP of AUTOCORO(1) completed **
                   55

                    0
1  ** Determining A_P_DATUM_KONSUL of AUTOCORO(1) **
                   49

                    0
1  >>>> A_P_DATUM_KONSUL
                   21
3    assigned = ':day1!!.!!:month1!!.!!:year2' (1).
                   71

                    5
1  >>>> Resulting value after assignment:
                   38
1  '2.12.1989' (1)
                   15
1  -- Trying to resolve Default Constraint
                   39
```

```
                    0
4     = ':day1!!.!!:month1!!.!!:year2'
                   35

                    0
1  Default Constraint resolution successful
                   40
1  -- Default constraint applied
                   29

                    0
1  ** Processing of A_P_DATUM_KONSUL of AUTOCORO(1) completed **
                   61

                    0
1  ** Determining A_P_UHRZEIT of AUTOCORO(1) **
                   44

                    0
1  >>>> A_P_UHRZEIT
                   16
3    assigned = ':hour1!!.!!:minute2!!.!!Uhr' (1).
                   71

                    5
1  >>>> Resulting value after assignment:
                   38
1  '10.42.Uhr' (1)
                   15
1  -- Trying to resolve Default Constraint
                   39
                    0
4     = ':hour1!!.!!:minute2!!.!!Uhr'
                   34

                    0
1  Default Constraint resolution successful
                   40
1  -- Default constraint applied
                   29

                    0
1  ** Processing of A_P_UHRZEIT of AUTOCORO(1) completed **
                   56
1  ==> End of Task set for FCB AUTOCORO(1) TCB DETERMINE
                   53
1  ==> FCB AUTOCORO(1) queued to pending FCB list
                   46
1  ==> Control given to FCB (AUTOCORO)
                   35
2   +++ Establish Focuses +++
                   26
5      value of EINGABE (1)
                   24
1  --Focus On
                   10
1  --Ignore
                    8
1  ==> End of Task set for FCB AUTOCORO(1) TCB ESTABLISH
                   53
1  ==> FCB EINGABE(1) queued to pending FCB list
                   45
1  ==> Reply to initial instance query for FCB EINGABE is YES.
                   59
1  ==> Control blocks built
                   24
1  ==> Control given to FCB (EINGABE)
                   34
2   +++ Display Values +++
                   23
```

```
5     value of D_Z (  1)(1)
                25
1  --Focus On
                10
1  --Ignore
                 8
1  ==> Display Results
                19
7       value of D_Z (  1)(1)
                27
1  ==> Screen: BS_EINGABE_AUFLISTUNG
                33
1  ==> End of Task set for FCB EINGABE(1) TCB DISPLAY
                50
1  ==> FCB EINGABE(1) queued to pending FCB list
                45
1  ==> Control given to FCB (EINGABE)
                34
2   +++ Ask Values +++
                19
5     value of PA_KUNDENNR (  1)(1)
                33
1  --Focus On
                10
1  --Ignore
                 8
1  --Dont Ask
                10
1  ==> Asking for the value of PA_KUNDENNR
                39
1  Value of PA_KUNDENNR(1) Before User Interaction:
                48
3    (No values assigned to the parameter at this time.)
                53
1  >>>> User response:
                19
1  >>>> Resulting value after assignment:
                38
3    (No values assigned to the parameter at this time.)
                53
1  >>>> User response:
                19
1  >>>> Resulting value after assignment:
                38
3    (No values assigned to the parameter at this time.)
                53
1  >>>> User response:
                19
1  >>>> Resulting value after assignment:
                38
3    (No values assigned to the parameter at this time.)
                53
1  >>>> User response:
                19
1  >>>> Resulting value after assignment:
                38
3    (No values assigned to the parameter at this time.)
                53
1  >>>> User response:
                19
1  >>>> Resulting value after assignment:
                38
3    (No values assigned to the parameter at this time.)
                53
```

```
                    5
1  >>>> Resulting value after assignment:
                   38
1  'cylindrical (SRZ)' (1)
                   23
1  >>>> User response:
                   19
3    assigned = 'no' (1).
                   71

                    5
1  >>>> Resulting value after assignment:
                   38
1  'no' (1)
                    8
1  >>>> User response:
                   19
3    assigned = 'without' (1).
                   71

                    5
1  >>>> Resulting value after assignment:
                   38
1  'without' (1)
                   13
1  >>>> User response:
                   19
3    assigned = 'Weaving' (1).
                   71

                    5
1  >>>> Resulting value after assignment:
                   38
1  'Weaving' (1)
                   13

                    0
1  Value of KOMM_NR(1) After User Interaction:
                   43
3    (No values assigned to the parameter at this time.)
                   53
1  ==> End of Task set for FCB EINGABE(1) TCB ASK
                   46
1  ==> FCB EINGABE(1) queued to pending FCB list
                   45
1  >>>> User response:
                   19
1  >>>> Resulting value after assignment:
                   38
3    (No values assigned to the parameter at this time.)
                   53
1  >>>> User response:
                   19
1  >>>> Resulting value after assignment:
                   38
3    (No values assigned to the parameter at this time.)
                   53
1  >>>> User response:
                   19
1  >>>> Resulting value after assignment:
                   38
3    (No values assigned to the parameter at this time.)
                   53

                    0
1  Value of PA_KUNDENNR(1) After User Interaction:
                   47
3    (No values assigned to the parameter at this time.)
                   53
1  ==> End of Task set for FCB EINGABE(1) TCB ASK
                   46
1  ==> FCB EINGABE(1) queued to pending FCB list
                   45
```

```
1  ==> Control given to FCB (EINGABE)
                    34
2   +++ Ask Values +++
                    19
5      value of KOMM_NR (  1)(1)
                    29
1  --Focus On
                    10
1  --Ignore
                     8
1  --Dont Ask
                    10
1  ==> Asking for the value of KOMM_NR
                    35
1  Value of KOMM_NR(1) Before User Interaction:
                    44
3    (No values assigned to the parameter at this time.)
                    53
1  >>>> User response:
                    19
1  >>>> Resulting value after assignment:
                    38
3    (No values assigned to the parameter at this time.)
                    53
1  >>>> User response:
                    19
3    assigned = 216  (1).
                    71

                     5
1  >>>> Resulting value after assignment:
                    38
1  216  (1)
                     8
1  ----------------------------------------------------------------
                    71
1  -- Executing Constraint ANZ_SPINNST_FALSCH of AUTOCORO(1) --
                    60

                     0

                     3
1  = anz_spinnst
                    13

                     0
1  >>>> ANZ_SPINNST_FALSCH
                    23
3    assigned = 216  (1).
                    71

                     5
1  >>>> Resulting value after assignment:
                    38
1  216  (1)
                     8
1  Constraint Resolved
                    19
1  ----------------------------------------------------------------
                    71
```

```
                    0
1  >>>> User response:
                   19
3    assigned = 'SE 8' (1).
                   71

                    5
1  >>>> Resulting value after assignment:
                   38
1  'SE 8' (1)
                   10
1  >>>> User response:
                   19
3    assigned = 'cylindrical (SRZ)' (1).
                   71
1  ==> Control given to FCB (EINGABE)
                   34
2   +++ Determine Values
                   21
5      value of SPINNB_TYP (  1)(1)
                   32
1  --Focus On
                   10
1  --Ignore
                    8
1  --Dont Ask
                   10
1  --Dont Acquire
                   14
1  --Dont Infer
                   12
1  --Use Rules
                   11
1  ==> Backward Chaining for
                   25
7        value of SPINNB_TYP (  1)(1)
                   34

                    0
1  ----------------------------------------------------------------
                   71
1  ==> Goal parameter resolved:
                   28
1  SPINNB_TYP of AUTOCORO(1) (Current State:Resolved)
                   50
1  'SE 8' (1)
                   10
1  ----------------------------------------------------------------
                   71
1  ==> End of Task set for FCB EINGABE(1) TCB DETERMINE
                   52
1  ==> FCB EINGABE(1) queued to pending FCB list
                   45
1  ==> Control given to FCB (EINGABE)
                   34
2   +++ Discover
                   13
1  Quiesce State
                   13
1  Use Rules
                    9
5      value of E_R_ERG_SPINNST (1)
                   32
```

```
5     value of EINSATZZWECK_M (1)
                31
5     value of EINSATZZWECK_W (1)
                31
1  ==> Forward Chaining
                20
1  ----------------------------------------------------------------
                71

                 0

1  The Premise of Rule EINSATZZWECK_W of EINGABE(1) is satisfied.
                62

                 0
1  if esz = 'Weaving'
                55
4     then dont consider art_maschenw
                34

                 0
1  ----------------------------------------------------------------
                71
1  -- Firing Rule EINSATZZWECK_W of EINGABE(1) --
                46

                 0
4     if esz = 'Weaving'
                58
4     then dont consider art_maschenw
                34

                 0
1  >>>> DONT CONSIDER set for Parameter ART_MASCHENW(1) of FCB
                60
1  AUTOCORO(1).
                12
1  Premise of Rule EINSATZZWECK_W of EINGABE(1) succeeded with certainty
                70
1  (1).
                 4
1  ----------------------------------------------------------------
                71

                 0
1  ==> End of Task set for FCB EINGABE(1) TCB DISCOVER
                51
1  ==> FCB EINGABE(1) queued to pending FCB list
                45
1  ==> Control given to FCB (EINGABE)
                34
2   +++ Determine Values
                21
5     value of ART_W (  1)(1)
                27
5     value of ART_MASCHENW (  1)(1)
                34
1  --Focus On
                10
1  --Ignore
                 8
```

```
1  --Dont Ask
                10
1  --Dont Acquire
                14
1  --Dont Infer
                12
1  --Use Rules
                11
1  ==> Backward Chaining for
                25
7       value of ART_W (  1)(1)
                29
7       value of ART_MASCHENW (  1)(1)
                36

                 0
1  ** Determining ART_W of EINGABE(1) **
                37

                 0
1  ----------------------------------------------------------------------
                71
1  -- Trying Rule ART_W_ZUW of EINGABE(1) --
                41

                 0
4     If esz = 'Weaving'
                58
4     Then art_w = (art_w_flachg,art_w_polg,art_w_sonderg)
                55

                 0
1  Unknown parameter(s) in the conclusion:
                39
1  ART_W_FLACHG of EINGABE(1) (Current State:UnProcessed)
                54
1  ART_W_POLG of EINGABE(1) (Current State:UnProcessed)
                52
1  ART_W_SONDERG of EINGABE(1) (Current State:UnProcessed)
                55
1  ----------------------------------------------------------------------
                71

                 0

                 0
1  ** Determining ART_W_FLACHG of EINGABE(1) **
                44

                 0
1  ----------------------------------------------------------------------
                71
1  -- Asking user for ART_W_FLACHG of EINGABE(1):
                46

1  >>>> User response:
                19
3    assigned = 'Denim (classical)' (1).
                71

                 5
1  >>>> Resulting value after assignment:
                38
1  'Denim (classical)' (1)
                23
1  >>>> User response:
                19
1  >>>> Resulting value after assignment:
                38
3    (No values assigned to the parameter at this time.)
                53
```

```
1  >>>> User response:
                19
1  >>>> Resulting value after assignment:
                38
3    (No values assigned to the parameter at this time.)
                53
1  ----------------------------------------------------------------
                71

                 0
1  ** Processing of ART_W_FLACHG of EINGABE(1) completed **
                56

                 0
1  ** Determining ART_W of EINGABE(1) **
                37

                 0
1  ----------------------------------------------------------------
                71
1  -- Trying Rule ART_W_ZUW of EINGABE(1) --
                41

                 0
4     If esz = 'Weaving'
                58
4     Then art_w = (art_w_flachg,art_w_polg,art_w_sonderg)
                55

                 0
1  Unknown parameter(s) in the conclusion:
                39
1  ART_W_POLG of EINGABE(1) (Current State:UnProcessed)
                52
1  ART_W_SONDERG of EINGABE(1) (Current State:UnProcessed)
                55
1  ----------------------------------------------------------------
                71

                 0

                 0
1  ** Determining ART_W_POLG of EINGABE(1) **
                42

                 0
1  -- No default constraint
                24

                 0
1  ** Processing of ART_W_POLG of EINGABE(1) completed **
                54

                 0
1  ** Determining ART_W of EINGABE(1) **
                37

                 0
1  ----------------------------------------------------------------
                71
1  -- Trying Rule ART_W_ZUW of EINGABE(1) --
                41
```

```
                    0
4     If esz = 'Weaving'
                   58
4     Then art_w = (art_w_flachg,art_w_polg,art_w_sonderg)
                   55

                    0
1  Unknown parameter(s) in the conclusion:
                   39
1  ART_W_SONDERG of EINGABE(1) (Current State:UnProcessed)
                   55
1  ----------------------------------------------------------------
                   71

                    0

                    0
1  ** Determining ART_W_SONDERG of EINGABE(1) **
                   45

                    0
1  -- No default constraint
                   24

                    0
1  ** Processing of ART_W_SONDERG of EINGABE(1) completed **
                   57

                    0
1  ** Determining ART_W of EINGABE(1) **
                   37

                    0
1  ----------------------------------------------------------------
                   71
1  -- Trying Rule ART_W_ZUW of EINGABE(1) --
                   41

                    0
4     If esz = 'Weaving'
                   58
4     Then art_w = (art_w_flachg,art_w_polg,art_w_sonderg)
                   55

                    0
1  >>>> ART_W
                   10
3    assigned = 'Denim (classical)' (1).
                   71

                    5
1  >>>> Resulting value after assignment:
                   38
1  'Denim (classical)' (1)
                   23
1  Premise of Rule ART_W_ZUW of EINGABE(1) succeeded with certainty (1).
                   69
1  ----------------------------------------------------------------
                   71

                    0

                    0
1  ** Processing of ART_W of EINGABE(1) completed **
                   49

                    0
1  ----------------------------------------------------------------
                   71
1  ==> Goal parameter resolved:
                   28
```

```
1  ART_MASCHENW of AUTOCORO(1) (Current State:UnProcessed)
                    55
3    (No values assigned to the parameter at this time.)
                    53
1  ----------------------------------------------------------------
                    71
1  ==> End of Task set for FCB EINGABE(1) TCB DETERMINE
                    52
1  ==> FCB EINGABE(1) queued to pending FCB list
                    45
1  ==> Control given to FCB (EINGABE)
                    34
2   +++ Discover
                    13
1  Quiesce State
                    13
1  Use Rules
                     9
1  ==> Forward Chaining
                    20
1  ==> End of Task set for FCB EINGABE(1) TCB DISCOVER
                    51
1  ==> FCB EINGABE(1) queued to pending FCB list
                    45
1  ==> Control given to FCB (EINGABE)
                    34
2   +++ Determine Values
                    21
5      value of SPAM_ZYL_KON (  1)(1)
                    34
1  --Focus On
                    10
1  --Ignore
                     8
1  --Dont Ask
                    10
1  --Dont Acquire
                    14
1  --Dont Infer
                    12
1  --Use Rules
                    11
1  ==> Backward Chaining for
                    25
7        value of SPAM_ZYL_KON (  1)(1)
                    36

                     0
1  ----------------------------------------------------------------
                    71
1  ==> Goal parameter resolved:
                    28
1  SPAM_ZYL_KON of AUTOCORO(1) (Current State:Resolved)
                    52
1  'cylindrical (SRZ)' (1)
                    23
1  ----------------------------------------------------------------
                    71
1  ==> End of Task set for FCB EINGABE(1) TCB DETERMINE
                    52
1  ==> FCB EINGABE(1) queued to pending FCB list
                    45
1  ==> Control given to FCB (EINGABE)
                    34
2   +++ Determine Values
                    21
5      value of GCH_H (  1)(1)
                    27
5      value of GCH_KRI (  1)(1)
                    29
1  --Focus On
```

```
                    10
1  --Ignore
                     8
1  --Dont Ask
                    10
1  --Dont Acquire
                    14
1  --Dont Infer
                    12
1  --Use Rules
                    11
1  -- Order Rules By
                    17
4     Explicit Sequence
                    20
1  - Ascending
                    11
7        value of WEITERVER_LUFTD (1)
                    34
4     Explicit Sequence
                    20
1  - Ascending
                    11
7        value of WEITERVER_GREIF (1)
                    34
1  ==> Backward Chaining for
                    25
7        value of GCH_H (  1)(1)
                    29
7        value of GCH_KRI (  1)(1)
                    31

                     0
1  ** Determining GCH_H of AUTOCORO(1) **
                    38

                     0
1  ---------------------------------------------------------------------
                    71
1  -- Trying Rule WEITERVER_LUFTD of EINGABE(1) --
                    47

                     0
4     IF ((art_w      = 'Corduroy'
                    58
5      and (a_d_hfp_cord = 'Pile filling'
                    58
5      or a_d_hfp_cord   = 'Ground filling'))
                    58
5      or (art_w          = 'Velours'
                    58
6       and (a_d_hfp_velour    = 'Pile filling'
                    58
5      or a_d_hfp_velour  = 'Ground filling'))
                    58
5      or (art_w          = 'Terry towel'
                    58
6       and a_d_hfp_frot    = 'Ground filling')
                    58
5      or (art_w          = 'Denim (classical)'
                    58
6       and a_d_hfp         = 'Weft')
                    58
6       and warenbild is known
                    58
6       and markenart is known )
                    58
6       and wv_i_w         = 'Air jet'
                    58
4     THEN gch_h          = 'Medium'
                    33
```

```
                    0
1  Unknown parameter(s) in the premise:
                   36
1  A_D_HFP of AUTOCORO(1) (Current State:UnProcessed)
                   50
1  WARENBILD of EINGABE(1) (Current State:UnProcessed)
                   51
1  MARKENART of EINGABE(1) (Current State:UnProcessed)
                   51
1  WV_I_W of EINGABE(1) (Current State:UnProcessed)
                   48
1  ----------------------------------------------------------------------
                   71

                    0

                    0
1  ** Determining A_D_HFP of AUTOCORO(1) **
                   40

                    0
1  ----------------------------------------------------------------------
                   71
1  -- Asking user for A_D_HFP of AUTOCORO(1):
                   42
1  >>>> User response:
                   19
3    assigned = 'Warp' (1).
                   71

                    5
1  >>>> Resulting value after assignment:
                   38
1  'Warp' (1)
                   10
1  ----------------------------------------------------------------------
                   71

                    0
1  ** Processing of A_D_HFP of AUTOCORO(1) completed **
                   52

                    0
1  ** Determining GCH_H of AUTOCORO(1) **
                   38

                    0
1  ----------------------------------------------------------------------
                   71
1  -- Trying Rule WEITERVER_LUFTD of EINGABE(1) --
                   47

                    0
4     IF ((art_w      = 'Corduroy'
                   58
5      and (a_d_hfp_cord = 'Pile filling'
                   58
5      or a_d_hfp_cord   = 'Ground filling'))
                   58
5      or (art_w          = 'Velours'
                   58
6       and (a_d_hfp_velour    = 'Pile filling'
                   58
5      or a_d_hfp_velour  = 'Ground filling'))
                   58
5      or (art_w          = 'Terry towel'
                   58
6       and a_d_hfp_frot    = 'Ground filling')
                   58
5      or (art_w          = 'Denim (classical)'
                   58
```

```
6       and a_d_hfp          = 'Weft')
                58
6       and warenbild is known
                58
6       and markenart is known )
                58
6       and wv_i_w           = 'Air jet'
                58
4     THEN gch_h            = 'Medium'
                33

                 0
1  Premise failed because ...
                26
1  Clause #1 failed.
                17
1  Clause #4 failed.
                17
1  Clause #7 failed.
                17
1  Clause #10 failed.
                18
1  ----------------------------------------------------------------
                71

                 0
1  ----------------------------------------------------------------
                71
1  -- Trying Rule AUFM_FROTTIER_POLKETTE of EINGABE(1) --
                54

                 0
4     if ((art_w        = 'Terry towel'
                58
4     and a_d_hfp_frot  = 'Pile warp'))
                58
4     or art_maschenw = 'Warp knitting (pile)'
                58
4     then
                58
4     gch_kri         = 'Low'          ,
                58
4     gch_gl          = 'Moderately good'          ,
                58
4     gch_h           = 'High'          ,
                58
4     gch_wg          = 'yes'          ,
                58
4     gch_d           = 'Low'          ,
                58
4     moegl_qualitaet = ('Service life','Quality') ,
                58
4     moegl_qual_text =
                58
4     (':pp SERVICE LIFE - high durability, probably
                58
4     :br:tb5 not so high quality
                58
4     :pp QUALITY - high quality at maximum speed')
                48

                 0
1  Premise failed because ...
                26
1  Clause #1 failed.
                17
1  Clause #3 failed.
                17
1  ----------------------------------------------------------------
                71
```

```
                    0
1  ------------------------------------------------------------------
                   71
1  -- Trying Rule AUFM_ART_MASCH_UNTERW_SW of EINGABE(1) --
                   56

                    0
4     IF art_maschenw  = 'Underware (high grade)'
                   58
4     and a_d_hfp_unterw = 'Very soft'
                   58
4     then
                   58
4     gch_gl        =  'Good'            ,
                   58
4     gch_wg        =  'yes'                  ,
                   58
4     gch_h         =  'Very high'                ,
                   58
4     gch_d         =  'Low'             ,
                   58
4     gfk_g_m_h     =  'High'                 ,
                   58
4     moegl_qualitaet = ('Service life','Quality',
                   58
29                              'Extraquality') ,
                   58
4     moegl_qual_text =
                   58
4     (':pp SERVICE LIFE - high durability, probably
                   58
4     :br:tb5 not so high quality
                   58
4     :pp QUALITY - high quality at maximum speed
                   58
4     :pp EXTRAQUALITY - highest quality, probably at
                   58
4     :br:tb5 lower speed.')
                   25

                    0
1  Premise failed because ...
                   26
1  Clause #1 failed.
                   17
1  ------------------------------------------------------------------
                   71

                    0
1  ------------------------------------------------------------------
                   71
1  -- Trying Rule AUFM_OBERH_GLATT of EINGABE(1) --
                   48

                    0
4     if art_w       = 'Shirtings, blouses - smooth'
                   58
4     then
                   58
4     gch_h          = 'Low'            ,
                   58
4     gfk_g_m_h      = 'Low'            ,
                   58
4     gch_gl         = 'Very good'               ,
                   58
4     gch_vol        is not 'Great'               ,
                   58
4     gch_wg         = 'no'               ,
                   58
4     gch_d          = 'High'               ,
                   58
```

```
4     moegl_rs_art_bw = ('100 %','Regenerated',
                  58
23                        'Comber noils','Blends thereof'),
                  58
4     moegl_qualitaet = ('Quality','Extraquality') ,
                  58
4     moegl_qual_text =
                  58
4     (':pp QUALITY - high quality at maximum speed
                  58
4     :pp EXTRAQUALITY - highest quality, probably at
                  58
4     :br:tb5 lower speed')
                  24
                   0
1  Premise failed because ...
                  26
1  Clause #1 failed.
                  17
1  ----------------------------------------------------------------
                  71

                   0
1  ----------------------------------------------------------------
                  71
1  -- Trying Rule AUFM_ART_MASCH_UNTERW_ST of EINGABE(1) --
                  56

                   0
4     IF art_maschenw  = 'Underware (high grade)'
                  58
4     and a_d_hfp_unterw = 'Standard'
                  58
4     then
                  58
4     gch_gl        =  'Good'            ,
                  58
4     gch_wg        =  'yes'                  ,
                  58
4     gch_h         =  'High'                 ,
                  58
4     gch_d         =  'Low'             ,
                  58
4     gfk_g_m_h     =  'High'                 ,
                  58
4     moegl_qualitaet = ('Service life','Quality',
                  58
29                              'Extraquality') ,
                  58
4     moegl_qual_text =
                  58
4     (':pp SERVICE LIFE - high durability, probably
                  58
4     :br:tb5 not so high quality
                  58
4     :pp QUALITY - high quality at maximum speed
                  58
4     :pp EXTRAQUALITY - highest quality, probably at
                  58
4     :br:tb5 lower speed.')
                  25

                   0
1  Premise failed because ...
                  26
1  Clause #1 failed.
                  17
1  ----------------------------------------------------------------
                  71

                   0
```

```
1  -- No default constraint
                24

                 0
1  ** Processing of GCH_H of AUTOCORO(1) completed **
                50

                 0
1  ** Determining GCH_KRI of AUTOCORO(1) **
                40

                 0
1  ----------------------------------------------------------------
                71
1  -- Trying Rule WEITERVER_GREIF of EINGABE(1) --
                47

                 0
4     IF ((art_w      = 'Corduroy'
                58
5      and (a_d_hfp_cord = 'Pile filling'
                58
5      or   a_d_hfp_cord   = 'Ground filling'))
                58
5      or  (art_w          = 'Velours'
                58
6       and (a_d_hfp_velour    = 'Pile filling'
                58
10          or   a_d_hfp_velour    = 'Ground filling'))
                58
5      or  (art_w          = 'Terry towel'
                58
6       and  a_d_hfp_frot    = 'Ground filling')
                58
5      or  (art_w          = 'Denim (classical)'
                58
6       and  a_d_hfp         = 'Weft')
                58
6       and warenbild is known
                58
6       and markenart is known )
                58
6       and  wv_i_w          = 'Rapier'
                58
4     THEN  gch_kri         = 'Low'
                32
                 0
1  Premise failed because ...
                26
1  Clause #1 failed.
                17
1  Clause #4 failed.
                17
1  Clause #7 failed.
                17
1  Clause #10 failed.
                18
1  ----------------------------------------------------------------
                71

                 0
1  ----------------------------------------------------------------
                71
1  -- Trying Rule AUFM_DENIM_KETTE_VW_MA of EINGABE(1) --
                54

                 0
4     If art_w       = 'Denim (classical)'
                58
4     and
                58
```

```
4     a_d_hfp        = 'Warp'
                  58
4     and
                  58
4     warenbild      = 'Indistinct'
                  58
4     and
                  58
4     markenart      = 'yes'
                  58
4     then
                  58
4     gch_bba        = 'acceptable'          ,
                  58
4     gch_kri        = 'Low'          ,
                  58
4     gch_gl         = 'Moderately good'          ,
                  58
4     gfk_g_m_h      = 'Very high'       ,
                  58
4     gch_d          = 'High'            ,
                  58
4     moegl_qualitaet = 'Service life'       ,
                  58
4     rs_art          = 'Cotton' ,
                  58
4     moegl_rs_art_bw = ('100 %','Regenerated','Comber noils'
                  58
22                      ,'Blends thereof')
                  39

                   0
1  Unknown parameter(s) in the premise:
                  36
1  WARENBILD of EINGABE(1) (Current State:UnProcessed)
                  51
1  MARKENART of EINGABE(1) (Current State:UnProcessed)
                  51
1  ----------------------------------------------------------------------
                  71

                   0

                   0
1  ** Determining WARENBILD of EINGABE(1) **
                  41

                   0
1  ----------------------------------------------------------------------
                  71
1  -- Asking user for WARENBILD of EINGABE(1):
                  43
1  >>>> User response:
                  19
3    assigned = 'Indistinct' (1).
                  71

                   5
1  >>>> Resulting value after assignment:
                  38
1  'Indistinct' (1)
                  16
1  ----------------------------------------------------------------------
                  71

                   0
1  ** Processing of WARENBILD of EINGABE(1) completed **
                  53

                   0
```

```
1  ** Determining GCH_KRI of AUTOCORO(1) **
                   40

                    0
1  ----------------------------------------------------------------
                   71
1  -- Trying Rule AUFM_DENIM_KETTE_VW_MA of EINGABE(1) --
                   54
                    0
4     If art_w        = 'Denim (classical)'
                   58
4     and
                   58
4     a_d_hfp         = 'Warp'
                   58
4     and
                   58
4     warenbild       = 'Indistinct'
                   58
4     and
                   58
4     markenart       = 'yes'
                   58
4     then
                   58
4     gch_bba         = 'acceptable'          ,
                   58
4     gch_kri         = 'Low'          ,
                   58
4     gch_gl          = 'Moderately good'          ,
                   58
4     gfk_g_m_h       = 'Very high'       ,
                   58
4     gch_d           = 'High'            ,
                   58
4     moegl_qualitaet = 'Service life'       ,
                   58
4     rs_art          = 'Cotton' ,
                   58
4     moegl_rs_art_bw = ('100 %','Regenerated','Comber noils'
                   58
22                       ,'Blends thereof')
                   39

                    0
1  Unknown parameter(s) in the premise:
                   36
1  MARKENART of EINGABE(1) (Current State:UnProcessed)
                   51
1  ----------------------------------------------------------------
                   71

                    0
                    0
1  ** Determining MARKENART of EINGABE(1) **
                   41

                    0
1  ----------------------------------------------------------------
                   71
1  -- Asking user for MARKENART of EINGABE(1):
                   43
1  >>>> User response:
                   19
3    assigned = 'yes' (1).
                   71

                    5
1  >>>> Resulting value after assignment:
                   38
1  'yes' (1)
                    9
```

```
1  ----------------------------------------------------------------
                71

                 0
   ** Processing of MARKENART of EINGABE(1) completed **
                53

                 0
1  ** Determining GCH_KRI of AUTOCORO(1) **
                40

                 0
1  ----------------------------------------------------------------
                71
1  -- Trying Rule AUFM_DENIM_KETTE_VW_MA of EINGABE(1) --
                54

                 0
4     If art_w        = 'Denim (classical)'
                58
4     and
                58
4     a_d_hfp         = 'Warp'
                58
4     and
                58
4     warenbild       = 'Indistinct'
                58
4     and
                58
4     markenart       = 'yes'
                58
4     then
                58
4     gch_bba         = 'acceptable'          ,
                58
4     gch_kri         = 'Low'          ,
                58
4     gch_gl          = 'Moderately good'          ,
                58
4     gfk_g_m_h       = 'Very high'       ,
                58
4     gch_d           = 'High'            ,
                58
4     moegl_qualitaet = 'Service life'       ,
                58
4     rs_art          = 'Cotton' ,
                58
4     moegl_rs_art_bw = ('100 %','Regenerated','Comber noils'
                58
22                    ,'Blends thereof')
                39

                 0
1  >>>> GCH_BBA
                12
3    assigned = 'acceptable' (1).
                71

                 5
1  >>>> Resulting value after assignment:
                38
1  'acceptable' (1)
                16
1  >>>> GCH_KRI
                12
3    assigned = 'Low' (1).
                71

                 5
   >>>> Resulting value after assignment:
                38
```

```
1  'Low' (1)
                    9
1  >>>> GCH_GL
                   11
3    assigned = 'Moderately good' (1).
                   71

                    5
1  >>>> Resulting value after assignment:
                   38
1  'Moderately good' (1)
                   21
1  >>>> GFK_G_M_H
                   14
3    assigned = 'Very high' (1).
                   71

                    5
1  >>>> Resulting value after assignment:
                   38
1  'Very high' (1)
                   15
1  >>>> GCH_D
                   10
3    assigned = 'High' (1).
                   71

                    5
1  >>>> Resulting value after assignment:
                   38
1  'High' (1)
                   10
1  >>>> MOEGL_QUALITAET
                   20
3    assigned = 'Service life' (1).
                   71

                    5
1  >>>> Resulting value after assignment:
                   38
1  'Service life' (1)
                   18
1  >>>> MOEGL_RS_ART_BW
                   20
3    assigned =
                   71
6       '100 %' (1).
                   71
6       'Regenerated' (1).
                   71
6       'Comber noils' (1).
                   71
6       'Blends thereof' (1).
                   71

                    5
1  >>>> Resulting value after assignment:
                   38
1  '100 %' (1)
                   11
1  'Regenerated' (1)
                   17
1  'Comber noils' (1)
                   18
1  'Blends thereof' (1)
                   20
1  Unknown parameter(s) in the conclusion:
                   39
1  RS_ART of EINGABE(1) (Current State:UnProcessed, Constraint Incomplete)
                   71
```

```
1  ----------------------------------------------------------------------
                    71

                     0

                     0
1  ** Determining RS_ART of EINGABE(1) **
                    38

                     0
1  -- Trying to resolve constraint
                    31

                     0
4     is taken from moegl_rs_art
                    29

                     0
1  Incomplete references in the constraint:
                    40
1  MOEGL_RS_ART of EINGABE (1)
                    27

                     0
1  ** Determining MOEGL_RS_ART of EINGABE(1) **
                    44

                     0
1  ----------------------------------------------------------------------
                    71
1  -- Trying Rule AUFM_VERBANDST of EINGABE(1) --
                    46

                     0
4     IF art_w        = 'Surgical dressing'
                    58
4     then
                    58
4     gch_bba         = 'acceptable'            ,
                    58
4     gfk_g_m_h       = 'High'                  ,
                    58
4     gch_d           = 'Medium'                ,
                    58
4     moegl_rs_art = ('Cotton',
                    58
20                     'Cellulosic fibers',
                    58
20                     'Fiber blends'),
                    58
4     moegl_qualitaet = ('Service life','Quality'),
                    58
4     moegl_qual_text =
                    58
4     (':pp SERVICE LIFE - high durability, probably
                    58
4     :br:tb5 not so high quality
                    58
4     :pp QUALITY - high quality at maximum speed')
                    48

                     0
1  Premise failed because ...
                    26
1  Clause #1 failed.
                    17
1  ----------------------------------------------------------------------
                    71

                     0
1  >>>> MOEGL_RS_ART
                    17
```

```
3    assigned =
                71
6       'Cotton' (1).
                71
6       'Cellulosic fibers' (1).
                71
6       'Synthetic fibers (e.g. PES, PAC)' (1).
                71
6       'Wool (not yet implemented)' (1).
                71
6       'Fiber blends' (1).
                71

                 5
1  >>>> Resulting value after assignment:
                38
1  'Cotton' (1)
                12
1  'Cellulosic fibers' (1)
                23
1  'Synthetic fibers (e.g. PES, PAC)' (1)
                38
1  'Wool (not yet implemented)' (1)
                32
1  'Fiber blends' (1)
                18
1  -- Trying to resolve Default Constraint
                39

                 0
4     = ('Cotton' ,
                58
7        'Cellulosic fibers' ,
                58
7        'Synthetic fibers (e.g. PES, PAC)' ,
                58
7        'Wool (not yet implemented)' ,
                58
7        'Fiber blends')
                21

                 0
1  Default Constraint resolution successful
                40
1  -- Default constraint applied
                29

                 0
1  ** Processing of MOEGL_RS_ART of EINGABE(1) completed **
                56
1  ----------------------------------------------------------------------
                71
1  -- Executing Constraint RS_ART of EINGABE(1) --
                47

                 0

                 3
1  is taken from moegl_rs_art
                26

                 0
1  Constraint Resolved
                19
1  ----------------------------------------------------------------------
                71

                 0

                 0
1  ** Determining RS_ART of EINGABE(1) **
                38
```

```
                 0
1  ----------------------------------------------------------------
                71
1  -- Trying Rule AUFM_DENIM_KETTE_VW_MA of EINGABE(1) --
                54
                 0
4     If art_w       = 'Denim (classical)'
                58
4     and
                58
4     a_d_hfp        = 'Warp'
                58
4     and
                58
4     warenbild      = 'Indistinct'
                58
4     and
                58
4     markenart      = 'yes'
                58
4     then
                58
4     gch_bba        = 'acceptable'          ,
                58
4     gch_kri        = 'Low'          ,
                58
4     gch_gl         = 'Moderately good'          ,
                58
4     gfk_g_m_h      = 'Very high'       ,
                58
4     gch_d          = 'High'            ,
                58
4     moegl_qualitaet = 'Service life'       ,
                58
4     rs_art           = 'Cotton' ,
                58
4     moegl_rs_art_bw = ('100 %','Regenerated','Comber noils'
                58
22                      ,'Blends thereof')
                39

                 0
1  >>>> RS_ART
                11
3    assigned = 'Cotton' (1).
                71

                 5
1  >>>> Resulting value after assignment:
                38
1  'Cotton' (1)
                12
1  && Trying monitor rules for RS_ART of EINGABE(1) &&
                51
1  ----------------------------------------------------------------
                71
1  -- Trying Monitor Rule RS_ART_MISCHUNGEN of EINGABE(1) --
                57

                 0
5      if rs_art = 'Fiber blends'
                58
5      then establish mi_kalkulation immediate
                58
5      and e_str = 'mibw'
                58
5      and fl_syn = 0
                58
5      and fl_chem = 0
                19
```

```
                    0
1  Premise failed because ...
                   26
1  Clause #1 failed.
                   17
1  ----------------------------------------------------------------------
                   71

                    0
1  ----------------------------------------------------------------------
                   71
1  -- Trying Monitor Rule AUFM_MISCH of EINGABE(1) --
                   50

                    0
4     if rs_art  is not  'Fiber blends'
                   58
4     then dont consider gr_mischungen
                   35

                    0
1  >>>> DONT CONSIDER set for Parameter RS_ART_MIWO(1) of FCB AUTOCORO(1).
                   71
1  >>>> DONT CONSIDER set for Parameter RS_ART_MICH(1) of FCB AUTOCORO(1).
                   71
1  >>>> DONT CONSIDER set for Parameter RS_ART_MISY(1) of FCB AUTOCORO(1).
                   71
1  >>>> DONT CONSIDER set for Parameter RS_ART_MIBW(1) of FCB AUTOCORO(1).
                   71
1  >>>> DONT CONSIDER set for Parameter MIWO_PROZ(1) of FCB AUTOCORO(1).
                   69
1  >>>> DONT CONSIDER set for Parameter MISY_PROZ(1) of FCB EINGABE(1).
                   68
1  >>>> DONT CONSIDER set for Parameter MICH_PROZ(1) of FCB EINGABE(1).
                   68
1  >>>> DONT CONSIDER set for Parameter MIBW_PROZ(1) of FCB EINGABE(1).
                   68
1  Premise of Rule AUFM_MISCH of EINGABE(1) succeeded with certainty (1).
                   70
1  ----------------------------------------------------------------------
                   71

                    0
1  && Completed monitor rules for RS_ART of EINGABE(1) &&
                   54
1  Premise of Rule AUFM_DENIM_KETTE_VW_MA of EINGABE(1) succeeded with
                   68
1  certainty (1).
                   14
1  ----------------------------------------------------------------------
                   71

                    0

                    0
1  ** Processing of RS_ART of EINGABE(1) completed **
                   50
1  ==> End of Task set for FCB EINGABE(1) TCB DETERMINE
                   52
1  ==> FCB EINGABE(1) queued to pending FCB list
                   45
1  ==> Control given to FCB (EINGABE)
                   34
2   +++ Determine Values
                   21
5      value of E_STR_GC (  1)(1)
                   30
1  --Focus On
                   10
1  --Ignore
                    8
1  --Dont Ask
```

```
                    10
1  --Dont Acquire
                    14
1  --Dont Infer
                    12
1  --Use Rules
                    11
1  ==> Backward Chaining for
                    25
7        value of E_STR_GC (  1)(1)
                    32

                     0
1  ** Determining E_STR_GC of EINGABE(1) **
                    40

                     0
1  ----------------------------------------------------------------------
                    71
1  -- Trying Rule GARNCHARAKTER_ANZEIGE of EINGABE(1) --
                    53

                     0
4     if (art_maschenw = 'Others'
                    58
4     or art_w = 'At your option')
                    58
4     then establish gc_anzeige
                    58
4     and  e_str_gc = '1'
                    22

                     0
1  Premise failed because ...
                    26
1  Clause #1 failed.
                    17
1  Clause #2 failed.
                    17
1  ----------------------------------------------------------------------
                    71

                     0
1  ----------------------------------------------------------------------
                    71
1  -- Trying Rule AUFM_RAUHGEWEBE_MOD of EINGABE(1) --
                    51

                     0
4     If (art_w =  'Napped fabrics'
                    58
4     or art_w = 'Shirtings casual wear, blouses (flanelle)')
                    58
4     and art_rauhgewebe = 'Modified'
                    58
4     then
                    58
4     establish gc_anzeige
                    58
4     and e_str_gc = '1'
                    58
4     and moegl_qualitaet = ('Service life','Quality')
                    58
4     and moegl_qual_text =
                    58
4     (':pp STANDZEIT - standfeste Spinnmittel, eventuell zu
                    58
4     :br:tb5 Lasten einer besseren Qualität.
                    58
```

```
4     :pp QUALITY - high quality at maximum speed')
                48

                 0
1  Premise failed because ...
                26
1  Clause #1 failed.
                17
1  Clause #2 failed.
                17
1  ----------------------------------------------------------------------
                71

                 0

                 0
1  ** Processing of E_STR_GC of EINGABE(1) completed **
                52
1  ==> End of Task set for FCB EINGABE(1) TCB DETERMINE
                52
1  ==> FCB EINGABE(1) queued to pending FCB list
                45
1  ==> Control given to FCB (EINGABE)
                34
2   +++ Ask Values +++
                19
5      value of GFH_MIN_EING (  1)(1)
                34
5      value of RS_ART (  1)(1)
                28
1  --Focus On
                10
1  --Ignore
                 8
1  --Dont Ask
                10
1  ==> Asking for the value of GFH_MIN_EING
                40
1  Value of GFH_MIN_EING(1) Before User Interaction:
                49
3    (No values assigned to the parameter at this time.)
                53
1  >>>> User response:
                19
3    assigned = 'Nm' (1).
                71

                 5
1  >>>> Resulting value after assignment:
                38
1  'Nm' (1)
                 8
1  >>>> User response:
                19
3    assigned = 14  (1).
                71

                 5
1  >>>> Resulting value after assignment:
                38
1  14  (1)
                 7
1  >>>> User response:
                19
1  >>>> Resulting value after assignment:
                38
3    (No values assigned to the parameter at this time.)
                53

                 0
1  Value of GFH_MIN_EING(1) After User Interaction:
                48
```

```
1  14  (1)
                    7
1  ==> Asking for the value of RS_ART
                   34
1  Caution -- Parameter is already resolved
                   40
1  ==> End of Task set for FCB EINGABE(1) TCB ASK
                   46
1  ==> FCB EINGABE(1) queued to pending FCB list
                   45
1  ==> Control given to FCB (EINGABE)
                   34
2   +++ Discover
                   13
1  Quiesce State
                   13
1  Use Rules
                    9
1  ==> Forward Chaining
                   20
1  ----------------------------------------------------------------------
                   71

                    0
1  The Premise of Rule FH_MAX_BW of EINGABE(1) is satisfied.
                   57

                    0
1  If rs_art = 'Cotton'
                   55
4     then ffh_max_sy_ch = 1
                   25
                    0
1  ----------------------------------------------------------------------
                   71
1  -- Firing Rule FH_MAX_BW of EINGABE(1) --
                   41

                    0
4     If rs_art = 'Cotton'
                   58
4     then ffh_max_sy_ch = 1
                   25

                    0
1  >>>> FFH_MAX_SY_CH
                   18
3    assigned = 1  (1).
                   71

                    5
1  >>>> Resulting value after assignment:
                   38
1  1  (1)
                    6
1  ----------------------------------------------------------------------
                   71
1  Evaluating premise references to FFH_MAX_SY_CH of EINGABE(1).
                   61

                    0
1  Premise of Rule FH_MAX_BW of EINGABE(1) succeeded with certainty (1).
                   69
1  ----------------------------------------------------------------------
                   71

                    0
1  ==> End of Task set for FCB EINGABE(1) TCB DISCOVER
                   51
1  ==> FCB EINGABE(1) queued to pending FCB list
                   45
1  ==> Control given to FCB (EINGABE)
```

```
                34
2   +++ Determine Values
                21
5      value of E_STR (  1)(1)
                27
1  --Focus On
                10
1  --Ignore
                 8
1  --Dont Ask
                10
1  --Dont Acquire
                14
1  --Dont Infer
                12
1  --Use Rules
                11
1  ==> Backward Chaining for
                25
7        value of E_STR (  1)(1)
                29

                 0
1  ** Determining E_STR of EINGABE(1) **
                37

                 0
1  ----------------------------------------------------------------------
                71
1  -- Trying Rule RS_ART_BAUMWOLLE of EINGABE(1) --
                48

                 0
4     if rs_art = 'Cotton'
                58
4     and rs_art_bw is known
                58
4     and rs_bw_verschmutz is known
                58
4     and sl_bw_fuenfzig is known
                58
4     and ffh_bw          is known
                58
4     and e_p_bw_schmutz_messw = 'no'
                58
4     then e_str = 'bw'
                58
4     and fl_syn = 0
                58
4     and fl_chem = 0
                58
4     and fl_wol = 0
                58
4     and fl_einheit = 'mm'
                24

                 0
1  Unknown parameter(s) in the premise:
                36
1  RS_ART_BW of AUTOCORO(1) (Current State:UnProcessed, Constraint
                64
1  Incomplete)
                11
1  RS_BW_VERSCHMUTZ of EINGABE(1) (Current State:UnProcessed)
                58
1  SL_BW_FUENFZIG of AUTOCORO(1) (Current State:UnProcessed)
                57
1  FFH_BW of AUTOCORO(1) (Current State:UnProcessed)
                49
1  E_P_BW_SCHMUTZ_MESSW of EINGABE(1) (Current State:UnProcessed)
                62
1  ----------------------------------------------------------------------
```

```
                71

                 0

                 0
1  ** Determining RS_ART_BW of AUTOCORO(1) **
                42

                 0
1  -- Trying to resolve constraint
                31

                 0
4     taken from moegl_rs_art_bw
                29

                 0
1  Incomplete references in the constraint:
                40
1  MOEGL_RS_ART_BW of AUTOCORO (1)
                31

                 0
1  ** Determining MOEGL_RS_ART_BW of AUTOCORO(1) **
                48

                 0
1  ---------------------------------------------------------------------
                71
1  -- Trying Rule AUFM_DENIM_SCHUSS_MA of EINGABE(1) --
                52

                 0
4     if art_w      = 'Denim (classical)'
                58
4     and
                58
4     a_d_hfp       = 'Weft'
                58
4     and
                58
4     markenart     = 'yes'
                58
4     then
                58
4     gch_bba       =  'acceptable'              ,
                58
4     gch_kri       =  'Low'             ,
                58
4     gch_gl        =  'Good'                ,
                58
4     gfk_g_m_h     =  'Very high'           ,
                58
4     gch_d         =  'High'                ,
                58
4     moegl_qualitaet  =  'Service life'          ,
                58
4     rs_art         = 'Cotton' ,
                58
4     moegl_rs_art_bw = ('100 %','Regenerated','Comber noils'
                58
22                    ,'Blends thereof')
                39

                 0
1  Premise failed because ...
                26
1  Clause #2 failed.
                17
1  ---------------------------------------------------------------------
                71
```

```
                    0
1  ------------------------------------------------------------------
                   71
1  -- Trying Rule AUFM_DENIM_KETTE_VW of EINGABE(1) --
                   51

                    0
4     if art_w       = 'Denim (classical)'
                   58
4     and
                   58
4     a_d_hfp        = 'Warp'
                   58
4     and
                   58
4     warenbild      = 'Indistinct'
                   58
4     and
                   58
4     markenart      = 'no'
                   58
4     then
                   58
4     gch_bba        = 'acceptable'          ,
                   58
4     gch_kri        = 'Low'          ,
                   58
4     gch_gl         = 'Moderately good'          ,
                   58
4     gfk_g_m_h      = 'High'          ,
                   58
4     gch_d          = 'High'          ,
                   58
4     moegl_qualitaet = 'Service life'       ,
                   58
9          rs_art    = 'Cotton' ,
                   58
4     moegl_rs_art_bw = ('100 %','Regenerated','Comber noils'
                   58
22                      ,'Blends thereof')
                   39

                    0
1  Premise failed because ...
                   26
1  Clause #4 failed.
                   17
1  ------------------------------------------------------------------
                   71

                    0
1  ------------------------------------------------------------------
                   71
1  -- Trying Rule AUFM_DENIM_KETTE_GW_MA of EINGABE(1) --
                   54

                    0
4     if art_w       = 'Denim (classical)'
                   58
4     and
                   58
4     a_d_hfp        = 'Warp'
                   58
4     and
                   58
4     warenbild      = 'Distinct'
                   58
4     and
                   58
4     markenart      = 'yes'
                   58
4     then
```

```
                    58
4     gch_bba         = 'acceptable'          ,
                    58
4     gch_kri         = 'Low'          ,
                    58
4     gch_gl          = 'Good'          ,
                    58
4     gfk_g_m_h       = 'Very high'       ,
                    58
4     gch_d           = 'High'          ,
                    58
4     moegl_qualitaet = 'Service life'       ,
                    58
4     rs_art          = 'Cotton',
                    58
4     moegl_rs_art_bw = ('100 %','Regenerated','Comber noils'
                    58
22                        ,'Blends thereof')
                    39

                     0
1  Premise failed because ...
                    26
1  Clause #3 failed.
                    17
1  ----------------------------------------------------------------
                    71

                     0
1  ----------------------------------------------------------------
                    71
1  -- Trying Rule AUFM_DENIM_KETTE_GW of EINGABE(1) --
                    51

                     0
4     if art_w        = 'Denim (classical)'
                    58
4     and
                    58
4     a_d_hfp         = 'Warp'
                    58
4     and
                    58
4     warenbild       = 'Distinct'
                    58
4     and
                    58
4     markenart       = 'no'
                    58
4     then
                    58
4     gch_bba         = 'acceptable'          ,
                    58
4     gch_kri         = 'Low'          ,
                    58
4     gch_gl          = 'Moderately good'          ,
                    58
4     gfk_g_m_h       = 'High'          ,
                    58
4     gch_d           = 'High'          ,
                    58
4     moegl_qualitaet = 'Service life'       ,
                    58
4     rs_art          = 'Cotton' ,
                    58
4     moegl_rs_art_bw = ('100 %','Regenerated','Comber noils'
                    58
22                        ,'Blends thereof')
                    39

                     0
```

```
1  Premise failed because ...
                    26
1  Clause #3 failed.
                    17
1  ----------------------------------------------------------------------
                    71

                     0
1  ----------------------------------------------------------------------
                    71
1  -- Trying Rule AUFM_DENIM_SCHUSS of EINGABE(1) --
                    49

                     0
4     if art_w       = 'Denim (classical)'
                    58
4     and
                    58
4     a_d_hfp        = 'Weft'
                    58
4     and
                    58
4     markenart      = 'no'
                    58
4     then
                    58
4     gch_bba        =  'acceptable'              ,
                    58
4     gch_kri        =  'Low'             ,
                    58
4     gch_gl         =  'Good'                ,
                    58
4     gfk_g_m_h      =  'High'               ,
                    58
4     gch_d          =  'High'               ,
                    58
4     moegl_qualitaet =  'Service life'          ,
                    58
4     rs_art           = 'Cotton' ,
                    58
4     moegl_rs_art_bw = ('100 %','Regenerated','Comber noils'
                    58
22                        ,'Blends thereof')
                    39

                     0
1  Premise failed because ...
                    26
1  Clause #2 failed.
                    17
1  ----------------------------------------------------------------------
                    71

                     0
1  ----------------------------------------------------------------------
                    71
1  -- Trying Rule AUFM_POPELINE of EINGABE(1) --
                    45

                     0
4     if art_w        =  'Popeline for coats'
                    58
4     then
                    58
4     gch_bba         =  'Low'             ,
                    58
4     gch_gl          =  'Very good'       ,
                    58
4     gfk_g_m_h       =  'High'            ,
                    58
4     gch_vol         =  'Moderate'          ,
                    58
```

```
4     gch_wg          =  'no'            ,
                   58
4     gch_d           =  'Medium'         ,
                   58
4     moegl_rs_art_bw = ('100 %','Regenerated',
                   58
23                          'Comber noils','Blends thereof') ,
                   58
4     moegl_qualitaet = ('Quality','Extraquality') ,
                   58
4     moegl_qual_text =
                   58
4     ('pp: QUALITY - high quality at maximum speed
                   58
4     :pp EXTRAQUALITY - highest quality, probably at
                   58
4     :br:tb5 lower speed')
                   24

                    0
1  Premise failed because ...
                   26
1  Clause #1 failed.
                   17
1  ----------------------------------------------------------------
                   71

                    0
1  >>>> MOEGL_RS_ART_BW
                   20
3    assigned =
                   71
6       '100 %' (1).
                   71
6       'Waste' (1).
                   71
6       'Regenerated' (1).
                   71
6       'Comber noils' (1).
                   71
6       'Blends thereof' (1).
                   71

                    5
1  >>>> Resulting value after assignment:
                   38
1  '100 %' (1)
                   11
1  'Waste' (1)
                   11
1  'Regenerated' (1)
                   17
1  'Comber noils' (1)
                   18
1  'Blends thereof' (1)
                   20
1  -- Trying to resolve Default Constraint
                   39

                    0
4     = ('100 %',
                   58
7        'Waste',
                   58
7        'Regenerated',
                   58
7        'Comber noils',
                   58
7        'Blends thereof')
                   23

                    0
1  Default Constraint resolution successful
                   40
```

```
1  -- Default constraint applied
                29

                 0
1  ** Processing of MOEGL_RS_ART_BW of AUTOCORO(1) completed **
                60
1  ------------------------------------------------------------------
                71
1  -- Executing Constraint RS_ART_BW of AUTOCORO(1) --
                51

                 0

                 3
1  taken from moegl_rs_art_bw
                26

                 0
1  Constraint Resolved
                19
1  ------------------------------------------------------------------
                71

                 0

                 0
1  ** Determining RS_ART_BW of AUTOCORO(1) **
                42

                 0
1  ------------------------------------------------------------------
                71
1  -- Asking user for RS_ART_BW of AUTOCORO(1):
                44
1  >>>> User response:
                19
3    assigned = '100 %' (1).
                71

                 5
1  >>>> Resulting value after assignment:
                38
1  '100 %' (1)
                11
1  ------------------------------------------------------------------
                71
                 0
1  ** Processing of RS_ART_BW of AUTOCORO(1) completed **
                54

                 0
1  ** Determining E_STR of EINGABE(1) **
                37

                 0
1  ------------------------------------------------------------------
                71
1  -- Trying Rule RS_ART_BAUMWOLLE of EINGABE(1) --
                48

                 0
4     if rs_art = 'Cotton'
                58
4     and rs_art_bw is known
                58
4     and rs_bw_verschmutz is known
                58
4     and sl_bw_fuenfzig is known
                58
4     and ffh_bw          is known
                58
4     and e_p_bw_schmutz_messw = 'no'
```

```
                58
4     then e_str = 'bw'
                58
4     and fl_syn = 0
                58
4     and fl_chem = 0
                58
4     and fl_wol = 0
                58
4     and fl_einheit = 'mm'
                24

                 0
1  Unknown parameter(s) in the premise:
                36
1  RS_BW_VERSCHMUTZ of EINGABE(1) (Current State:UnProcessed)
                58
1  SL_BW_FUENFZIG of AUTOCORO(1) (Current State:UnProcessed)
                57
1  FFH_BW of AUTOCORO(1) (Current State:UnProcessed)
                49
1  E_P_BW_SCHMUTZ_MESSW of EINGABE(1) (Current State:UnProcessed)
                62
1  ----------------------------------------------------------------------
                71

                 0

                 0
1  ** Determining RS_BW_VERSCHMUTZ of EINGABE(1) **
                48
                 0
1  ----------------------------------------------------------------------
                71
1  -- Asking user for RS_BW_VERSCHMUTZ of EINGABE(1):
                50
1  >>>> User response:
                19
3    assigned = 'none known' (1).
                71

                 5
1  >>>> Resulting value after assignment:
                38
1  'none known' (1)
                16
1  >>>> User response:
                19
3    assigned = 'perfect for rotor spinning' (1).
                71

                 5
1  >>>> Resulting value after assignment:
                38
1  'perfect for rotor spinning' (1)
                32
1  >>>> User response:
                19
3    assigned = 'no' (1).
                71

                 5
1  >>>> Resulting value after assignment:
                38
1  'no' (1)
                 8
1  ----------------------------------------------------------------------
                71

                 0
1  ** Processing of RS_BW_VERSCHMUTZ of EINGABE(1) completed **
                60
```

```
                    0
1  ** Determining E_STR of EINGABE(1) **
                   37
                    0
1  ----------------------------------------------------------------
                   71
1  -- Trying Rule RS_ART_BAUMWOLLE of EINGABE(1) --
                   48

                    0
4     if rs_art = 'Cotton'
                   58
4     and rs_art_bw is known
                   58
4     and rs_bw_verschmutz is known
                   58
4     and sl_bw_fuenfzig is known
                   58
4     and ffh_bw         is known
                   58
4     and e_p_bw_schmutz_messw = 'no'
                   58
4     then e_str = 'bw'
                   58
4     and fl_syn = 0
                   58
4     and fl_chem = 0
                   58
4     and fl_wol = 0
                   58
4     and fl_einheit = 'mm'
                   24

                    0
1  Unknown parameter(s) in the premise:
                   36
1  SL_BW_FUENFZIG of AUTOCORO(1) (Current State:UnProcessed)
                   57
1  FFH_BW of AUTOCORO(1) (Current State:UnProcessed)
                   49
1  ----------------------------------------------------------------
                   71

                    0

                    0
1  ** Determining SL_BW_FUENFZIG of AUTOCORO(1) **
                   47

                    0
1  ----------------------------------------------------------------
                   71
1  -- Trying Rule RS_ART_CHEMIEFASERN of EINGABE(1) --
                   51

                    0
4     If rs_art = 'Cellulosic fibers'
                   58
4     and rs_art_ch   is known
                   58
4     and fl_chem     is known
                   58
4     and ffh_ch_eing  is known
                   58
4     then e_str ='ch'
                   58
4     and fl_syn = 0
                   58
4     and sl_bw_fuenfzig = 0
                   25

                    0
```

```
1  Premise failed because ...
                    26
1  Clause #1 failed.
                    17
1  ----------------------------------------------------------------
                    71

                     0
1  ----------------------------------------------------------------
                    71
1  -- Trying Rule RS_ART_SYNTHESEFASERN of EINGABE(1) --
                    53

                     0
4     if rs_art = 'Synthetic fibers (e.g. PES, PAC)'
                    58
4     and rs_art_sy   is known
                    58
4     and fl_syn      is known
                    58
4     and ffh_sy_eing  is known
                    58
4     then e_str = 'sy'
                    58
4     and fl_chem = 0
                    58
4     and sl_bw_fuenfzig = 0
                    25

                     0
1  Premise failed because ...
                    26
1  Clause #1 failed.
                    17
1  ----------------------------------------------------------------
                    71

                     0
1  Rule E_R_BW_SL_FL_ZUW_INCH(1) is a reference to an unprocessed FCB
                    67
1  (BAUMWOLLE_KOMPL(1)).
                    21
1  ==> FCB BAUMWOLLE_KOMPL(1) queued to pending FCB list
                    53
1  ==> Reply to initial instance query for FCB BAUMWOLLE_KOMPL is YES.
                    67
1  ==> Control blocks built
                    24
1  ==> Control given to FCB (BAUMWOLLE_KOMPL)
                    42
2   +++ Determine Values
                    21
5      value of SL_BW_UR_WERT (  1)(1)
                    35
5      value of SL_BW_FUENFZ_EING (  1)(1)
                    39
5      value of SL_BW_ZWEIF_EING (  1)(1)
                    38
1  --Focus On
                    10
1  --Ignore
                     8
1  --Dont Ask
                    10
5      value of SL_BW_UR_WERT (  1)(1)
                    35
5      value of SL_BW_FUENFZ_EING (  1)(1)
                    39
5      value of SL_BW_ZWEIF_EING (  1)(1)
                    38
1  --Dont Acquire
```

```
1  --Dont Infer
                12
1  --Use Rules
                11
1  ==> Backward Chaining for
                25
7        value of SL_BW_UR_WERT (  1)(1)
                37
7        value of SL_BW_FUENFZ_EING (  1)(1)
                41
7        value of SL_BW_ZWEIF_EING (  1)(1)
                40

                 0
1  ** Determining SL_BW_UR_WERT of AUTOCORO(1) **
                46

                 0
1  >>>> SL_BW_UR_WERT
                18
1  >>>> Resulting value after assignment:
                38
3    (No values assigned to the parameter at this time.)
                53
1  && Trying monitor rules for SL_BW_UR_WERT of AUTOCORO(1) &&
                59
1  ----------------------------------------------------------------------
                71
1  -- Trying Monitor Rule E_R_SL_FUENFZIG_UMR of BAUMWOLLE_KOMPL(1) --
                67

                 0
4     IF currently sl_bw_fuenfz_eing is not known
                58
5      and currently sl_bw_zweif_eing is known
                58
4     and currently ffh_bw is known
                58
5      and currently sl_bw_ur_wert is known
                58
4     THEN sl_bw_fuenfz_eing =
                58
15 .             (sl_bw_zweif_eing * sl_bw_ur_wert) / 100
                58
4     and show  (sl_bw_fuenfz_eing ,ffh_bw)  (use (bs_sl_bw))
                58

                 0
1  Premise failed because ...
                26
1  Clause #2 failed.
                17
1  ----------------------------------------------------------------------
                71

                 0
1  ----------------------------------------------------------------------
                71
1  -- Trying Monitor Rule E_R_BW_UR_WERT_UMR of BAUMWOLLE_KOMPL(1) --
                66

                 0
4     IF
                58
9          currently sl_bw_ur_wert is not known
                58
5      and currently sl_bw_fuenfz_eing is known
                58
5      and currently sl_bw_zweif_eing  is  known
                58
5      and currently ffh_bw            is  known
                58
```

```
4     THEN sl_bw_ur_wert = (( sl_bw_fuenfz_eing * 100 )
                    58
25                          / sl_bw_zweif_eing )
                    58
5      and show (sl_bw_ur_wert,ffh_bw) (use (bs_sl_bw))
                    52

                     0
1  Premise failed because ...
                    26
1  Clause #2 failed.
                    17
1  ----------------------------------------------------------------------
                    71

                     0
1  ----------------------------------------------------------------------
                    71
1  -- Trying Monitor Rule E_R_SL_ZWEIFUENF_UMR of BAUMWOLLE_KOMPL(1) --
                    68

                     0
4     IF currently sl_bw_zweif_eing is not known
                    58
5      and currently ffh_bw           is known
                    58
5      and currently sl_bw_fuenfz_eing  is known
                    58
5      and currently sl_bw_ur_wert is known
                    58
4     THEN sl_bw_zweif_eing = ((sl_bw_fuenfz_eing * 100 )
                    58
27                          / sl_bw_ur_wert)
                    58
4     and show (sl_bw_zweif_eing,ffh_bw) (use (bs_sl_bw))
                    54

                     0
1  Premise failed because ...
                    26
1  Clause #2 failed.
                    17
1  ----------------------------------------------------------------------
                    71

                     0
1  && Completed monitor rules for SL_BW_UR_WERT of AUTOCORO(1) &&
                    62
1  -- Trying to resolve Default Constraint
                    39

                     0
4     = sl_bw_fuenfzig * 100  / sl_bw_zweifuenf
                    44

                     0
1  Incomplete references in Default Constraint
                    43
4     SL_BW_FUENFZIGOFAUTOCORO (1)
                    31
1  -- Default constraint applied
                    29

                     0
1  ** Determining SL_BW_FUENFZIG of AUTOCORO(1) **
                    47

                     0
1  ----------------------------------------------------------------------
                    71
1  -- Trying Rule E_R_BW_SL_FL_ZUW_INCH of BAUMWOLLE_KOMPL(1) --
                    61
```

```
                0
4     IF ( rs_art = 'Cotton'
                58
6       or mibw_proz > 0)
                58
5      and sl_bw_fuenfz_eing is known
                58
5      and sl_bw_zweif_eing is known
                58
5      and sl_bw_ur_wert is known
                58
5      and fl_einheit = 'inch'
                58
4     THEN sl_bw_fuenfzig = sl_bw_fuenfz_eing * 2.54
                58
5      and sl_bw_zweifuenf = sl_bw_zweif_eing * 2.54
                49

                 0
1  Unknown parameter(s) in the premise:
                36
1  SL_BW_FUENFZ_EING of EINGABE(1) (Current State:UnProcessed)
                59
1  SL_BW_ZWEIF_EING of EINGABE(1) (Current State:UnProcessed)
                58
1  SL_BW_UR_WERT of AUTOCORO(1) (Current State:Partially Resolved)
                63
1  FL_EINHEIT of AUTOCORO(1) (Current State:UnProcessed)
                53
1  ----------------------------------------------------------------------
                71

                 0

                 0
1  ** Determining SL_BW_FUENFZ_EING of EINGABE(1) **
                49

                 0
1  -- No default constraint
                24

                 0
1  ** Processing of SL_BW_FUENFZ_EING of EINGABE(1) completed **
                61
1  && Trying monitor rules for SL_BW_FUENFZ_EING of EINGABE(1) &&
                62
1  ----------------------------------------------------------------------
                71
1  -- Trying Monitor Rule E_R_SL_FUENFZIG_UMR of BAUMWOLLE_KOMPL(1) --
                67

                 0
4     IF currently sl_bw_fuenfz_eing is not known
                58
5      and currently sl_bw_zweif_eing is known
                58
4     and currently ffh_bw is known
                58
5      and currently sl_bw_ur_wert is known
                58
4     THEN sl_bw_fuenfz_eing =
                58
15               (sl_bw_zweif_eing * sl_bw_ur_wert) / 100
                 58
4     and show  (sl_bw_fuenfz_eing ,ffh_bw)  (use (bs_sl_bw))
                 58

                 0
1  Premise failed because ...
                 26
```

```
1  Clause #2 failed.
                17
1  ----------------------------------------------------------------
                71

                 0
1  ----------------------------------------------------------------
                71
1  -- Trying Monitor Rule E_R_BW_UR_WERT_UMR of BAUMWOLLE_KOMPL(1) --
                66

                 0
4     IF
                58
9         currently sl_bw_ur_wert is not known
                58
5      and currently sl_bw_fuenfz_eing is known
                58
5      and currently sl_bw_zweif_eing  is  known
                58
5      and currently ffh_bw            is  known
                58
4     THEN sl_bw_ur_wert = (( sl_bw_fuenfz_eing * 100 )
                58
25                         / sl_bw_zweif_eing )
                58
5      and show (sl_bw_ur_wert,ffh_bw) (use (bs_sl_bw))
                52

                 0
1  Premise failed because ...
                26
1  Clause #2 failed.
                17
1  ----------------------------------------------------------------
                71

                 0
1  ----------------------------------------------------------------
                71
1  -- Trying Monitor Rule E_R_SL_ZWEIFUENF_UMR of BAUMWOLLE_KOMPL(1) --
                68

                 0
4     IF currently sl_bw_zweif_eing is not known
                58
5      and currently ffh_bw           is known
                58
5      and currently sl_bw_fuenfz_eing  is known
                58
5      and currently sl_bw_ur_wert is known
                58
4     THEN sl_bw_zweif_eing = ((sl_bw_fuenfz_eing * 100 )
                58
27                         / sl_bw_ur_wert)
                58
4     and show (sl_bw_zweif_eing,ffh_bw) (use (bs_sl_bw))
                54

                 0
1  Premise failed because ...
                26
1  Clause #2 failed.
                17
1  ----------------------------------------------------------------
                71

                 0
1  && Completed monitor rules for SL_BW_FUENFZ_EING of EINGABE(1) &&
                65

                 0
```

```
1  ** Determining SL_BW_FUENFZIG of AUTOCORO(1) **
                  47

                   0
1  ----------------------------------------------------------------------
                  71
1  -- Trying Rule E_R_BW_SL_FL_ZUW_INCH of BAUMWOLLE_KOMPL(1) --
                  61

                   0
4     IF ( rs_art = 'Cotton'
                  58
6       or mibw_proz > 0)
                  58
5      and sl_bw_fuenfz_eing is known
                  58
5      and sl_bw_zweif_eing is known
                  58
5      and sl_bw_ur_wert is known
                  58
5      and fl_einheit = 'inch'
                  58
4     THEN sl_bw_fuenfzig = sl_bw_fuenfz_eing * 2.54
                  58
5      and sl_bw_zweifuenf = sl_bw_zweif_eing * 2.54
                  49

                   0
1  Premise failed because ...
                  26
1  Clause #3 failed.
                  17
1  ----------------------------------------------------------------------
                  71

                   0
1  ----------------------------------------------------------------------
                  71
1  -- Trying Rule E_R_BW_SL_FL_ZUW_MM of BAUMWOLLE_KOMPL(1) --
                  59

                   0
4     IF ( rs_art = 'Cotton'
                  58
8         or  mibw_proz > 0 )
                  58
5      and sl_bw_fuenfz_eing is known
                  58
5      and sl_bw_zweif_eing is known
                  58
5      and sl_bw_ur_wert is known
                  58
5      and fl_einheit = 'mm'
                  58
4     THEN sl_bw_fuenfzig = sl_bw_fuenfz_eing
                  58
5      and sl_bw_zweifuenf = sl_bw_zweif_eing
                  42

                   0
1  Premise failed because ...
                  26
1  Clause #3 failed.
                  17
1  ----------------------------------------------------------------------
                  71

                   0
1  >>>> SL_BW_FUENFZIG
                  19
3    assigned = 13  (1).
                  71
```

```
                    5
1  >>>> Resulting value after assignment:
                   38
1  13  (1)
                    7
1  -- Trying to resolve Default Constraint
                   39

                    0
4     = 13.0
                    9

                    0
1  Default Constraint resolution successful
                   40
1  -- Default constraint applied
                   29
                    0
1  ** Processing of SL_BW_FUENFZIG of AUTOCORO(1) completed **
                   59

                    0
1  ** Determining SL_BW_UR_WERT of AUTOCORO(1) **
                   46

                    0
1  >>>> SL_BW_UR_WERT
                   18
1  >>>> Resulting value after assignment:
                   38
3    (No values assigned to the parameter at this time.)
                   53
1  && Trying monitor rules for SL_BW_UR_WERT of AUTOCORO(1) &&
                   59
1  ----------------------------------------------------------------------
                   71
1  -- Trying Monitor Rule E_R_SL_FUENFZIG_UMR of BAUMWOLLE_KOMPL(1) --
                   67

                    0
4     IF currently sl_bw_fuenfz_eing is not known
                   58
5      and currently sl_bw_zweif_eing is known
                   58
4     and currently ffh_bw is known
                   58
5      and currently sl_bw_ur_wert is known
                   58
4     THEN sl_bw_fuenfz_eing =
                   58
15               (sl_bw_zweif_eing * sl_bw_ur_wert) / 100
                   58
4     and show  (sl_bw_fuenfz_eing ,ffh_bw)  (use (bs_sl_bw))
                   58

                    0
1  Premise failed because ...
                   26
1  Clause #2 failed.
                   17
1  ----------------------------------------------------------------------
                   71

                    0
1  ----------------------------------------------------------------------
                   71
1  -- Trying Monitor Rule E_R_BW_UR_WERT_UMR of BAUMWOLLE_KOMPL(1) --
                   66

                    0
4     IF
                   58
```

```
9          currently sl_bw_ur_wert is not known
                58
5      and currently sl_bw_fuenfz_eing is known
                58
5      and currently sl_bw_zweif_eing  is  known
                58
5      and currently ffh_bw            is  known
                58
4     THEN sl_bw_ur_wert = (( sl_bw_fuenfz_eing * 100 )
                58
25                        / sl_bw_zweif_eing )
                58
5      and show (sl_bw_ur_wert,ffh_bw) (use (bs_sl_bw))
                52

                 0
1  Premise failed because ...
                26
1  Clause #2 failed.
                17
1  ----------------------------------------------------------------------
                71

                 0
1  ----------------------------------------------------------------------
                71
1  -- Trying Monitor Rule E_R_SL_ZWEIFUENF_UMR of BAUMWOLLE_KOMPL(1) --
                68

                 0
4     IF currently sl_bw_zweif_eing is not known
                58
5      and currently ffh_bw           is known
                58
5      and currently sl_bw_fuenfz_eing  is known
                58
5      and currently sl_bw_ur_wert is known
                58
4     THEN sl_bw_zweif_eing = ((sl_bw_fuenfz_eing * 100 )
                58
27                          / sl_bw_ur_wert)
                58
4     and show (sl_bw_zweif_eing,ffh_bw) (use (bs_sl_bw))
                54

                 0
1  Premise failed because ...
                26
1  Clause #2 failed.
                17
1  ----------------------------------------------------------------------
                71

                 0
1  && Completed monitor rules for SL_BW_UR_WERT of AUTOCORO(1) &&
                62
1  -- Trying to resolve Default Constraint
                39

                 0
4     = sl_bw_fuenfzig * 100  / sl_bw_zweifuenf
                44

                 0
1  Incomplete references in Default Constraint
                43
4     SL_BW_ZWEIFUENFOFAUTOCORO (1)
                32
1  -- Default constraint applied
                29

                 0
```

```
1  ** Determining SL_BW_ZWEIFUENF of AUTOCORO(1) **
                48

                 0
1  >>>> SL_BW_ZWEIFUENF
                20
3    assigned = 28  (1).
                71

                 5
1  >>>> Resulting value after assignment:
                38
1  28  (1)
                 7
1  -- Trying to resolve Default Constraint
                39

                 0
4     = 28.0
                 9

                 0
1  Default Constraint resolution successful
                40
1  -- Default constraint applied
                29

                 0
1  ** Processing of SL_BW_ZWEIFUENF of AUTOCORO(1) completed **
                60

                 0
1  ** Determining SL_BW_UR_WERT of AUTOCORO(1) **
                46
                 0
1  >>>> SL_BW_UR_WERT
                18
1  >>>> Resulting value after assignment:
                38
3    (No values assigned to the parameter at this time.)
                53
1  && Trying monitor rules for SL_BW_UR_WERT of AUTOCORO(1) &&
                59
1  ----------------------------------------------------------------
                71
1  -- Trying Monitor Rule E_R_SL_FUENFZIG_UMR of BAUMWOLLE_KOMPL(1) --
                67

                 0
4     IF currently sl_bw_fuenfz_eing is not known
                58
5      and currently sl_bw_zweif_eing is known
                58
4     and currently ffh_bw is known
                58
5      and currently sl_bw_ur_wert is known
                58
4     THEN sl_bw_fuenfz_eing =
                58
15               (sl_bw_zweif_eing * sl_bw_ur_wert) / 100
                 58
4     and show  (sl_bw_fuenfz_eing ,ffh_bw)  (use (bs_sl_bw))
                58

                 0
1  Premise failed because ...
                26
1  Clause #2 failed.
                17
1  ----------------------------------------------------------------
                71
```

```
                    0
 1 ----------------------------------------------------------------------
                   71
 1 -- Trying Monitor Rule E_R_BW_UR_WERT_UMR of BAUMWOLLE_KOMPL(1) --
                   66

                    0
 4    IF
                   58
 9        currently sl_bw_ur_wert is not known
                   58
 5     and currently sl_bw_fuenfz_eing is known
                   58
 5     and currently sl_bw_zweif_eing  is  known
                   58
 5     and currently ffh_bw            is  known
                   58
 4    THEN sl_bw_ur_wert = (( sl_bw_fuenfz_eing * 100 )
                   58
25                        / sl_bw_zweif_eing )
                   58
 5     and show (sl_bw_ur_wert,ffh_bw) (use (bs_sl_bw))
                   52

                    0
 1 Premise failed because ...
                   26
 1 Clause #2 failed.
                   17
 1 ----------------------------------------------------------------------
                   71

                    0
 1 ----------------------------------------------------------------------
                   71
 1 -- Trying Monitor Rule E_R_SL_ZWEIFUENF_UMR of BAUMWOLLE_KOMPL(1) --
                   68

                    0
 4    IF currently sl_bw_zweif_eing is not known
                   58
 5     and currently ffh_bw           is known
                   58
 5     and currently sl_bw_fuenfz_eing  is known
                   58
 5     and currently sl_bw_ur_wert is known
                   58
 4    THEN sl_bw_zweif_eing = ((sl_bw_fuenfz_eing * 100 )
                   58
27                         / sl_bw_ur_wert)
                   58
 4    and show (sl_bw_zweif_eing,ffh_bw) (use (bs_sl_bw))
                   54

                    0
 1 Premise failed because ...
                   26
 1 Clause #2 failed.
                   17
 1 ----------------------------------------------------------------------
                   71

                    0
 1 && Completed monitor rules for SL_BW_UR_WERT of AUTOCORO(1) &&
                   62
 1 -- Trying to resolve Default Constraint
                   39

                    0
 4    = sl_bw_fuenfzig * 100  / sl_bw_zweifuenf
                   44
```

```
                    0
1  >>>> SL_BW_UR_WERT
                   18
3    assigned = 46.4285714286  (1).
                   71

                    5
1  >>>> Resulting value after assignment:
                   38
1  46.4285714286  (1)
                   18
1  && Trying monitor rules for SL_BW_UR_WERT of AUTOCORO(1) &&
                   59
1  ---------------------------------------------------------------------
                   71
1  -- Trying Monitor Rule E_R_SL_FUENFZIG_UMR of BAUMWOLLE_KOMPL(1) --
                   67

                    0
4     IF currently sl_bw_fuenfz_eing is not known
                   58
5      and currently sl_bw_zweif_eing is known
                   58
4     and currently ffh_bw is known
                   58
5      and currently sl_bw_ur_wert is known
                   58
4     THEN sl_bw_fuenfz_eing =
                   58
15               (sl_bw_zweif_eing * sl_bw_ur_wert) / 100
                   58
4     and show  (sl_bw_fuenfz_eing ,ffh_bw)  (use (bs_sl_bw))
                   58

                    0
1  Premise failed because ...
                   26
1  Clause #2 failed.
                   17
1  ---------------------------------------------------------------------
                   71

                    0
1  ---------------------------------------------------------------------
                   71
1  -- Trying Monitor Rule E_R_BW_UR_WERT_UMR of BAUMWOLLE_KOMPL(1) --
                   66

                    0
4     IF
                   58
9          currently sl_bw_ur_wert is not known
                   58
5      and currently sl_bw_fuenfz_eing is known
                   58
5      and currently sl_bw_zweif_eing  is  known
                   58
5      and currently ffh_bw            is  known
                   58
4     THEN sl_bw_ur_wert = (( sl_bw_fuenfz_eing * 100 )
                   58
25                         / sl_bw_zweif_eing )
                   58
5      and show (sl_bw_ur_wert,ffh_bw) (use (bs_sl_bw))
                   52

                    0
1  Premise failed because ...
                   26
1  Clause #1 failed.
                   17
```

```
1  ----------------------------------------------------------------------
                71

                 0
1  ----------------------------------------------------------------------
                71
1  -- Trying Monitor Rule E_R_SL_ZWEIFUENF_UMR of BAUMWOLLE_KOMPL(1) --
                68

                 0
4     IF currently sl_bw_zweif_eing is not known
                58
5      and currently ffh_bw          is known
                58
5      and currently sl_bw_fuenfz_eing  is known
                58
5      and currently sl_bw_ur_wert is known
                58
4     THEN sl_bw_zweif_eing = ((sl_bw_fuenfz_eing * 100 )
                58
27                          / sl_bw_ur_wert)
                58
4     and show (sl_bw_zweif_eing,ffh_bw) (use (bs_sl_bw))
                54

                 0
1  Premise failed because ...
                26
1  Clause #2 failed.
                17
1  ----------------------------------------------------------------------
                71

                 0
1  && Completed monitor rules for SL_BW_UR_WERT of AUTOCORO(1) &&
                62
1  Default Constraint resolution successful
                40
1  -- Default constraint applied
                29

                 0
1  ** Processing of SL_BW_UR_WERT of AUTOCORO(1) completed **
                58

                 0
1  ----------------------------------------------------------------------
                71
1  ==> Goal parameter resolved:
                28
1  SL_BW_FUENFZ_EING of EINGABE(1) (Current State:Partially Resolved)
                66
3    (No values assigned to the parameter at this time.)
                53
1  ----------------------------------------------------------------------
                71

                 0
1  ** Determining SL_BW_ZWEIF_EING of EINGABE(1) **
                48

                 0
1  -- No default constraint
                24

                 0
1  ** Processing of SL_BW_ZWEIF_EING of EINGABE(1) completed **
                60
1  && Trying monitor rules for SL_BW_ZWEIF_EING of EINGABE(1) &&
                61
1  ----------------------------------------------------------------------
                71
```

```
1  -- Trying Monitor Rule E_R_SL_FUENFZIG_UMR of BAUMWOLLE_KOMPL(1) --
                67

                 0
4     IF currently sl_bw_fuenfz_eing is not known
                58
5      and currently sl_bw_zweif_eing is known
                58
4     and currently ffh_bw is known
                58
5      and currently sl_bw_ur_wert is known
                58
4     THEN sl_bw_fuenfz_eing =
                58
15              (sl_bw_zweif_eing * sl_bw_ur_wert) / 100
                58
4     and show  (sl_bw_fuenfz_eing ,ffh_bw)  (use (bs_sl_bw))
                58

                 0
1  Premise failed because ...
                26
1  Clause #2 failed.
                17
1  ----------------------------------------------------------------
                71

                 0
1  ----------------------------------------------------------------
                71
1  -- Trying Monitor Rule E_R_BW_UR_WERT_UMR of BAUMWOLLE_KOMPL(1) --
                66

                 0
4     IF
                58
9          currently sl_bw_ur_wert is not known
                58
5      and currently sl_bw_fuenfz_eing is known
                58
5      and currently sl_bw_zweif_eing  is  known
                58
5      and currently ffh_bw            is  known
                58
4     THEN sl_bw_ur_wert = (( sl_bw_fuenfz_eing * 100 )
                58
25                         / sl_bw_zweif_eing )
                58
5      and show (sl_bw_ur_wert,ffh_bw) (use (bs_sl_bw))
                52

                 0
1  Premise failed because ...
                26
1  Clause #1 failed.
                17
1  ----------------------------------------------------------------
                71

                 0
1  ----------------------------------------------------------------
                71
1  -- Trying Monitor Rule E_R_SL_ZWEIFUENF_UMR of BAUMWOLLE_KOMPL(1) --
                68

                 0
4     IF currently sl_bw_zweif_eing is not known
                58
5      and currently ffh_bw           is known
                58
5      and currently sl_bw_fuenfz_eing  is known
                58
```

```
5     and currently sl_bw_ur_wert is known
                58
4    THEN sl_bw_zweif_eing = ((sl_bw_fuenfz_eing * 100 )
                58
27                          / sl_bw_ur_wert)
                58
4    and show (sl_bw_zweif_eing,ffh_bw) (use (bs_sl_bw))
                54

                 0
1  Premise failed because ...
                26
1  Clause #2 failed.
                17
1  ----------------------------------------------------------------
                71

                 0
1  && Completed monitor rules for SL_BW_ZWEIF_EING of EINGABE(1) &&
                64
1  ==> End of Task set for FCB BAUMWOLLE_KOMPL(1) TCB DETERMINE
                60
1  ==> FCB BAUMWOLLE_KOMPL(1) queued to pending FCB list
                53
1  ==> Control given to FCB (BAUMWOLLE_KOMPL)
                42
2   +++ Discover
                13
1  Quiesce State
                13
1  Use Rules
                 9
1  ==> Forward Chaining
                20
1  ----------------------------------------------------------------
                71

                 0
1  The Premise of Rule B_R_REIFEGR_PM of BAUMWOLLE_KOMPL(1) is satisfied.
                70

                 0
1  IF
                55
7       CURRENTLY  reifegr_pm       IS NOT KNOWN
                58
4    THEN
                58
7       reifegr_pm = ((2.44 - (square(1.76 - reifegr_br)))
                58
21                     / 0.0212)
                29

                 0
1  ----------------------------------------------------------------
                71
1  -- Firing Rule B_R_REIFEGR_PM of BAUMWOLLE_KOMPL(1) --
                54

                 0
4    IF
                58
7       CURRENTLY  reifegr_pm       IS NOT KNOWN
                58
4    THEN
                58
7       reifegr_pm = ((2.44 - (square(1.76 - reifegr_br)))
                58
21                     / 0.0212)
                29

                 0
```

```
1  >>>> REIFEGR_PM
                15
3    assigned = 75.1698113208  (1).
                71

                 5
1  >>>> Resulting value after assignment:
                38
1  75.1698113208  (1)
                18
1  ----------------------------------------------------------------
                71
1  Evaluating premise references to REIFEGR_PM of AUTOCORO(1).
                59

                 0
1  ----------------------------------------------------------------
                71
                 0
1  The Premise of Rule B_R_REIFEGR_BR of BAUMWOLLE_KOMPL(1) is satisfied.
                70

                 0
1  IF
                55
7        CURRENTLY  reifegr_pm       IS KNOWN
                58
4     THEN
                58
7        reifegr_br = (1.76 - (sqroot(2.44 - (0.0212 *
                58
21                    reifegr_pm))))
                34

                 0
1  Premise of Rule B_R_REIFEGR_PM of BAUMWOLLE_KOMPL(1) succeeded with
                68
1  certainty (1).
                14
1  ----------------------------------------------------------------
                71

                 0
1  ----------------------------------------------------------------
                71
1  -- Firing Rule B_R_REIFEGR_BR of BAUMWOLLE_KOMPL(1) --
                54

                 0
4     IF
                58
7        CURRENTLY  reifegr_pm       IS KNOWN
                58
4     THEN
                58
7        reifegr_br = (1.76 - (sqroot(2.44 - (0.0212 *
                58
21                    reifegr_pm))))
                34

                 0
1  >>>> REIFEGR_BR
                15
3    assigned = 0.84  (1).
                71

                 5
1  >>>> Resulting value after assignment:
                38
1  0.84  (1)
                 9
```

```
1  ----------------------------------------------------------------------
                    71
1  Evaluating premise references to REIFEGR_BR of AUTOCORO(1).
                    59

                     0
1  Premise of Rule B_R_REIFEGR_BR of BAUMWOLLE_KOMPL(1) succeeded with
                    68
1  certainty (1).
                    14
1  ----------------------------------------------------------------------
                    71

                     0
1  ==> End of Task set for FCB BAUMWOLLE_KOMPL(1) TCB DISCOVER
                    59
1  ==> FCB BAUMWOLLE_KOMPL(1) queued to pending FCB list
                    53
1  ==> Control given to FCB (BAUMWOLLE_KOMPL)
                    42
2   +++ Display Values +++
                    23
5      value of SL_BW_FUENFZ_EING (  1)(1)
                    39
1  --Focus On
                    10
1  --Ignore
                     8
1  ==> Display Results
                    19
7        value of SL_BW_FUENFZ_EING (  1)(1)
                    41
1  ==> Screen: BS_SL_BW
                    20
1  && Trying monitor rules for SL_BW_FUENFZ_EING of EINGABE(1) &&
                    62
1  ----------------------------------------------------------------------
                    71
1  -- Trying Monitor Rule E_R_SL_FUENFZIG_UMR of BAUMWOLLE_KOMPL(1) --
                    67

                     0
4     IF currently sl_bw_fuenfz_eing is not known
                    58
5      and currently sl_bw_zweif_eing is known
                    58
4     and currently ffh_bw is known
                    58
5      and currently sl_bw_ur_wert is known
                    58
4     THEN sl_bw_fuenfz_eing =
                    58
15                (sl_bw_zweif_eing * sl_bw_ur_wert) / 100
                    58
4     and show  (sl_bw_fuenfz_eing ,ffh_bw)  (use (bs_sl_bw))
                    58

                     0
1  Premise failed because ...
                    26
1  Clause #2 failed.
                    17
1  ----------------------------------------------------------------------
                    71

                     0
1  ----------------------------------------------------------------------
                    71
1  -- Trying Monitor Rule E_R_BW_UR_WERT_UMR of BAUMWOLLE_KOMPL(1) --
                    66

                     0
```

```
4     IF
                58
9         currently sl_bw_ur_wert is not known
                58
5      and currently sl_bw_fuenfz_eing is known
                58
5      and currently sl_bw_zweif_eing  is  known
                58
5      and currently ffh_bw            is  known
                58
4     THEN sl_bw_ur_wert = (( sl_bw_fuenfz_eing * 100 )
                58
25                        / sl_bw_zweif_eing )
                58
5      and show (sl_bw_ur_wert,ffh_bw) (use (bs_sl_bw))
                52

                 0
1  Premise failed because ...
                26
1  Clause #1 failed.
                17
1  ----------------------------------------------------------------------
                71
                 0
1  ----------------------------------------------------------------------
                71
1  -- Trying Monitor Rule E_R_SL_ZWEIFUENF_UMR of BAUMWOLLE_KOMPL(1) --
                68

                 0
4     IF currently sl_bw_zweif_eing is not known
                58
5      and currently ffh_bw           is known
                58
5      and currently sl_bw_fuenfz_eing  is known
                58
5      and currently sl_bw_ur_wert is known
                58
4     THEN sl_bw_zweif_eing = ((sl_bw_fuenfz_eing * 100 )
                58
27                         / sl_bw_ur_wert)
                58
4     and show (sl_bw_zweif_eing,ffh_bw) (use (bs_sl_bw))
                54

                 0
1  Premise failed because ...
                26
1  Clause #2 failed.
                17
1  ----------------------------------------------------------------------
                71

                 0
1  && Completed monitor rules for SL_BW_FUENFZ_EING of EINGABE(1) &&
                65
1  && Trying monitor rules for SL_BW_ZWEIF_EING of EINGABE(1) &&
                61
1  ----------------------------------------------------------------------
                71
1  -- Trying Monitor Rule E_R_SL_FUENFZIG_UMR of BAUMWOLLE_KOMPL(1) --
                67

                 0
4     IF currently sl_bw_fuenfz_eing is not known
                58
5      and currently sl_bw_zweif_eing is known
                58
4     and currently ffh_bw is known
                58
```

```
5     and currently sl_bw_ur_wert is known
                58
4    THEN sl_bw_fuenfz_eing =
                58
15              (sl_bw_zweif_eing * sl_bw_ur_wert) / 100
                58
4    and show  (sl_bw_fuenfz_eing ,ffh_bw)  (use (bs_sl_bw))
                58

                 0
1  Premise failed because ...
                26
1  Clause #2 failed.
                17
1  ----------------------------------------------------------------
                71

                 0
1  ----------------------------------------------------------------
                71
1  -- Trying Monitor Rule E_R_BW_UR_WERT_UMR of BAUMWOLLE_KOMPL(1) --
                66

                 0
4    IF
                58
9         currently sl_bw_ur_wert is not known
                58
5     and currently sl_bw_fuenfz_eing is known
                58
5     and currently sl_bw_zweif_eing  is  known
                58
5     and currently ffh_bw            is  known
                58
4    THEN sl_bw_ur_wert = (( sl_bw_fuenfz_eing * 100 )
                58
25                      / sl_bw_zweif_eing )
                58
5     and show (sl_bw_ur_wert,ffh_bw) (use (bs_sl_bw))
                52

                 0
1  Premise failed because ...
                26
1  Clause #1 failed.
                17
1  ----------------------------------------------------------------
                71

                 0
1  ----------------------------------------------------------------
                71
1  -- Trying Monitor Rule E_R_SL_ZWEIFUENF_UMR of BAUMWOLLE_KOMPL(1) --
                68

                 0
4    IF currently sl_bw_zweif_eing is not known
                58
5     and currently ffh_bw           is known
                58
5     and currently sl_bw_fuenfz_eing  is known
                58
5     and currently sl_bw_ur_wert is known
                58
4    THEN sl_bw_zweif_eing = ((sl_bw_fuenfz_eing * 100 )
                58
27                        / sl_bw_ur_wert)
                58
4    and show (sl_bw_zweif_eing,ffh_bw) (use (bs_sl_bw))
                54

                 0
```

```
1  Premise failed because ...
                    26
1  Clause #2 failed.
                    17
1  ----------------------------------------------------------------
                    71

                     0
1  && Completed monitor rules for SL_BW_ZWEIF_EING of EINGABE(1) &&
                    64
1  && Trying monitor rules for SL_BW_UR_WERT of AUTOCORO(1) &&
                    59
1  ----------------------------------------------------------------
                    71
1  -- Trying Monitor Rule E_R_SL_FUENFZIG_UMR of BAUMWOLLE_KOMPL(1) --
                    67

                     0
4     IF currently sl_bw_fuenfz_eing is not known
                    58
5      and currently sl_bw_zweif_eing is known
                    58
4     and currently ffh_bw is known
                    58
5      and currently sl_bw_ur_wert is known
                    58
4     THEN sl_bw_fuenfz_eing =
                    58
15                 (sl_bw_zweif_eing * sl_bw_ur_wert) / 100
                    58
4     and show  (sl_bw_fuenfz_eing ,ffh_bw)  (use (bs_sl_bw))
                    58

                     0
1  Premise failed because ...
                    26
1  Clause #2 failed.
                    17
1  ----------------------------------------------------------------
                    71

                     0
1  ----------------------------------------------------------------
                    71
1  -- Trying Monitor Rule E_R_BW_UR_WERT_UMR of BAUMWOLLE_KOMPL(1) --
                    66

                     0
4     IF
                    58
9          currently sl_bw_ur_wert is not known
                    58
5      and currently sl_bw_fuenfz_eing is known
                    58
5      and currently sl_bw_zweif_eing  is  known
                    58
5      and currently ffh_bw            is  known
                    58
4     THEN sl_bw_ur_wert = (( sl_bw_fuenfz_eing * 100 )
                    58
25                         / sl_bw_zweif_eing )
                    58
5      and show (sl_bw_ur_wert,ffh_bw) (use (bs_sl_bw))
                    52

                     0
1  Premise failed because ...
                    26
1  Clause #1 failed.
                    17
```

```
 1 ----------------------------------------------------------------
                   71

                    0
 1 ----------------------------------------------------------------
                   71
 1 -- Trying Monitor Rule E_R_SL_ZWEIFUENF_UMR of BAUMWOLLE_KOMPL(1) --
                   68

                    0
 4     IF currently sl_bw_zweif_eing is not known
                   58
 5      and currently ffh_bw          is known
                   58
 5      and currently sl_bw_fuenfz_eing  is known
                   58
 5      and currently sl_bw_ur_wert is known
                   58
 4     THEN sl_bw_zweif_eing = ((sl_bw_fuenfz_eing * 100 )
                   58
27                            / sl_bw_ur_wert)
                   58
 4     and show (sl_bw_zweif_eing,ffh_bw) (use (bs_sl_bw))
                   54

                    0
 1  Premise failed because ...
                   26
 1  Clause #2 failed.
                   17
 1 ----------------------------------------------------------------
                   71

                    0
 1  && Completed monitor rules for SL_BW_UR_WERT of AUTOCORO(1) &&
                   62
 1  ==> End of Task set for FCB BAUMWOLLE_KOMPL(1) TCB DISPLAY
                   58
 1  ==> FCB BAUMWOLLE_KOMPL(1) queued to pending FCB list
                   53
 1  ==> Control given to FCB (BAUMWOLLE_KOMPL)
                   42
 2   +++ Determine Values
                   21
 5      value of SL_BW_FUENFZIG (  1)(1)
                   36
 1  --Focus On
                   10
 1  --Ignore
                    8
 1  --Dont Ask
                   10
 1  --Dont Acquire
                   14
 1  --Dont Infer
                   12
 1  --Use Rules
                   11
 1  ==> Backward Chaining for
                   25
 7        value of SL_BW_FUENFZIG (  1)(1)
                   38

                    0
 1 ----------------------------------------------------------------
                   71
 1  ==> Goal parameter resolved:
                   28
 1  SL_BW_FUENFZIG of AUTOCORO(1) (Current State:Resolved)
                   54
 1  13  (1)
                    7
```

```
1  ----------------------------------------------------------------------
                    71
1  ==> End of Task set for FCB BAUMWOLLE_KOMPL(1) TCB DETERMINE
                    60
1  ==> FCB BAUMWOLLE_KOMPL(1) queued to pending FCB list
                    53
1  ==> Control given to FCB (BAUMWOLLE_KOMPL)
                    42
1  ==> End of focus set for FCB BAUMWOLLE_KOMPL(1)
                    47
1  ==> Maximum Instances reached for FCB BAUMWOLLE_KOMPL
                    53
1  ==> FCB BAUMWOLLE_KOMPL(1) queued to pending FCB list
                    53
1  ==> Control given to FCB (BAUMWOLLE_KOMPL)
                    42
1  ==> FCB BAUMWOLLE_KOMPL(1) complete
                    35
1  ==> FCB BAUMWOLLE_KOMPL(   1) disposed.
                    39
1  ==> FCB EINGABE(1) queued to pending FCB list
                    45
1  ==> Control given to FCB (EINGABE)
                    34

                     0
1  ** Determining E_STR of EINGABE(1) **
                    37

                     0
1  ----------------------------------------------------------------------
                    71
1  -- Trying Rule RS_ART_BAUMWOLLE of EINGABE(1) --
                    48

                     0
4     if rs_art = 'Cotton'
                    58
4     and rs_art_bw is known
                    58
4     and rs_bw_verschmutz is known
                    58
4     and sl_bw_fuenfzig is known
                    58
4     and ffh_bw          is known
                    58
4     and e_p_bw_schmutz_messw = 'no'
                    58
4     then e_str = 'bw'
                    58
4     and fl_syn = 0
                    58
4     and fl_chem = 0
                    58
4     and fl_wol = 0
                    58
4     and fl_einheit = 'mm'
                    24

                     0
1  Unknown parameter(s) in the premise:
                    36
1  FFH_BW of AUTOCORO(1) (Current State:UnProcessed)
                    49
1  ----------------------------------------------------------------------
                    71

                     0

                     0
1  ** Determining FFH_BW of AUTOCORO(1) **
                    39
```

```
                    0
1  >>>> FFH_BW
                   11
3    assigned = 0  (1).
                   71

                    5
1  >>>> Resulting value after assignment:
                   38
1  0  (1)
                    6
1  && Trying monitor rules for FFH_BW of AUTOCORO(1) &&
                   52
1  && Completed monitor rules for FFH_BW of AUTOCORO(1) &&
                   55
1  -- Trying to resolve Default Constraint
                   39

                    0
4     = 0
                    6

                    0
1  Default Constraint resolution successful
                   40
1  -- Default constraint applied
                   29

                    0
1  ** Processing of FFH_BW of AUTOCORO(1) completed **
                   51

                    0
1  ** Determining E_STR of EINGABE(1) **
                   37
                    0
1  ----------------------------------------------------------------------
                   71
1  -- Trying Rule RS_ART_BAUMWOLLE of EINGABE(1) --
                   48

                    0
4     if rs_art = 'Cotton'
                   58
4     and rs_art_bw is known
                   58
4     and rs_bw_verschmutz is known
                   58
4     and sl_bw_fuenfzig is known
                   58
4     and ffh_bw          is known
                   58
4     and e_p_bw_schmutz_messw = 'no'
                   58
4     then e_str = 'bw'
                   58
4     and fl_syn = 0
                   58
4     and fl_chem = 0
                   58
4     and fl_wol = 0
                   58
4     and fl_einheit = 'mm'
                   24

                    0
1  >>>> E_STR
                   10
3    assigned = 'bw' (1).
                   71

                    5
```

```
1  >>>> Resulting value after assignment:
                    38
1  'bw' (1)
                     8
1  >>>> FL_SYN
                    11
3    assigned = 0  (1).
                    71
                     5
1  >>>> Resulting value after assignment:
                    38
1  0  (1)
                     6
1  >>>> FL_CHEM
                    12
3    assigned = 0  (1).
                    71

                     5
1  >>>> Resulting value after assignment:
                    38
1  0  (1)  .
                     6
1  >>>> FL_WOL
                    11
3    assigned = 0  (1).
                    71

                     5
1  >>>> Resulting value after assignment:
                    38
1  0  (1)
                     6
1  >>>> FL_EINHEIT
                    15
3    assigned = 'mm' (1).
                    71

                     5
1  >>>> Resulting value after assignment:
                    38
1  'mm' (1)
                     8
1  Premise of Rule RS_ART_BAUMWOLLE of EINGABE(1) succeeded with
                    62
1  certainty (1).
                    14
1  ----------------------------------------------------------------------
                    71

                     0

                     0
1  ** Processing of E_STR of EINGABE(1) completed **
                    49
1  ==> End of Task set for FCB EINGABE(1) TCB DETERMINE
                    52
1  ==> FCB EINGABE(1) queued to pending FCB list
                    45
1  ==> Control given to FCB (EINGABE)
                    34
2   +++ Determine Values
                    21
5      value of E_P_FLAG (  1)(1)
                    30
1  --Focus On
                    10
1  --Ignore
                     8
1  --Dont Ask
                    10
```

```
1  --Dont Acquire
                14
1  --Dont Infer
                12
1  --Use Rules
                11
1  ==> Backward Chaining for
                25
7        value of E_P_FLAG (  1)(1)
                32

                 0
1  ** Determining E_P_FLAG of EINGABE(1) **
                40

                 0
1  ----------------------------------------------------------------
                71
1  -- Trying Rule RS_ART_MI_BW_MESSW of EINGABE(1) --
                50

                 0
4     IF rs_art = 'Fiber blends'
                58
4     and mibw_proz > 0
                58
4     and rs_art_bw is known
                58
4     and rs_bw_verschmutz is known
                58
4     and sl_bw_fuenfzig is known
                58
4     and ffh_bw          is known
                58
4     and e_p_bw_schmutz_messw = 'yes'
                58
4     then e_p_flag        = 1
                58
5      and establish schmutz_messwert immediate
                44
                 0
1  Premise failed because ...
                26
1  Clause #1 failed.
                17
1  ----------------------------------------------------------------
                71

                 0
1  >>>> E_P_FLAG
                13
3    assigned = 0  (1).
                71

                 5
1  >>>> Resulting value after assignment:
                38
1  0  (1)
                 6
1  -- Trying to resolve Default Constraint
                39

                 0
4     = 0
                 6

                 0
1  Default Constraint resolution successful
                40
1  -- Default constraint applied
                29
```

```
                    0
1  ** Processing of E_P_FLAG of EINGABE(1) completed **
                   52
1  ==> End of Task set for FCB EINGABE(1) TCB DETERMINE
                   52
1  ==> FCB EINGABE(1) queued to pending FCB list
                   45
1  ==> Control given to FCB (EINGABE)
                   34
2   +++ Discover
                   13
1  Quiesce State
                   13
1  Use Rules
                    9
1  ==> Forward Chaining
                   20
1  ==> End of Task set for FCB EINGABE(1) TCB DISCOVER
                   51
1  ==> FCB EINGABE(1) queued to pending FCB list
                   45
1  ==> Control given to FCB (EINGABE)
                   34
2   +++ Establish Focuses +++
                   26
5      value of PLAUSIBILITAETSPRUEFUNG (1)
                   40
1  --Focus On
                   10
1  --Ignore
                    8
1  ==> End of Task set for FCB EINGABE(1) TCB ESTABLISH
                   52
1  ==> FCB PLAUSIBILITAETSPRUEFUNG(1) queued to pending FCB list
                   61
1  ==> Reply to initial instance query for FCB PLAUSIBILITAETSPRUEFUNG is
                   71
1  YES.
                    4
1  ==> Control blocks built
                   24
1  ==> Control given to FCB (PLAUSIBILITAETSPRUEFUNG)
                   50
2   +++ Determine Values
                   21
5      value of RDV_DUSTF (  1)(1)
                   31
5      value of RDV_TRASHF (  1)(1)
                   32
5      value of SL_BW_FUENFZIG (  1)(1)
                   36
1  --Focus On
                   10
1  --Ignore
                    8
1  --Dont Ask
                   10
1  --Dont Acquire
                   14
1  --Dont Infer
                   12
1  --Use Rules
                   11
1  ==> Backward Chaining for
                   25
7        value of RDV_DUSTF (  1)(1)
                   33
7        value of RDV_TRASHF (  1)(1)
                   34
7        value of SL_BW_FUENFZIG (  1)(1)
                   38
```

```
                    0
1  ** Determining RDV_DUSTF of AUTOCORO(1) **
                   42

                    0
1  ----------------------------------------------------------------------
                   71
1  -- Trying Rule P_R_BANDREINHEIT_N_BW of PLAUSIBILITAETSPRUEFUNG(1) --
                   69

                    0
4     IF (rs_art =      ('Cellulosic fibers',
                   58
10          'Synthetic fibers (e.g. PES, PAC)',
                   58
10          'Wool (not yet implemented) ')
                   58
5      or  (rs_art =  'Fiber blends'
                   58
10          and mibw_proz = 0  ))
                   58
4     THEN rdv_dustf = 0
                   58
5      and summe_dust = 0.00
                   58
5      and r_bw_dust_500 = 0.0
                   58
5      and r_bw_dust_15  = 0.0
                   58
5      and r_bw_dust_50  = 0.0
                   58
5      and r_bw_dust_100 = 0.0
                   58
5      and r_bw_trash_gem  = 0.0
                   58
5      and r_bw_trash_gem_sh  = 0.0
                   58
5      and  rdv_trashf = 0
                   23

                    0
1  Premise failed because ...
                   26
1  Clause #1 failed.
                   17
1  Clause #2 failed.
                   17
1  ----------------------------------------------------------------------
                   71

                    0
1  ----------------------------------------------------------------------
                   71
1  -- Trying Rule REINHEIT_DUST_BWM of PLAUSIBILITAETSPRUEFUNG(1) --
                   65

                    0
4     If ( rs_art    = 'Fiber blends'
                   58
9          and mibw_proz >  0
                   58
9          and rs_bw_verschmutz is known
                   58
9          and rdv_dust    is known
                   58
9          and rdv_trash   is known )
                   58
4     then rdv_dustf = rdv_dust * (mibw_proz / 100)
                   58
4     and rdv_trashf = rdv_trash * (mibw_proz/ 100)
                   48
```

```
                    0
1  Premise failed because ...
                   26
1  Clause #1 failed.
                   17
1  ----------------------------------------------------------------------
                   71

                    0
1  ----------------------------------------------------------------------
                   71
1  -- Trying Rule REINHEIT_DUST_BW of PLAUSIBILITAETSPRUEFUNG(1) --
                   64

                    0
4     If   rs_art     = 'Cotton'
                   58
9          and rdv_dust    is known
                   58
9          and rdv_trash   is known
                   58
4     then rdv_dustf = rdv_dust
                   58
4     and rdv_trashf = rdv_trash
                   29

                    0
1  Unknown parameter(s) in the premise:
                   36
1  RDV_DUST of AUTOCORO(1) (Current State:UnProcessed)
                   51
1  Clause #3 failed.
                   17
1  ----------------------------------------------------------------------
                   71

                    0
1  ----------------------------------------------------------------------
                   71
1  -- Trying Rule REINHEITSSTUFE_4B of PLAUSIBILITAETSPRUEFUNG(1) --
                   65

                    0
4     if ( rs_art     = 'Cotton'
                   58
4     or currently mibw_proz > 0 )
                   58
4     and vorwerk     = 'inadequate for rotor spinning'
                   58
4     then rdv_dust = 100
                   58
4     and rdv_trash = 100
                   22

                    0
1  Premise failed because ...
                   26
1  Clause #3 failed.
                   17
1  ----------------------------------------------------------------------
                   71

                    0
1  ----------------------------------------------------------------------
                   71
1  -- Trying Rule REINHEITSSTUFE_3B of PLAUSIBILITAETSPRUEFUNG(1) --
                   65

                    0
4     IF  currently rs_bw_verschmutz =
                   58
```

```
21                    'sticky (such as honeydew, seed oil)'
                   58
 4    and vorwerk    = 'adequate for rotor spinning     '
                   58
 4    then rdv_dust = 80
                   58
 4    and rdv_trash = 50
                   21

                    0
 1  Premise failed because ...
                   26
 1  Clause #1 failed.
                   17
 1  ----------------------------------------------------------------
                   71

                    0
 1  ----------------------------------------------------------------
                   71
 1  -- Trying Rule REINHEITSSTUFE_3A of PLAUSIBILITAETSPRUEFUNG(1) --
                   65

                    0
 4    IF  currently rs_bw_verschmutz =
                   58
21                     'high microdust content'
                   58
 4    and vorwerk    = 'adequate for rotor spinning     '
                   58
 4    then rdv_dust = 80
                   58
 4    and rdv_trash = 33
                   21

                    0
 1  Premise failed because ...
                   26
 1  Clause #1 failed.
                   17
 1  ----------------------------------------------------------------
                   71

                    0
 1  ----------------------------------------------------------------
                   71
 1  -- Trying Rule REINHEITSSTUFE_AH of PLAUSIBILITAETSPRUEFUNG(1) --
                   65

                    0
 4    IF currently rs_bw_verschmutz = ('none known',
                   58
16                 'contaminated (e.g., microbiologically)')
                   58
 4    and  vorwerk    is not 'inadequate for rotor spinning'
                   58
 4    then rdv_dust = 33
                   58
 4    and rdv_trash = 33
                   21

                    0
 1  >>>> RDV_DUST
                   13
 3    assigned = 33  (1).
                   71

                    5
 1  >>>> Resulting value after assignment:
                   38
 1  33  (1)
                    7
```

```
1  >>>> RDV_TRASH
                    14
3    assigned = 33  (1).
                    71

                     5
1  >>>> Resulting value after assignment:
                    38
1  33  (1)
                     7
1  Premise of Rule REINHEITSSTUFE_AH of PLAUSIBILITAETSPRUEFUNG(1)
                    64
1  succeeded with certainty (1).
                    29
1  ----------------------------------------------------------------------
                    71

                     0

                     0
1  ** Processing of RDV_DUST of AUTOCORO(1) completed **
                    53

                     0
1  ** Determining RDV_DUSTF of AUTOCORO(1) **
                    42

                     0
1  ----------------------------------------------------------------------
                    71
1  -- Trying Rule REINHEIT_DUST_BW of PLAUSIBILITAETSPRUEFUNG(1) --
                    64

                     0
4     If   rs_art     = 'Cotton'
                    58
9          and rdv_dust    is known
                    58
9          and rdv_trash   is known
                    58
4     then rdv_dustf = rdv_dust
                    58
4     and rdv_trashf = rdv_trash
                    29

                     0
1  >>>> RDV_DUSTF
                    14
3    assigned = 33  (1).
                    71

                     5
1  >>>> Resulting value after assignment:
                    38
1  33  (1)
                     7
1  >>>> RDV_TRASHF
                    15
3    assigned = 33  (1).
                    71

                     5
1  >>>> Resulting value after assignment:
                    38
1  33  (1)
                     7
1  Premise of Rule REINHEIT_DUST_BW of PLAUSIBILITAETSPRUEFUNG(1)
                    63
1  succeeded with certainty (1).
                    29
1  ----------------------------------------------------------------------
                    71
```

```
                0

                0
1  ** Processing of RDV_DUSTF of AUTOCORO(1) completed **
               54

                0
1  ----------------------------------------------------------------
               71
1  ==> Goal parameter resolved:
               28
1  RDV_TRASHF of AUTOCORO(1) (Current State:Resolved)
               50
1  33  (1)
                7
1  ----------------------------------------------------------------
               71

                0
1  ----------------------------------------------------------------
               71
1  ==> Goal parameter resolved:
               28
4     IF currently art_w  = 'Denim (classical)'
               58
4     and rs_art = 'Cotton'
               58
4     and (gfh_nm_min + gfh_nm_max) / 2
               58
8         is in interval >= 8 : <= 17
               58
4     then
               58
4     gdbw_a_met  = 150
               20

                0
1  Unknown parameter(s) in the premise:
               36
1  GFH_NM_MIN of EINGABE(1) (Current State:UnProcessed)
               52
1  GFH_NM_MAX of EINGABE(1) (Current State:UnProcessed)
               52
1  ----------------------------------------------------------------
               71

                0

                0
1  ** Determining GFH_NM_MIN of EINGABE(1) **
               42

                0
1  ----------------------------------------------------------------
               71
1  -- Trying Rule UMR_GFH_NM_TEX of PLAUSIBILITAETSPRUEFUNG(1) --
               62

                0
4     IF  gfh_einheit = 'Nm'
               58
4     and gfh_min_eing is known
               58
4     and gfh_max_eing is known
               58
4     then
               58
4     gfh_tex_max = round (10000 / gfh_max_eing) / 10
               58
4     and gfh_tex_min = round (10000 / gfh_min_eing) / 10
               58
4     and gfh_nm_max = gfh_max_eing
               58
```

```
4     and gfh_nm_min = gfh_min_eing
                32

                 0
1  Unknown parameter(s) in the premise:
                36
1  GFH_MAX_EING of EINGABE(1) (Current State:UnProcessed)
                54
1  ----------------------------------------------------------------
                71

                 0

                 0
1  ** Determining GFH_MAX_EING of EINGABE(1) **
                44

                 0
1  >>>> GFH_MAX_EING
                17
1  >>>> Resulting value after assignment:
                38
3    (No values assigned to the parameter at this time.)
                53
1  -- Trying to resolve Default Constraint
                39

                 0
4     = (gfh_min_eing)
                19

                 0
1  >>>> GFH_MAX_EING
                17
3    assigned = 14  (1).
                71

                 5
1  >>>> Resulting value after assignment:
                38
1  14  (1)
                 7
1  Default Constraint resolution successful
                40
1  -- Default constraint applied
                29

                 0
1  ** Processing of GFH_MAX_EING of EINGABE(1) completed **
                56

                 0
1  ** Determining GFH_NM_MIN of EINGABE(1) **
                42
                 0
1  ----------------------------------------------------------------
                71
1  -- Trying Rule UMR_GFH_NM_TEX of PLAUSIBILITAETSPRUEFUNG(1) --
                62

                 0
4     IF  gfh_einheit = 'Nm'
                58
4     and gfh_min_eing is known
                58
4     and gfh_max_eing is known
                58
4     then
                58
4     gfh_tex_max = round (10000 / gfh_max_eing) / 10
                58
```

```
4     and gfh_tex_min = round (10000 / gfh_min_eing) / 10
                    58
4     and gfh_nm_max = gfh_max_eing
                    58
4     and gfh_nm_min = gfh_min_eing
                    32

                     0
1  >>>> GFH_TEX_MAX
                    16
3    assigned = 71.4  (1).
                    71

                     5
1  >>>> Resulting value after assignment:
                    38
1  71.4  (1)
                     9
1  >>>> GFH_TEX_MIN
                    16
3    assigned = 71.4  (1).
                    71

                     5
1  >>>> Resulting value after assignment:
                    38
1  71.4  (1)
                     9
1  >>>> GFH_NM_MAX
                    15
3    assigned = 14  (1).
                    71

                     5
1  >>>> Resulting value after assignment:
                    38
1  14  (1)
                     7
1  && Trying monitor rules for GFH_NM_MAX of EINGABE(1) &&
                    55
1  ----------------------------------------------------------------------
                    71
1  -- Trying Monitor Rule GFH_PRUEFUNG of EINGABE(1) --
                    52

                     0
4     If gfh_nm_min is known
                    58
4     and gfh_nm_min < 8
                    58
4     or gfh_nm_max > 85
                    58
4     THEN show ' The yarn count entered is outside the count
                    58
5      range that can be handled by the AUTOCORO. :br
                    58
4     Limit values are : :br:tb20 >= NM 8  and  <= NM 85 :br
                    58
4     Please terminate this consultation by pressing PF3-key
                    58
4     twice.'
                    10

                     0
1  Premise failed because ...
                    26
1  Clause #1 failed.
                    17
1  Clause #3 failed.
                    17
1  ----------------------------------------------------------------------
                    71
```

```
                    0
1  && Completed monitor rules for GFH_NM_MAX of EINGABE(1) &&
                   58
1  ---------------------------------------------------------------------
                   71
1  -- Executing Constraint V_P_VZGB_EING of VORLAGEBAND(1) --
                   58

                    0

                    3
1  = (gfh_nm_max / v_p_vorlbd_nr)
                   30
                    0
1  Constraint Incomplete
                   21
1  ---------------------------------------------------------------------
                   71

                    0
1  ---------------------------------------------------------------------
                   71
1  -- Executing Constraint V_P_VZGB_EING of DREHZAHL_BESTAETIGUNG(1) --
                   68

                    0

                    3
1  = (gfh_nm_max / v_p_vorlbd_nr)
                   30

                    0
1  Constraint Incomplete
                   21
1  ---------------------------------------------------------------------
                   71

                    0
1  >>>> GFH_NM_MIN
                   15
3    assigned = 14  (1).
                   71

                    5
1  >>>> Resulting value after assignment:
                   38
1  14  (1)
                    7
1  && Trying monitor rules for GFH_NM_MIN of EINGABE(1) &&
                   55
1  ---------------------------------------------------------------------
                   71
1  -- Trying Monitor Rule GFH_PRUEFUNG of EINGABE(1) --
                   52

                    0
4     If gfh_nm_min is known
                   58
4     and gfh_nm_min < 8
                   58
4     or gfh_nm_max > 85
                   58
4     THEN show ' The yarn count entered is outside the count
                   58
5      range that can be handled by the AUTOCORO. :br
                   58
4     Limit values are : :br:tb20 >= NM 8  and  <= NM 85 :br
                   58
4     Please terminate this consultation by pressing PF3-key
                   58
```

```
4     twice.'
                10

                 0
1  Premise failed because ...
                26
1  Clause #2 failed.
                17
1  Clause #3 failed.
                17
1  ----------------------------------------------------------------------
                71

                 0
1  && Completed monitor rules for GFH_NM_MIN of EINGABE(1) &&
                58
1  Premise of Rule UMR_GFH_NM_TEX of PLAUSIBILITAETSPRUEFUNG(1) succeeded
                71
1  with certainty (1).
                19
1  ----------------------------------------------------------------------
                71

                 0

                 0
1  ** Processing of GFH_NM_MIN of EINGABE(1) completed **
                54

                 0
1  ** Determining GDBW_A_MET of EINGABE(1) **
                42

                 0
1  ----------------------------------------------------------------------
                71
1  -- Trying Rule ALPHA_WEBEREI_DENIM_8_17 of PLAUSIBILITAETSPRUEFUNG(1)
                70
1  --
                 2

                 0
4     IF currently art_w  = 'Denim (classical)'
                58
4     and rs_art = 'Cotton'
4     and (gfh_nm_min + gfh_nm_max) / 2
                58
8         is in interval >= 8 : <= 17
                58
4     then
                58
4     gdbw_a_met  = 150
                20

                 0
1  >>>> GDBW_A_MET
                15
3    assigned = 150  (1).
                71

                 5
1  >>>> Resulting value after assignment:
                38
1  150  (1)
                 8
1  Premise of Rule ALPHA_WEBEREI_DENIM_8_17 of PLAUSIBILITAETSPRUEFUNG(1)
                71
1  succeeded with certainty (1).
                29
1  ----------------------------------------------------------------------
                71
```

```
                    0

                    0
1  ** Processing of GDBW_A_MET of EINGABE(1) completed **
                   54
1  ==> End of Task set for FCB PLAUSIBILITAETSPRUEFUNG(1) TCB DETERMINE
                   68
1  ==> FCB PLAUSIBILITAETSPRUEFUNG(1) queued to pending FCB list
                   61
1  ==> Control given to FCB (PLAUSIBILITAETSPRUEFUNG)
                   50
2   +++ Ask Values +++
                   19
5      value of GDBW_A_MET (  1)(1)
                   32
1  --Focus On
                   10
1  --Ignore
                    8
1  --Dont Ask
                   10
1  ==> Asking for the value of GDBW_A_MET
                   38
1  Value of GDBW_A_MET(1) Before User Interaction:
                   47
9          150  (1)
                   16
1  >>>> User response:
                   19
3    assigned = 150  (1).
                   71
                    5
1  >>>> Resulting value after assignment:
                   38
1  150  (1)
                    8

                    0
1  Value of GDBW_A_MET(1) After User Interaction:
                   46
1  150  (1)
                    8
1  ==> End of Task set for FCB PLAUSIBILITAETSPRUEFUNG(1) TCB ASK
                   62
1  ==> FCB PLAUSIBILITAETSPRUEFUNG(1) queued to pending FCB list
                   61
1  ==> Control given to FCB (PLAUSIBILITAETSPRUEFUNG)
                   50
2   +++ Determine Values
                   21
5      value of N_MAX_SYN_EING (  1)(1)
                   36
1  --Focus On
                   10
1  --Ignore
                    8
1  --Dont Ask
                   10
5      value of N_MAX_SYN_EING (  1)(1)
                   36
1  --Dont Acquire
                   14
1  --Dont Infer
                   12
1  --Use Rules
                   11
1  ==> Backward Chaining for
                   25
7        value of N_MAX_SYN_EING (  1)(1)
                   38

                    0
```

```
1  ** Determining N_MAX_SYN_EING of EINGABE(1) **
                    46

                     0
5      value of P_R_N_ESTABL_ABFRAGE_N (1)
                    39
1  ==> Forward Chaining
                    20
1  ==> End of Task set for FCB PLAUSIBILITAETSPRUEFUNG(1) TCB DISCOVER
                    67
1  ==> FCB PLAUSIBILITAETSPRUEFUNG(1) queued to pending FCB list
                    61
1  ==> Control given to FCB (PLAUSIBILITAETSPRUEFUNG)
                    50
2   +++ Determine Values
                    21
5      value of MFAZ (  1)(1)
                    26
5      value of FZ_I_Q_MIN (  1)(1)
                    32
5      value of FZ_I_Q_MAX (  1)(1)
                    32
5      value of MISY_PROZ (  1)(1)
                    31
5      value of N_MAX (  1)(1)
                    27
1  --Focus On
                    10
1  --Ignore
                     8
1  --Dont Ask
                    10
1  --Dont Acquire
                    14
1  --Dont Infer
                    12
1  --Use Rules
                    11
1  ==> Backward Chaining for
                    25
7        value of MFAZ (  1)(1)
                    28
7        value of FZ_I_Q_MIN (  1)(1)
                    34
7        value of FZ_I_Q_MAX (  1)(1)
                    34
7        value of MISY_PROZ (  1)(1)
                    33
7        value of N_MAX (  1)(1)
                    29
1  ----------------------------------------------------------------------
                    71
1  -- Trying Rule P_R_N_MAX_100_EING of PLAUSIBILITAETSPRUEFUNG(1) --
                    66

                     0
4     IF rs_art = ('Cotton','Cellulosic fibers')
                    58
5      or ( currently rs_art_sy = 'Polyacrylic'
                    58
5      or currently rs_art_misy = 'Polyacrylic')
                    58
5      and (( currently ffh_sy_eing <= 1.0
                    58
10          and currently fl_syn  <=  32 )
                    58
6       or currently ffh_sy2 <= 1.0
                    58
10          and currently fl_syn2 <= 32 )
                    58
4     THEN n_max_syn_eing = 100000
                    31
```

```
                    0
1  >>>> N_MAX_SYN_EING
                   19
3    assigned = 100000  (1).
                   71

                    5
1  >>>> Resulting value after assignment:
                   38
1  100000  (1)
                   11
1  Premise of Rule P_R_N_MAX_100_EING of PLAUSIBILITAETSPRUEFUNG(1)
                   65
1  succeeded with certainty (1).
                   29
1  ----------------------------------------------------------------
                   71

                    0

                    0
1  ** Processing of N_MAX_SYN_EING of EINGABE(1) completed **
                   58
1  ==> End of Task set for FCB PLAUSIBILITAETSPRUEFUNG(1) TCB DETERMINE
                   68
1  ==> FCB PLAUSIBILITAETSPRUEFUNG(1) queued to pending FCB list
                   61
1  ==> Control given to FCB (PLAUSIBILITAETSPRUEFUNG)
                   50
2   +++ Discover
                   13
1  Quiesce State
                   13
1  Use Rules
                    9
                    0
1  ** Determining MFAZ of AUTOCORO(1) **
                   37

                    0
1  ----------------------------------------------------------------
                   71
1  -- Trying Rule A_R_MFZ of PLAUSIBILITAETSPRUEFUNG(1) --
                   55

                    0
4     If currently rs_art = 'Cotton'
                   58
4     and sl_bw_zweifuenf > 30
                   58
4     and sl_bw_fuenfzig  > 15
                   58
4     then mfaz = 80
                   17

                    0
1  Premise failed because ...
                   26
1  Clause #2 failed.
                   17
1  ----------------------------------------------------------------
                   71

                    0
1  ----------------------------------------------------------------
                   71
1  -- Trying Rule ANSPRUECHE_HOCH of PLAUSIBILITAETSPRUEFUNG(1) --
                   63

                    0
4     if asp = 'hoch'
                   58
```

```
4     then
                    58
4     mfaz = 120
                    13

                     0
1  Unknown parameter(s) in the premise:
                    36
1  ASP of EINGABE(1) (Current State:UnProcessed)
                    45
1  ----------------------------------------------------------------
                    71

                     0

                     0
1  ** Determining ASP of EINGABE(1) **
                    35

                     0
                     0
1  ** Processing of ASP of EINGABE(1) completed **
                    47

                     0
1  ** Determining MFAZ of AUTOCORO(1) **
                    37

                     0
1  ----------------------------------------------------------------
                    71
1  -- Trying Rule ANSPRUECHE_HOCH of PLAUSIBILITAETSPRUEFUNG(1) --
                    63

                     0
4     if asp = 'hoch'
                    58
4     then
                    58
4     mfaz = 120
                    13

                     0
1  Premise failed because ...
                    26
1  Clause #1 failed.
                    17
1  ----------------------------------------------------------------
                    71

                     0
1  ----------------------------------------------------------------
                    71
1  -- Trying Rule ANSPRUECHE_NIEDRIG of PLAUSIBILITAETSPRUEFUNG(1) --
                    66

                     0
4     if asp = 'niedrig'
                    58
4     then
                    58
4     mfaz =  90
                    13

                     0
1  Premise failed because ...
                    26
1  Clause #1 failed.
                    17
1  ----------------------------------------------------------------
                    71
```

```
                    0
1  Rule V_R_VORLBD_BW_SP(1) is a reference to an unprocessed FCB
                   62
1  (VORLAGEBAND(1)).
                   17
1  ==> FCB VORLAGEBAND(1) queued to pending FCB list
                   49
1  ==> Reply to initial instance query for FCB VORLAGEBAND is YES.
                   63
1  ==> Control blocks built
                   24
1  ==> Control given to FCB (VORLAGEBAND)
                   38
2   +++ Determine Values
                   21
5      value of V_P_VORLBD_DICK_NM (  2)(1)
                   40
5      value of V_P_VORLBD_DUENN_NM (  2)(1)
                   41
5      value of V_P_VORLBD_DICK_NE (  2)(1)
                   40
5      value of V_P_VORLBD_DUENN_NE (  2)(1)
                   41
5      value of V_P_VORLBD_DICK_TE (  2)(1)
                   40
5      value of V_P_VORLBD_DUENN_TE (  2)(1)
                   41
5      value of V_P_VORLBD_DICK_GR (  2)(1)
                   40
5      value of V_P_VORLBD_DUENN_GR (  2)(1)
                   41
1  --Focus On
                   10
1  --Ignore
                    8
1  --Dont Ask
                   10
1  --Dont Acquire
                   14
1  --Dont Infer
                   12
1  --Use Rules
                   11
1  ==> Backward Chaining for
                   25
7       value of V_P_VORLBD_DICK_NM (  2)(1)
                   42
7       value of V_P_VORLBD_DUENN_NM (  2)(1)
                   43
7       value of V_P_VORLBD_DICK_NE (  2)(1)
                   42
7       value of V_P_VORLBD_DUENN_NE (  2)(1)
                   43
7       value of V_P_VORLBD_DICK_TE (  2)(1)
                   42
7       value of V_P_VORLBD_DUENN_TE (  2)(1)
                   43
7       value of V_P_VORLBD_DICK_GR (  2)(1)
                   42
7       value of V_P_VORLBD_DUENN_GR (  2)(1)
                   43

                    0
1  ** Determining V_P_VORLBD_DICK_NM of VORLAGEBAND(1) **
                   54

                    0
1  ----------------------------------------------------------------------
                   71
1  -- Trying Rule V_R_VORLBD_ACRYL of VORLAGEBAND(1) --
                   52
```

```
                    0
4     IF     rs_art = 'Synthetic fibers (e.g. PES, PAC)'
                   58
7        AND rs_art_sy = 'Polyacrylic'
                   58
4     THEN   v_p_vorlbd_dick_nm = 0.2
                   34

                    0
1  Premise failed because ...
                   26
1  Clause #1 failed.
                   17
1  ----------------------------------------------------------------
                   71

                    0
1  >>>> V_P_VORLBD_DICK_NM
                   23
3    assigned = 0.16  (1).
                   71

                    5
1  >>>> Resulting value after assignment:
                   38
1  0.16  (1)
                    9
1  ----------------------------------------------------------------
                   71
1  -- Executing Constraint V_P_VORLBD_DICK_TE of VORLAGEBAND(1) --
                   63

                    0

                    3
1  = (round ( 1000 / v_p_vorlbd_dick_nm ) / 1000 )
                   47

                    0
1  >>>> V_P_VORLBD_DICK_TE
                   23
3    assigned = 6.25  (1).
                   71

                    5
1  >>>> Resulting value after assignment:
                   38
1  6.25  (1)
                    9
1  Constraint Resolved
                   19
1  ----------------------------------------------------------------
                   71

                    0
1  ----------------------------------------------------------------
                   71
1  -- Executing Constraint V_P_VORLBD_DICK_NE of VORLAGEBAND(1) --
                   63

                    0

                    3
1  = (round ( 100  *  v_p_vorlbd_dick_nm  * 0.591) / 100)
                   54

                    0
1  >>>> V_P_VORLBD_DICK_NE
                   23
3    assigned = 0.09  (1).
                   71
```

```
                    5
1  >>>> Resulting value after assignment:
                   38
1  0.09  (1)
                    9
1  Constraint Resolved
                   19
1  ----------------------------------------------------------------
                   71

                    0
1  ----------------------------------------------------------------
                   71
1  -- Executing Constraint V_P_VORLBD_DICK_GR of VORLAGEBAND(1) --
                   63

                    0

                    3
1  = (round ((100 * 14.1) / (v_p_vorlbd_dick_nm * 6 ))
                   55
20                     / 100)
                   25

                    0
1  >>>> V_P_VORLBD_DICK_GR
                   23
3    assigned = 14.69  (1).
                   71

                    5
1  >>>> Resulting value after assignment:
                   38
1  14.69  (1)
                   10
1  Constraint Resolved
                   19
1  ----------------------------------------------------------------
                   71

                    0
1  ----------------------------------------------------------------
                   71
1  -- Executing Constraint V_P_VORLBD_DICK_AMGR of VORLAGEBAND(1) --
                   65

                    0

                    3
1  =  round ( 8.33 / ( v_p_vorlbd_dick_nm * 0.59 ))
                   48

                    0
1  >>>> V_P_VORLBD_DICK_AMGR
                   25
3    assigned = 88  (1).
                   71
                    5
1  >>>> Resulting value after assignment:
                   38
1  88  (1)
                    7
1  Constraint Resolved
                   19
1  ----------------------------------------------------------------
                   71

                    0
1  -- Trying to resolve Default Constraint
                   39
```

```
                    0
4     = 0.16
                    9

                    0
1  Default Constraint resolution successful
                   40
1  -- Default constraint applied
                   29

                    0
1  ** Processing of V_P_VORLBD_DICK_NM of VORLAGEBAND(1) completed **
                   66

                    0
1  ** Determining V_P_VORLBD_DUENN_NM of VORLAGEBAND(1) **
                   55

                    0
1  ----------------------------------------------------------------------
                   71
1  -- Trying Rule V_R_VORLBD_BW_SP of VORLAGEBAND(1) --
                   52

                    0
4     If rs_art = 'Cotton'
                   58
4     and sl_bw_zweifuenf > 30
                   58
4     and sl_bw_fuenfzig  > 15
                   58
4     then mfaz = 80
                   58
4     and v_p_vorlbd_duenn_nm = 0.45
                   33

                    0
1  Premise failed because ...
                   26
1  Clause #2 failed.
                   17
1  ----------------------------------------------------------------------
                   71
                    0
1  >>>> V_P_VORLBD_DUENN_NM
                   24
3    assigned = 0.38  (1).
                   71

                    5
1  >>>> Resulting value after assignment:
                   38
1  0.38  (1)
                    9
1  ----------------------------------------------------------------------
                   71
1  -- Executing Constraint V_P_VORLBD_DUENN_TE of VORLAGEBAND(1) --
                   64

                    0

                    3
1  = (round ( 1000 / v_p_vorlbd_duenn_nm ) / 1000 )
                   48

                    0
1  >>>> V_P_VORLBD_DUENN_TE
                   24
3    assigned = 2.632  (1).
                   71

                    5
```

```
1  >>>> Resulting value after assignment:
                    38
1  2.632  (1)
                    10
1  Constraint Resolved
                    19
1  ----------------------------------------------------------------
                    71

                     0
1  ----------------------------------------------------------------
                    71
1  -- Executing Constraint V_P_VORLBD_DUENN_NE of VORLAGEBAND(1) --
                    64

                     0
                     3
1  = (round ( 100 * 0.591 * v_p_vorlbd_duenn_nm ) / 100 )
                    54

                     0
1  >>>> V_P_VORLBD_DUENN_NE
                    24
3    assigned = 0.22  (1).
                    71

                     5
1  >>>> Resulting value after assignment:
                    38
1  0.22  (1)
                     9
1  Constraint Resolved
                    19
1  ----------------------------------------------------------------
                    71

                     0
1  ----------------------------------------------------------------
                    71
1  -- Executing Constraint V_P_VORLBD_DUENN_GR of VORLAGEBAND(1) --
                    64

                     0

                     3
1  = (round ((100 * 14.1) / (v_p_vorlbd_duenn_nm * 6 ))
                    55
                        / 100)
                    25

                     0
1  >>>> V_P_VORLBD_DUENN_GR
                    24
3    assigned = 6.18  (1).
                    71

                     5
1  >>>> Resulting value after assignment:
                    38
1  6.18  (1)
                     9
1  Constraint Resolved
                    19
1  ----------------------------------------------------------------
                    71

                     0
1  ----------------------------------------------------------------
                    71
1  -- Executing Constraint V_P_VORLBD_DUENN_AMGR of VORLAGEBAND(1) --
                    66

                     0
```

```
                    3
1  =  round ( 8.33 / ( v_p_vorlbd_duenn_nm * 0.59 ))
                   49

                    0
1  >>>> V_P_VORLBD_DUENN_AMGR
                   26
3    assigned = 37  (1).
                   71

                    5
1  >>>> Resulting value after assignment:
                   38
1  37  (1)
                    7
1  Constraint Resolved
                   19
1  ----------------------------------------------------------------
                   71

                    0
1  -- Trying to resolve Default Constraint
                   39

                    0
4     = (0.38)
                   11

                    0
1  Default Constraint resolution successful
                   40
1  -- Default constraint applied
                   29

                    0
1  ** Processing of V_P_VORLBD_DUENN_NM of VORLAGEBAND(1) completed **
                   67

                    0
1  ----------------------------------------------------------------
                   71
1  ==> Goal parameter resolved:
                   28
1  V_P_VORLBD_DICK_NE of VORLAGEBAND(1) (Current State:UnProcessed)
                   64
1  0.09  (1)
                    9
1  ----------------------------------------------------------------
                   71

                    0
1  ----------------------------------------------------------------
                   71
1  ==> Goal parameter resolved:
                   28
1  V_P_VORLBD_DUENN_NE of VORLAGEBAND(1) (Current State:UnProcessed)
                   65
1  0.22  (1)
                    9
1  ----------------------------------------------------------------
                   71

                    0
1  ----------------------------------------------------------------
                   71
1  ==> Goal parameter resolved:
                   28
1  V_P_VORLBD_DICK_TE of VORLAGEBAND(1) (Current State:UnProcessed)
                   64
1  6.25  (1)
                    9
```

```
1  ----------------------------------------------------------------------
                    71

                     0
1  ----------------------------------------------------------------------
                    71
1  ==> Goal parameter resolved:
                    28
1  V_P_VORLBD_DUENN_TE of VORLAGEBAND(1) (Current State:UnProcessed)
                    65
1  2.632  (1)
                    10
1  ----------------------------------------------------------------------
                    71

                     0
1  ----------------------------------------------------------------------
                    71
1  ==> Goal parameter resolved:
                    28
1  V_P_VORLBD_DICK_GR of VORLAGEBAND(1) (Current State:UnProcessed)
                    64
1  14.69  (1)
                    10
1  ----------------------------------------------------------------------
                    71

                     0
1  ----------------------------------------------------------------------
                    71
1  ==> Goal parameter resolved:
                    28
1  V_P_VORLBD_DUENN_GR of VORLAGEBAND(1) (Current State:UnProcessed)
                    65
1  6.18  (1)
                     9
1  ----------------------------------------------------------------------
                    71
1  ==> End of Task set for FCB VORLAGEBAND(1) TCB DETERMINE
                    56
1  ==> FCB VORLAGEBAND(1) queued to pending FCB list
                    49
1  ==> Control given to FCB (VORLAGEBAND)
                    38
2   +++ Ask Values +++
                    19
5      value of V_P_VORLBD_EING (  2)(1)
                    37
1  --Focus On
                    10
1  --Ignore
                     8
1  --Dont Ask
                    10
1  ==> Asking for the value of V_P_VORLBD_EING
                    43
1  Value of V_P_VORLBD_EING(2) Before User Interaction:
                    52
3    (No values assigned to the parameter at this time.)
                    53
1  >>>> User response:
                    19
3    assigned = 'Nm' (1).
                    71

                     5
1  >>>> Resulting value after assignment:
                    38
1  'Nm' (1)
                     8
1  >>>> User response:
                    19
```

```
3    assigned = 0.16  (1).
                    71

                     5
1  >>>> Resulting value after assignment:
                    38
1  0.16  (1)
                     9

                     0
1  Value of V_P_VORLBD_EING(2) After User Interaction:
                    51
1  0.16  (1)
                     9
1  ==> End of Task set for FCB VORLAGEBAND(1) TCB ASK
                    50
1  ==> FCB VORLAGEBAND(1) queued to pending FCB list
                    49
1  ==> Control given to FCB (VORLAGEBAND)
                    38
2   +++ Determine Values
                    21
5      value of V_P_VORLBD_MOEGL_DI (  2)(1)
                    41
1  --Focus On
                    10
1  --Ignore
                     8
1  --Dont Ask
                    10
1  --Dont Acquire
                    14
1  --Dont Infer
                    12
1  --Use Rules
                    11
1  ==> Backward Chaining for
                    25
7        value of V_P_VORLBD_MOEGL_DI (  2)(1)
                    43

                     0
1  ** Determining V_P_VORLBD_MOEGL_DI of VORLAGEBAND(1) **
                    55

                     0
1  ----------------------------------------------------------------------
                    71
1  -- Trying Rule V_R_VORLBD_BER_NM of VORLAGEBAND(1) --
                    53

                     0
4     IF vorlbd_einheit = 'Nm'
                    58
4     THEN v_p_vorlbd_moegl_di =
                    58
6       (maximum of (v_p_vorlbd_dick_nm,
                    58
6       (round ( 100 * ( gfh_nm_max / v_p_div )) / 100)))
                    58
5      and v_p_vorlbd_moegl_du  = v_p_vorlbd_duenn_nm
                    50

                     0
1  >>>> V_P_VORLBD_MOEGL_DU
                    24
3    assigned = 0.38  (1).
                    71

                     5
1  >>>> Resulting value after assignment:
                    38
```

```
1  0.38  (1)
                    9
1  Unknown parameter(s) in the conclusion:
                   39
1  V_P_DIV of VORLAGEBAND(1) (Current State:UnProcessed)
                   53
1  ---------------------------------------------------------------------
                   71

                    0

                    0
1  ** Determining V_P_DIV of VORLAGEBAND(1) **
                   43

                    0
1  ---------------------------------------------------------------------
                   71
1  -- Trying Rule V_R_DIV of VORLAGEBAND(1) --
                   43

                    0
4     IF currently v_p_warnung = '39 - 276'
                   55
4     THEN v_p_div = 270
                   21

                    0
1  Premise failed because ...
                   26
1  Clause #1 failed.
                   17
1  ---------------------------------------------------------------------
                   71

                    0
1  >>>> V_P_DIV
                   12
3    assigned = 205  (1).
                   71

                    5
1  >>>> Resulting value after assignment:
                   38
1  205  (1)
                    8
1  -- Trying to resolve Default Constraint
                   39

                    0
4     = 205
                    8

                    0
1  Default Constraint resolution successful
                   40
1  -- Default constraint applied
                   29

                    0
1  ** Processing of V_P_DIV of VORLAGEBAND(1) completed **
                   55

                    0
1  ** Determining V_P_VORLBD_MOEGL_DI of VORLAGEBAND(1) **
                   55

                    0
1  ---------------------------------------------------------------------
                   71
1  -- Trying Rule V_R_VORLBD_BER_NM of VORLAGEBAND(1) --
                   53
```

```
                    0
4     IF vorlbd_einheit = 'Nm'
                   58
4     THEN v_p_vorlbd_moegl_di =
                   58
6       (maximum of (v_p_vorlbd_dick_nm,
                   58
6       (round ( 100 * ( gfh_nm_max / v_p_div )) / 100)))
                   58
5      and v_p_vorlbd_moegl_du  = v_p_vorlbd_duenn_nm
                   50

                    0
1  >>>> V_P_VORLBD_MOEGL_DI
                   24
3    assigned = 0.16  (1).
                   71

                    5
1  >>>> Resulting value after assignment:
                   38
1  0.16  (1)
                    9
1  Premise of Rule V_R_VORLBD_BER_NM of VORLAGEBAND(1) succeeded with
                   67
1  certainty (1).
                   14
1  ----------------------------------------------------------------------
                   71

                    0

                    0
1  ** Processing of V_P_VORLBD_MOEGL_DI of VORLAGEBAND(1) completed **
                   67
1  ==> End of Task set for FCB VORLAGEBAND(1) TCB DETERMINE
                   56
1  ==> FCB VORLAGEBAND(1) queued to pending FCB list
                   49
1  ==> Control given to FCB (VORLAGEBAND)
                   38
2   +++ Determine Values
                   21
5      value of VZB (  1)(1)
                   25
1  --Focus On
                   10
1  --Ignore
                    8
1  --Dont Ask
                   10
1  --Dont Acquire
                   14
1  --Dont Infer
                   12
1  --Use Rules
                   11
1  -- Order Rules By
                   17
4     Explicit Sequence
                   20
1  - Ascending
                   11
7        value of V_R_BEREICH1 (1)
                   31
4     Explicit Sequence
                   20
1  - Ascending
                   11
7        value of V_R_BEREICH1A (1)
                   32
```

```
4     Explicit Sequence
                20
1  - Ascending
                11
7        value of V_R_BEREICH2D (1)
                32
4     Explicit Sequence
                20
1  - Ascending
                11
7        value of V_R_BEREICH2A (1)
                32
4     Explicit Sequence
                20
1  - Ascending
                11
7        value of V_R_BEREICH2B (1)
                32
4     Explicit Sequence
                20
1  - Ascending
                11
7        value of V_R_BEREICH2C (1)
                32
1  ==> Backward Chaining for
                25
7        value of VZB (  1)(1)
                27

                 0
1  ** Determining VZB of AUTOCORO(1) **
                36

                 0
1  ----------------------------------------------------------------------
                71
1  -- Trying Rule V_R_BEREICH1 of VORLAGEBAND(1) --
                48

                 0
4     If v_p_vzgb_eing > 200
                58
4     and v_p_vorlbd_nr is in interval
                58
10          >= v_p_vorlbd_dick_nm : <= v_p_vorlbd_duenn_nm
                58
4     and v_p_vzgb_eing is in interval > 200 : <= 212
                58
4     Then vzb = '30 - 212'
                58
4     and Hinweis = ':tb24 The sliver count weight is close
                58
4     :br:tb24 to the lower limit.
                58
4     :br:tb24 The draft ratios are higher then 200.'
                50
                 0
1  Unknown parameter(s) in the premise:
                36
1  V_P_VZGB_EING of VORLAGEBAND(1) (Current State:UnProcessed, Constraint
                71
1  Incomplete)
                11
1  V_P_VORLBD_NR of VORLAGEBAND(1) (Current State:UnProcessed)
                59
1  ----------------------------------------------------------------------
                71

                 0

                 0
```

```
1  ** Determining V_P_VZGB_EING of VORLAGEBAND(1) **
                49

                 0
1  -- Trying to resolve constraint
                31

                 0
4     = (gfh_nm_max / v_p_vorlbd_nr)
                33

                 0
1  Incomplete references in the constraint:
                40
1  V_P_VORLBD_NR of VORLAGEBAND (1)
                32

                 0
1  ** Determining V_P_VORLBD_NR of VORLAGEBAND(1) **
                49

                 0
1  ----------------------------------------------------------------
                71
1  -- Trying Rule V_R_UMR_KTEX_NM of VORLAGEBAND(1) --
                51

                 0
4     IF vorlbd_einheit = 'g / m (ktex)'
                58
4     THEN v_p_vorlbd_nr = (round ( 100 / v_p_vorlbd_eing)) /
                58
25                      100
                27

                 0
1  Premise failed because ...
                26
1  Clause #1 failed.
                17
1  ----------------------------------------------------------------
                71

                 0
1  ----------------------------------------------------------------
                71
1  -- Trying Rule V_R_UMR_NE_NM of VORLAGEBAND(1) --
                49

                 0
4     IF vorlbd_einheit = 'Ne'
                58
4     THEN v_p_vorlbd_nr = (round ( 169 * v_p_vorlbd_eing)) /
                58
25                      100
                27

                 0
1  Premise failed because ...
                26
1  Clause #1 failed.
                17
1  ----------------------------------------------------------------
                71

                 0
1  ----------------------------------------------------------------
                71
1  -- Trying Rule V_R_UMR_GRAINS_NM of VORLAGEBAND(1) --
                53

                 0
```

```
4     IF vorlbd_einheit = 'grains / 6 yards'
                    58
4     THEN v_p_vorlbd_nr = (round ( 100 * 14.1)
                    58
33                                  / (6 * v_p_vorlbd_eing)  /
                    58
25                          100)
                    28

                     0
1  Premise failed because ...
                    26
1  Clause #1 failed.
                    17
1  ----------------------------------------------------------------
                    71
                     0
1  ----------------------------------------------------------------
                    71
1  -- Trying Rule V_R_UMR_NM_NM of VORLAGEBAND(1) --
                    49

                     0
4     IF vorlbd_einheit = 'Nm'
                    58
4     THEN v_p_vorlbd_nr = v_p_vorlbd_eing
                    39

                     0
1  >>>> V_P_VORLBD_NR
                    18
3    assigned = 0.16  (1).
                    71

                     5
1  >>>> Resulting value after assignment:
                    38
1  0.16  (1)
                     9
1  ----------------------------------------------------------------
                    71
1  -- Executing Constraint V_P_VZGB_EING of VORLAGEBAND(1) --
                    58

                     0

                     3
1  = (gfh_nm_max / v_p_vorlbd_nr)
                    30

                     0
1  >>>> V_P_VZGB_EING
                    18
3    assigned = 87.5  (1).
                    71

                     5
1  >>>> Resulting value after assignment:
                    38
1  87.5  (1)
                     9
1  Constraint Resolved
                    19
1  ----------------------------------------------------------------
                    71

                     0
1  Premise of Rule V_R_UMR_NM_NM of VORLAGEBAND(1) succeeded with
                    63
1  certainty (1).
                    14
```

```
1  ----------------------------------------------------------------------
                    71

                     0

                     0
1  ** Processing of V_P_VORLBD_NR of VORLAGEBAND(1) completed **
                    61

                     0
1  ** Determining VZB of AUTOCORO(1) **
                    36

                     0
1  ----------------------------------------------------------------------
                    71
1  -- Trying Rule V_R_BEREICH1 of VORLAGEBAND(1) --
                    48

                     0
4     If v_p_vzgb_eing > 200
                    58
4     and v_p_vorlbd_nr is in interval
                    58
10          >= v_p_vorlbd_dick_nm : <= v_p_vorlbd_duenn_nm
                    58
4     and v_p_vzgb_eing is in interval > 200 : <= 212
                    58
4     Then vzb = '30 - 212'
                    58
4     and Hinweis = ':tb24 The sliver count weight is close
                    58
4     :br:tb24 to the lower limit.
                    58
4     :br:tb24 The draft ratios are higher then 200.'
                    50

                     0
1  Premise failed because ...
                    26
1  Clause #1 failed.
                    17
1  ----------------------------------------------------------------------
                    71

                     0
1  ----------------------------------------------------------------------
                    71
1  -- Trying Rule V_R_BEREICH1A of VORLAGEBAND(1) --
                    49

                     0
4     If v_p_vzgb_eing <= 200
                    58
4     and v_p_vorlbd_nr is in interval
                    58
12            >= v_p_vorlbd_dick_nm : <= v_p_vorlbd_duenn_nm
                    58
4     Then vzb = '30 - 212'
                    24

                     0
1  >>>> VZB
                     8
3    assigned = '30 - 212' (1).
                    71

                     5
1  >>>> Resulting value after assignment:
                    38
1  '30 - 212' (1)
                    14
```

```
1  Premise of Rule V_R_BEREICH1A of VORLAGEBAND(1) succeeded with
                    63
1  certainty (1).
                    14
1  ----------------------------------------------------------------------
                    71

                     0

                     0
1  ** Processing of VZB of AUTOCORO(1) completed **
                    48
1  ==> End of Task set for FCB VORLAGEBAND(1) TCB DETERMINE
                    56
1  ==> FCB VORLAGEBAND(1) queued to pending FCB list
                    49
1  ==> Control given to FCB (VORLAGEBAND)
                    38
1  ==> End of focus set for FCB VORLAGEBAND(1)
                    43
1  ==> Maximum Instances reached for FCB VORLAGEBAND
                    49
1  ==> FCB VORLAGEBAND(1) queued to pending FCB list
                    49
1  ==> Control given to FCB (VORLAGEBAND)
                    38
1  ==> FCB VORLAGEBAND(1) complete
                    31
1  ==> FCB PLAUSIBILITAETSPRUEFUNG(1) queued to pending FCB list
                    61
1  ==> Control given to FCB (PLAUSIBILITAETSPRUEFUNG)
                    50

                     0
1  ** Determining MFAZ of AUTOCORO(1) **
                    37

                     0
1  >>>> MFAZ
                     9
3    assigned = 100  (1).
                    71

                     5
1  >>>> Resulting value after assignment:
                    38
1  100  (1)
                     8
1  && Trying monitor rules for MFAZ of AUTOCORO(1) &&
                    50
1  ----------------------------------------------------------------------
                    71
1  -- Trying Monitor Rule FASERANZAHL_NICHT_AUSR of
                    49
1  PLAUSIBILITAETSPRUEFUNG(1) --
                    29

                     0
4     if fz_i_q_min < mfaz
                    58
4     then
                    58
4     show  'The yarn count cannot be achieved, as the fibers
                    58
5      are too coarse, i.e. the minimum number of fibers in
                    58
4     the cross-section is too small. :br
                    58
4     If you want to go on with the consultation, :br
                    58
4     ENTER key. :br
                    58
```

```
4    If not, press PF3-key twice to terminate.'
                45

                 0
1  Premise failed because ...
                26
1  Clause #1 failed.
                17
1  ----------------------------------------------------------------------
                71

                 0
1  && Completed monitor rules for MFAZ of AUTOCORO(1) &&
                53
1  -- Trying to resolve Default Constraint
                39

                 0
4    = 100
                 8

                 0
1  Default Constraint resolution successful
                40
1  -- Default constraint applied
                29

                 0
1  ** Processing of MFAZ of AUTOCORO(1) completed **
                49

                 0
1  ** Determining FZ_I_Q_MIN of AUTOCORO(1) **
                43

                 0
1  ----------------------------------------------------------------------
                71
1  -- Trying Rule FZ_I_Q_MISCH_MIN of PLAUSIBILITAETSPRUEFUNG(1) --
                64

                 0
4    If rs_art = 'Fiber blends'
                58
4    then fz_i_q_min = round (
                58
5     (gfh_tex_max * sy_proz1 * 10)  / (100 * ffh_sy1)
                58
4    +(gfh_tex_max * sy_proz2 * 10)  / (100 * ffh_sy2)
                58
4    +(gfh_tex_max * sy_proz3 * 10)  / (100 * ffh_sy3)
                58
4    +(gfh_tex_max * sy_proz4 * 10)  / (100 * ffh_sy4)
                58
4    +(gfh_tex_max * sy_proz5 * 10)  / (100 * ffh_sy5)
                58
4    +(gfh_tex_max * ch_proz1 * 10)  / (100 * ffh_ch1)
                58
4    +(gfh_tex_max * ch_proz2 * 10)  / (100 * ffh_ch2)
                58
4    +(gfh_tex_max * ch_proz3 * 10)  / (100 * ffh_ch3)
                58
4    +(gfh_tex_max * mibw_proz / (100 * ffh_tex)))
                48

                 0
1  Premise failed because ...
                26
1  Clause #1 failed.
                17
1  ----------------------------------------------------------------------
                71
```

```
                    0
1  ----------------------------------------------------------------
                   71
1  -- Trying Rule PL_R_FZ_I_Q_MIN of PLAUSIBILITAETSPRUEFUNG(1) --
                   63

                    0
4     If rs_art is not  'Fiber blends'
                   58
4     then fz_i_q_min  = round (gfh_tex_max  / ffh_tex)
                   52

                    0
1  Unknown parameter(s) in the conclusion:
                   39
1  FFH_TEX of AUTOCORO(1) (Current State:UnProcessed)
                   50
1  ----------------------------------------------------------------
                   71

                    0

                    0
1  ** Determining FFH_TEX of AUTOCORO(1) **
                   40

                    0
1  ----------------------------------------------------------------
                   71
1  -- Trying Rule UMR_FFH_WO_TEX of PLAUSIBILITAETSPRUEFUNG(1) --
                   62

                    0
4     If rs_art = 'Wool (not yet implemented)'
                   58
5      and ffh_wol    <> 0
                   58
4     THEN  ffh_tex =   ffh_wol  / 10
                   34
                    0
1  Premise failed because ...
                   26
1  Clause #1 failed.
                   17
1  ----------------------------------------------------------------
                   71

                    0
1  ----------------------------------------------------------------
                   71
1  -- Trying Rule UMR_FFH_BW_REIFEGR_PM of PLAUSIBILITAETSPRUEFUNG(1) --
                   69

                    0
4     IF (rs_art = 'Cotton'
                   58
8        or mibw_proz >0 )
                   58
5      and rs_bw_verschmutz is known
                   58
5      and ffh_bw is known
                   58
5      and currently reifegr_pm is known
                   58
4     THEN ffh_tex = 0.001 * ( 3.86 * (ffh_bw * ffh_bw) +
                   58
19                   18.16 * ffh_bw + 13) / ( 1.76  -sqroot
                   58
19                   (2.44 - 0.0212 * reifegr_pm))
                   47

                    0
```

```
1  >>>> FFH_TEX
                12
3    assigned = 0.0154761905  (1).
                71

                 5
1  >>>> Resulting value after assignment:
                38
1  0.0154761905  (1)
                17
1  Premise of Rule UMR_FFH_BW_REIFEGR_PM of PLAUSIBILITAETSPRUEFUNG(1)
                68
1  succeeded with certainty (1).
                29
1  ----------------------------------------------------------------------
                71

                 0

                 0
1  ** Processing of FFH_TEX of AUTOCORO(1) completed **
                52

                 0
1  ** Determining FZ_I_Q_MIN of AUTOCORO(1) **
                43

                 0
1  ----------------------------------------------------------------------
                71
1  -- Trying Rule PL_R_FZ_I_Q_MIN of PLAUSIBILITAETSPRUEFUNG(1) --
                63

                 0
4     If rs_art is not  'Fiber blends'
                58
4     then fz_i_q_min  = round (gfh_tex_max  / ffh_tex)
                52

                 0
1  >>>> FZ_I_Q_MIN
                15
3    assigned = 4614  (1).
                71

                 5
1  >>>> Resulting value after assignment:
                38
1  4614  (1)
                 9
1  && Trying monitor rules for FZ_I_Q_MIN of AUTOCORO(1) &&
                56
1  ----------------------------------------------------------------------
                71
1  -- Trying Monitor Rule FASERANZAHL_NICHT_AUSR of
                49
1  PLAUSIBILITAETSPRUEFUNG(1) --
                29

                 0
4     if fz_i_q_min < mfaz
                58
4     then
                58
4     show  'The yarn count cannot be achieved, as the fibers
                58
5      are too coarse, i.e. the minimum number of fibers in
                58
4     the cross-section is too small. :br
                58
4     If you want to go on with the consultation, :br
                58
```

```
4     ENTER key. :br
                58
4     If not, press PF3-key twice to terminate.'
                45

                 0
1  Premise failed because ...
                26
1  Clause #1 failed.
                17
1  ----------------------------------------------------------------
                71

                 0
1  && Completed monitor rules for FZ_I_Q_MIN of AUTOCORO(1) &&
                59
1  Premise of Rule PL_R_FZ_I_Q_MIN of PLAUSIBILITAETSPRUEFUNG(1)
                62
1  succeeded with certainty (1).
                29
1  ----------------------------------------------------------------
                71

                 0

                 0
1  ** Processing of FZ_I_Q_MIN of AUTOCORO(1) completed **
                55

                 0
1  ** Determining FZ_I_Q_MAX of AUTOCORO(1) **
                43

                 0
1  ----------------------------------------------------------------
                71
1  -- Trying Rule FZ_I_Q_MISCH_MAX of PLAUSIBILITAETSPRUEFUNG(1) --
                64

                 0
4     If rs_art = 'Fiber blends'
                58
4     then fz_i_q_max = round (
                58
5      (gfh_tex_min * sy_proz1 * 10)  / (100 * ffh_sy1)
                58
4     +(gfh_tex_min * sy_proz2 * 10)  / (100 * ffh_sy2)
                58
4     +(gfh_tex_min * sy_proz3 * 10)  / (100 * ffh_sy3)
                58
4     +(gfh_tex_min * sy_proz4 * 10)  / (100 * ffh_sy4)
                58
4     +(gfh_tex_min * sy_proz5 * 10)  / (100 * ffh_sy5)
                58
4     +(gfh_tex_min * ch_proz1 * 10)  / (100 * ffh_ch1)
                58
4     +(gfh_tex_min * ch_proz2 * 10)  / (100 * ffh_ch2)
                58
4     +(gfh_tex_min * ch_proz3 * 10)  / (100 * ffh_ch3)
                58
4     +(gfh_tex_min * mibw_proz / (100 * ffh_tex)))
                48

                 0
1  Premise failed because ...
                26
1  Clause #1 failed.
                17
1  ----------------------------------------------------------------
                71

                 0
```

```
1  ----------------------------------------------------------------
                    71
1  -- Trying Rule PL_R_FZ_I_Q_MAX of PLAUSIBILITAETSPRUEFUNG(1) --
                    63

                     0
4     If rs_art is not  'Fiber blends'
                    58
4     then fz_i_q_max  = round (gfh_tex_min  / ffh_tex)
                    52

                     0
1  >>>> FZ_I_Q_MAX
                    15
3    assigned = 4614  (1).
                    71

                     5
1  >>>> Resulting value after assignment:
                    38
1  4614  (1)
                     9
1  Premise of Rule PL_R_FZ_I_Q_MAX of PLAUSIBILITAETSPRUEFUNG(1)
                    62
1  succeeded with certainty (1).
                    29
1  ----------------------------------------------------------------
                    71

                     0

                     0
1  ** Processing of FZ_I_Q_MAX of AUTOCORO(1) completed **
                    55

                     0
1  ----------------------------------------------------------------
                    71
1  ==> Goal parameter resolved:
                    28
1  MISY_PROZ of EINGABE(1) (Current State:UnProcessed)
                    51
3    (No values assigned to the parameter at this time.)
                    53
1  ----------------------------------------------------------------
                    71

                     0
1  ** Determining N_MAX of EINGABE(1) **
                    37

                     0
1  ----------------------------------------------------------------
                    71
1  -- Trying Rule P_R_N_MAX_SYN_EING0 of PLAUSIBILITAETSPRUEFUNG(1) --
                    67

                     0
4     If rs_art ='Fiber blends'
                    58
5      and currently  misy_proz is in interval >= 55 : < 100
                    58
4     then n_max = n_max_syn_eing
                    30

                     0
1  Premise failed because ...
                    26
1  Clause #1 failed.
                    17
1  ----------------------------------------------------------------
                    71
```

```
                    0
1  ----------------------------------------------------------------
                   71
1  -- Trying Rule P_R_N_MAX_SYN_EING of PLAUSIBILITAETSPRUEFUNG(1) --
                   66

                    0
4     IF  rs_art is not 'Fiber blends'
                   58
4     THEN n_max = n_max_syn_eing
                   30

                    0
1  >>>> N_MAX
                   10
3    assigned = 100000  (1).
                   71

                    5
1  >>>> Resulting value after assignment:
                   38
1  100000  (1)
                   11
1  Premise of Rule P_R_N_MAX_SYN_EING of PLAUSIBILITAETSPRUEFUNG(1)
                   65
1  succeeded with certainty (1).
                   29
1  ----------------------------------------------------------------
                   71

                    0

                    0
1  ** Processing of N_MAX of EINGABE(1) completed **
                   49
1  ==> End of Task set for FCB PLAUSIBILITAETSPRUEFUNG(1) TCB DETERMINE
                   68
1  ==> FCB PLAUSIBILITAETSPRUEFUNG(1) queued to pending FCB list
                   61
1  ==> Control given to FCB (PLAUSIBILITAETSPRUEFUNG)
                   50
2   +++ Discover
                   13
1  Quiesce State
                   13
1  Use Rules
                    9
1  ==> Forward Chaining
                   20
1  ----------------------------------------------------------------
                   71

                    0
1  The Premise of Rule P_R_BANDREINHEIT_BW_K_ME of
                   48
1  PLAUSIBILITAETSPRUEFUNG(1) is satisfied.
                   40

                    0
1  IF (rs_art =       'Cotton'
                   55
5      or  (rs_art = 'Fiber blends'
                   58
10          and mibw_proz > 0  ))
                   58
5      and e_p_bw_schmutz_messw = 'no'
                   58
4     THEN summe_dust = 0.0
                   58
5      and r_bw_dust_500 = 0.0
                   58
```

```
5      and r_bw_dust_15  = 0.0
                58
5      and r_bw_dust_50  = 0.0
                58
5      and r_bw_dust_100 = 0.0
                58
5      and r_bw_trash_gem = 0.0
                58
5      and r_bw_trash_gem_sh = 0.0
                31

                 0
1 ---------------------------------------------------------------------
                71
1 -- Firing Rule P_R_BANDREINHEIT_BW_K_ME of PLAUSIBILITAETSPRUEFUNG(1)
                70
1 --
                 2

                 0
4     IF (rs_art =       'Cotton'
                58
5      or  (rs_art = 'Fiber blends'
                58
10          and mibw_proz > 0  ))
                58
5      and e_p_bw_schmutz_messw = 'no'
                58
4     THEN summe_dust = 0.0
                58
5      and r_bw_dust_500 = 0.0
                58
5      and r_bw_dust_15  = 0.0
                58
5      and r_bw_dust_50  = 0.0
                58
5      and r_bw_dust_100 = 0.0
                58
5      and r_bw_trash_gem = 0.0
                58
5      and r_bw_trash_gem_sh = 0.0
                31

                 0
1  >>>> SUMME_DUST
                15
3    assigned = 0  (1).
                71

                 5
1  >>>> Resulting value after assignment:
                38
1  0  (1)
                 6
1 ---------------------------------------------------------------------
                71
1  Evaluating premise references to SUMME_DUST of EINGABE(1).
                58

                 0
1  >>>> R_BW_DUST_500
                18
3    assigned = 0  (1).
                71

                 5
1  >>>> Resulting value after assignment:
                38
1  0  (1)
                 6
1 ---------------------------------------------------------------------
                71
```

```
1  Evaluating premise references to R_BW_DUST_500 of EINGABE(1).
                   61

                    0
1  >>>> R_BW_DUST_15
                   17
3    assigned = 0  (1).
                   71

                    5
1  >>>> Resulting value after assignment:
                   38
1  0  (1)
                    6
1  ----------------------------------------------------------------
                   71
1  Evaluating premise references to R_BW_DUST_15 of EINGABE(1).
                   60

                    0
1  >>>> R_BW_DUST_50
                   17
3    assigned = 0  (1).
                   71

                    5
1  >>>> Resulting value after assignment:
                   38
1  0  (1)
                    6
1  ----------------------------------------------------------------
                   71
1  Evaluating premise references to R_BW_DUST_50 of EINGABE(1).
                   60

                    0
1  >>>> R_BW_DUST_100
                   18
3    assigned = 0  (1).
                   71

                    5
1  >>>> Resulting value after assignment:
                   38
1  0  (1)
                    6
1  ----------------------------------------------------------------
                   71
1  Evaluating premise references to R_BW_DUST_100 of EINGABE(1).
                   61

                    0
1  >>>> R_BW_TRASH_GEM
                   19
3    assigned = 0  (1).
                   71

                    5
1  >>>> Resulting value after assignment:
                   38
1  0  (1)
                    6
1  ----------------------------------------------------------------
                   71
1  Evaluating premise references to R_BW_TRASH_GEM of EINGABE(1).
                   62

                    0
1  >>>> R_BW_TRASH_GEM_SH
                   22
3    assigned = 0  (1).
                   71
```

```
                    5
1  >>>> Resulting value after assignment:
                   38
1  0  (1)
                    6
1  ----------------------------------------------------------------------
                   71
1  Evaluating premise references to R_BW_TRASH_GEM_SH of EINGABE(1).
                   65

                    0
1  Premise of Rule P_R_BANDREINHEIT_BW_K_ME of PLAUSIBILITAETSPRUEFUNG(1)
                   71
1  succeeded with certainty (1).
                   29
1  ----------------------------------------------------------------------
                   71

                    0
1  ==> End of Task set for FCB PLAUSIBILITAETSPRUEFUNG(1) TCB DISCOVER
                   67
1  ==> FCB PLAUSIBILITAETSPRUEFUNG(1) queued to pending FCB list
                   61
1  ==> Control given to FCB (PLAUSIBILITAETSPRUEFUNG)
                   50
1  ==> End of focus set for FCB PLAUSIBILITAETSPRUEFUNG(1)
                   55
1  ==> Maximum Instances reached for FCB PLAUSIBILITAETSPRUEFUNG
                   61
1  ==> FCB PLAUSIBILITAETSPRUEFUNG(1) queued to pending FCB list
                   61
1  ==> Control given to FCB (PLAUSIBILITAETSPRUEFUNG)
                   50
1  ==> FCB PLAUSIBILITAETSPRUEFUNG(1) complete
                   43
1  ==> FCB EINGABE(1) queued to pending FCB list
                   45
1  ==> Control given to FCB (EINGABE)
                   34
2   +++ Establish Focuses +++
                   26
5      value of VORLAGEBAND (1)
                   28
1  --Focus On
                   10
1  --Ignore
                    8
1  ==> End of Task set for FCB EINGABE(1) TCB ESTABLISH
                   52
1  ==> FCB EINGABE(1) queued to pending FCB list
                   45
1  ==> Control given to FCB (EINGABE)
                   34
2   +++ Establish Focuses +++
                   26
5      value of SPINNMITTEL (1)
                   28
1  --Focus On
                   10
1  --Ignore
                    8
1  ==> End of Task set for FCB EINGABE(1) TCB ESTABLISH
                   52
1  ==> FCB SPINNMITTEL(1) queued to pending FCB list
                   49
1  ==> Reply to initial instance query for FCB SPINNMITTEL is YES.
                   63
1  ==> Control blocks built
                   24
1  ==> Control given to FCB (SPINNMITTEL)
                   38
```

```
2   +++ Display Values +++
                    23
5      value of D_Z (  1)(1)
                    25
1  --Focus On
                    10
1  --Ignore
                     8
1  ==> Display Results
                    19
7        value of D_Z (  1)(1)
                    27
1  ==> Screen: BS_SPINNMITTEL
                    26
1  ==> End of Task set for FCB SPINNMITTEL(1) TCB DISPLAY
                    54
1  ==> FCB SPINNMITTEL(1) queued to pending FCB list
                    49
1  ==> Control given to FCB (SPINNMITTEL)
                    38
2   +++ Determine Values
                    21
5      value of AZD (  1)(1)
                    25
5      value of ALW (  1)(1)
                    25
1  --Focus On
                    10
1  --Ignore
                     8
1  --Dont Ask
                    10
5      value of GCH_BBA (  1)(1)
                    29
5      value of GCH_R (  1)(1)
                    27
5      value of GCH_VOL (  1)(1)
                    29
5      value of GCH_H (  1)(1)
                    27
5      value of GCH_K (  1)(1)
                    27
5      value of GCH_KRI (  1)(1)
                    29
5      value of GCH_P (  1)(1)
                    27
5      value of GCH_WG (  1)(1)
                    28
5      value of GCH_GL (  1)(1)
                    28
5      value of GCH_GOE (  1)(1)
                    29
5      value of GFK_G_M_H (  1)(1)
                    31
5      value of GCH_D (  1)(1)
                    27
5      value of WARENBILD (  1)(1)
                    31
5      value of MARKENART (  1)(1)
                    31
5      value of RS_ART_SY (  1)(1)
                    31
5      value of FFH_SY_EING (  1)(1)
                    33
1  --Dont Acquire
                    14
1  --Dont Infer
                    12
5      value of GCH_BBA (  1)(1)
                    29
5      value of GCH_R (  1)(1)
                    27
```

```
5      value of GCH_VOL (  1)(1)
                29
5      value of GCH_H (  1)(1)
                27
5      value of GCH_K (  1)(1)
                27
5      value of GCH_KRI (  1)(1)
                29
5      value of GCH_P (  1)(1)
                27
5      value of GCH_WG (  1)(1)
                28
5      value of GCH_GL (  1)(1)
                28
5      value of GCH_GOE (  1)(1)
                29
5      value of GFK_G_M_H (  1)(1)
                31
5      value of GCH_D (  1)(1)
                27
5      value of WARENBILD (  1)(1)
                31
5      value of MARKENART (  1)(1)
                31
5      value of ROT_F (  1)(1)
                27
5      value of ROT_D (  1)(1)
                27
5      value of ROT_B (  1)(1)
                27
5      value of ROT_TS (  1)(1)
                28
5      value of ROT_N_MAX (  1)(1)
                31
5      value of ROT_N_MIN (  1)(1)
                31
5      value of EP_ROT_GFH_MAX_Q (  1)(1)
                38
5      value of EP_ROT_GFH_MIN_Q (  1)(1)
                38
5      value of EP_ROT_GFH_MAX_S (  1)(1)
                38
5      value of EP_ROT_GFH_MIN_S (  1)(1)
                38
1  --Use Rules
                11
1  ==> Backward Chaining for
                25
7        value of AZD (  1)(1)
                27
7        value of ALW (  1)(1)
                27

                 0
1  ** Determining AZD of AUTOCORO(1) **
                36

                 0
1  ----------------------------------------------------------------
                71
1  -- Trying Rule AZD_KN of SPINNMITTEL(1) --
                42

                 0
4      IF  (rs_art_sy  is not 'Polyester'
                58
9          or  not there is  rs_art_sy)
                58
4      and  (rs_art_misy  is not 'Polyester'
                58
8          or  not there is  rs_art_misy)
                58
```

```
4     and (gch_kri    = 'High'     or not there is gch_kri
                 58
9          or gch_bba = 'Very low'                        )
                 58
4     and (gch_d is not 'Low'  or not there is gch_d  )
                 58
4     and (gch_k is not 'Low'  or not there is gch_k)
                 58
4     and (gch_r      = 'Moderately good'
                 58
5      or  gch_r      = 'no'     or not there is gch_r)
                 58
4     and (gch_vol = 'Moderate'  or not there is gch_vol)
                 58
4     then
                 58
4     azd     = 'KN'
                 17

                  0
1  Premise failed because ...
                 26
1  Clause #3 failed.
                 17
1  Clause #4 failed.
                 17
1  Clause #5 failed.
                 17
1  ----------------------------------------------------------------
                 71

                  0
1  ----------------------------------------------------------------
                 71
1  -- Trying Rule AZD_KN3 of SPINNMITTEL(1) --
                 43

                  0
4     IF  (rs_art_sy is not 'Polyester'
                 58
13             or not there is  rs_art_sy )
                 58
4     and (rs_art_misy is not 'Polyester'
                 58
13             or not there is  rs_art_misy)
                 58
4     and (gch_bba is not 'Very low' or not there is gch_bba)
                 58
4     and (gch_kri    = 'High'        or not there is gch_kri)
                 58
4     and (gch_d  is not 'Low'   or not there is gch_d)
                 58
4     and (gch_r = 'Moderately good'
                 58
5      or  gch_r = 'Moderately good' or not there is gch_r)
                 58
4     and (gch_vol  is not 'Great' or not there is gch_vol)
                 58
4     and (gch_wg     = 'no'        or not there is gch_wg)
                 58
4     and (gch_k   is not 'Very good' or not there is gch_k)
                 58
4     then
                 58
4     azd     = 'KN 3'
                 19

                  0
1  Premise failed because ...
                 26
1  Clause #3 failed.
                 17
```

```
1  Clause #6 failed.
                    17
1  ----------------------------------------------------------------
                    71

                     0
1  ----------------------------------------------------------------
                    71
1  -- Trying Rule AZD_KN4 of SPINNMITTEL(1) --
                    43

                     0
4     if  (gch_bba is not 'Very low' or not there is gch_bba)
                    58
4     and (gch_gl  is not 'Very good' or not there is gch_gl)
                    58
4     and (gch_goe is not 'gut'   or not there is gch_goe )
                    58
4     and (gch_r   is not 'Very good' or not there is gch_r)
                    58
4     and  (gch_wg  = 'yes'  and gch_d = 'Low'
                    58
10          or not there is gch_wg )
                    58
4     and (gch_k   is not 'Very good' or not there is gch_k)
                    58
4     or esz = 'Weaving'
                    58
4     and (art_w = 'Corduroy'
                    58
4     and a_d_hfp_cord   = 'Pile filling'
                    58
5      or art_w = 'Velours'
                    58
4     and (a_d_hfp_velour = 'Pile filling'
                    58
5      or a_d_hfp_velour = 'Pile warp'))
                    58
5      or rs_art_sy is known and rs_art_sy = 'Polyester'
                    58
4     or  rs_art_misy is known and rs_art_misy = 'Polyester'
                    58
4     then
                    58
4     azd     = 'KN 4'
                    19

                     0
1  Unknown parameter(s) in the premise:
                    36
1  GCH_GOE of AUTOCORO(1) (Current State:UnProcessed)
                    50
1  GCH_R of AUTOCORO(1) (Current State:UnProcessed)
                    48
1  GCH_WG of AUTOCORO(1) (Current State:UnProcessed)
                    49
1  GCH_K of AUTOCORO(1) (Current State:UnProcessed)
                    48
1  RS_ART_SY of AUTOCORO(1) (Current State:UnProcessed)
                    52
1  ----------------------------------------------------------------
                    71

                     0

                     0
1  ** Determining GCH_GOE of AUTOCORO(1) **
                    40

                     0
1  -- No default constraint
                    24
```

```
                    0
1  ** Processing of GCH_GOE of AUTOCORO(1) completed **
                   52

                    0
1  ** Determining AZD of AUTOCORO(1) **
                   36

                    0
1  ----------------------------------------------------------------
                   71
1  -- Trying Rule AZD_KN4 of SPINNMITTEL(1) --
                   43

                    0
4     if  (gch_bba is not 'Very low' or not there is gch_bba)
                   58
4     and (gch_gl  is not 'Very good' or not there is gch_gl)
                   58
4     and (gch_goe is not 'gut'   or not there is gch_goe )
                   58
4     and (gch_r   is not 'Very good' or not there is gch_r)
                   58
4     and  (gch_wg  = 'yes'  and gch_d = 'Low'
                   58
10       .   or not there is gch_wg )
                   58
4     and (gch_k   is not 'Very good' or not there is gch_k)
                   58
4     or esz = 'Weaving'
                   58
4     and (art_w = 'Corduroy'
                   58
4     and a_d_hfp_cord   = 'Pile filling'
                   58
5      or art_w = 'Velours'
                   58
4     and (a_d_hfp_velour = 'Pile filling'
                   58
5      or a_d_hfp_velour = 'Pile warp'))
                   58
5      or rs_art_sy is known and rs_art_sy = 'Polyester'
                   58
4     or  rs_art_misy is known and rs_art_misy = 'Polyester'
                   58
4     then
                   58
4     azd     = 'KN 4'
                   19

                    0
1  Unknown parameter(s) in the premise:
                   36
1  GCH_R of AUTOCORO(1) (Current State:UnProcessed)
                   48
1  GCH_WG of AUTOCORO(1) (Current State:UnProcessed)
                   49
1  GCH_K of AUTOCORO(1) (Current State:UnProcessed)
                   48
1  RS_ART_SY of AUTOCORO(1) (Current State:UnProcessed)
                   52
1  ----------------------------------------------------------------
                   71

                    0

                    0
1  ** Determining GCH_R of AUTOCORO(1) **
                   38

                    0
```

```
1  -- No default constraint
                24

                 0
1  ** Processing of GCH_R of AUTOCORO(1) completed **
                50

                 0
1  ** Determining AZD of AUTOCORO(1) **
                36

                 0
1  ----------------------------------------------------------------------
                71
1  -- Trying Rule AZD_KN4 of SPINNMITTEL(1) --
                43

                 0
4     if  (gch_bba is not 'Very low' or not there is gch_bba)
                58
4     and (gch_gl  is not 'Very good' or not there is gch_gl)
                58
4     and (gch_goe is not 'gut'   or not there is gch_goe )
                58
4     and (gch_r   is not 'Very good' or not there is gch_r)
                58
4     and  (gch_wg  = 'yes'  and gch_d = 'Low'
                58
10          or not there is gch_wg )
                58
4     and (gch_k   is not 'Very good' or not there is gch_k)
                58
4     or esz = 'Weaving'
                58
4     and (art_w = 'Corduroy'
                58
4     and a_d_hfp_cord   = 'Pile filling'
                58
5      or art_w = 'Velours'
                58
4     and (a_d_hfp_velour = 'Pile filling'
                58
5      or a_d_hfp_velour = 'Pile warp'))
                58
5      or rs_art_sy is known and rs_art_sy = 'Polyester'
                58
4     or  rs_art_misy is known and rs_art_misy = 'Polyester'
                58
4     then
                58
4     azd     = 'KN 4'
                19

                 0
1  Unknown parameter(s) in the premise:
                36
1  GCH_WG of AUTOCORO(1) (Current State:UnProcessed)
                49
1  GCH_K of AUTOCORO(1) (Current State:UnProcessed)
                48
1  RS_ART_SY of AUTOCORO(1) (Current State:UnProcessed)
                52
1  ----------------------------------------------------------------------
                71

                 0

                 0
1  ** Determining GCH_WG of AUTOCORO(1) **
                39

                 0
```

```
1  -- No default constraint
                24

                 0
1  ** Processing of GCH_WG of AUTOCORO(1) completed **
                51

                 0
1  ** Determining AZD of AUTOCORO(1) **
                36

                 0
1  ----------------------------------------------------------------------
                71
1  -- Trying Rule AZD_KN4 of SPINNMITTEL(1) --
                43

                 0
4     if  (gch_bba is not 'Very low' or not there is gch_bba)
                58
4     and (gch_gl  is not 'Very good' or not there is gch_gl)
                58
4     and (gch_goe is not 'gut'   or not there is gch_goe )
                58
4     and (gch_r   is not 'Very good' or not there is gch_r)
                58
4     and  (gch_wg  = 'yes'  and gch_d = 'Low'
                58
10          or not there is gch_wg )
                58
4     and (gch_k   is not 'Very good' or not there is gch_k)
                58
4     or esz = 'Weaving'
                58
4     and (art_w = 'Corduroy'
                58
4     and a_d_hfp_cord   = 'Pile filling'
                58
5      or art_w = 'Velours'
                58
4     and (a_d_hfp_velour = 'Pile filling'
                58
5      or a_d_hfp_velour = 'Pile warp'))
                58
5      or rs_art_sy is known and rs_art_sy = 'Polyester'
                58
4     or  rs_art_misy is known and rs_art_misy = 'Polyester'
                58
4     then
                58
4     azd     = 'KN 4'
                19

                 0
1  Unknown parameter(s) in the premise:
                36
1  GCH_K of AUTOCORO(1) (Current State:UnProcessed)
                48
1  RS_ART_SY of AUTOCORO(1) (Current State:UnProcessed)
                52
1  ----------------------------------------------------------------------
                71

                 0

                 0
1  ** Determining GCH_K of AUTOCORO(1) **
                38

                 0
1  -- No default constraint
                24
```

```
                    0
1  ** Processing of GCH_K of AUTOCORO(1) completed **
                   50

                    0
1  ** Determining AZD of AUTOCORO(1) **
                   36

                    0
1  ----------------------------------------------------------------------
                   71
1  -- Trying Rule AZD_KN4 of SPINNMITTEL(1) --
                   43

                    0
4     if  (gch_bba is not 'Very low' or not there is gch_bba)
                   58
4     and (gch_gl  is not 'Very good' or not there is gch_gl)
                   58
4     and (gch_goe is not 'gut'   or not there is gch_goe )
                   58
4     and (gch_r   is not 'Very good' or not there is gch_r)
                   58
4     and  (gch_wg  = 'yes'  and gch_d = 'Low'
                   58
10          or not there is gch_wg )
                   58
4     and (gch_k   is not 'Very good' or not there is gch_k)
                   58
4     or esz = 'Weaving'
                   58
4     and (art_w = 'Corduroy'
                   58
4     and a_d_hfp_cord   = 'Pile filling'
                   58
5      or art_w = 'Velours'
                   58
4     and (a_d_hfp_velour = 'Pile filling'
                   58
5      or a_d_hfp_velour = 'Pile warp'))
                   58
5      or rs_art_sy is known and rs_art_sy = 'Polyester'
                   58
4     or  rs_art_misy is known and rs_art_misy = 'Polyester'
                   58
4     then
                   58
4     azd     = 'KN 4'
                   19

                    0
1  >>>> AZD
                    8
3    assigned = 'KN 4' (1).
                   71

                    5
1  >>>> Resulting value after assignment:
                   38
1  'KN 4' (1)
                   10
1  Premise of Rule AZD_KN4 of SPINNMITTEL(1) succeeded with certainty (1).
                   71
1  ----------------------------------------------------------------------
                   71

                    0
1  ----------------------------------------------------------------------
                   71
1  -- Trying Rule AZD_KN8 of SPINNMITTEL(1) --
                   43
```

```
                    0
 4     IF  currently rs_art_ch = 'Viscose'
                   58
 4     OR (rs_art_sy is not 'Polyester' or not there is
                   58
34                                    rs_art_sy)
                   58
 4     and (rs_art_misy is not 'Polyester'
                   58
15                or not there is rs_art_misy)
                   58
 4     and (gch_bba is not 'Very low' or not there is gch_bba)
                   58
 4     and (gch_gl  is not 'Very good' or not there is gch_gl)
                   58
 4     and (gch_goe is not 'gut'      or gch_goe is not known)
                   58
 4     and (gch_r   is not 'Very good' or not there is gch_r)
                   58
 4     and (gch_wg  = 'yes'            or not there is gch_wg)
                   58
 4     and (gch_k   is not 'Very good' or not there is gch_k)
                   58
 4     then
                   58
 4     azd     = 'KN 8'
                   19

                    0
 1  Unknown parameter(s) in the premise:
                   36
 1  RS_ART_SY of AUTOCORO(1) (Current State:UnProcessed)
                   52
 1  ----------------------------------------------------------------------
                   71

                    0

                    0
 1  ** Determining RS_ART_SY of AUTOCORO(1) **
                   42

                    0
 1  -- No default constraint
                   24

                    0
 1  ** Processing of RS_ART_SY of AUTOCORO(1) completed **
                   54

                    0
 1  ** Determining AZD of AUTOCORO(1) **
                   36

                    0
 1  ----------------------------------------------------------------------
                   71
 1  -- Trying Rule AZD_KN8 of SPINNMITTEL(1) --
                   43

                    0
 4     IF  currently rs_art_ch = 'Viscose'
                   58
 4     OR (rs_art_sy is not 'Polyester' or not there is
                   58
34                                    rs_art_sy)
                   58
 4     and (rs_art_misy is not 'Polyester'
                   58
15                or not there is rs_art_misy)
                   58
```

```
4     and (gch_bba is not 'Very low' or not there is gch_bba)
                58
4     and (gch_gl  is not 'Very good' or not there is gch_gl)
                58
4     and (gch_goe is not 'gut'      or gch_goe is not known)
                58
4     and (gch_r   is not 'Very good' or not there is gch_r)
                58
4     and (gch_wg  = 'yes'            or not there is gch_wg)
                58
4     and (gch_k   is not 'Very good' or not there is gch_k)
                58
4     then
                58
4     azd     = 'KN 8'
                19

                 0
1  >>>> AZD
                 8
3    assigned = 'KN 8' (1).
                 71

                 5
1  >>>> Resulting value after assignment:
                38
1  'KN 4' (1)
                10
1  'KN 8' (1)
                10
1  Premise of Rule AZD_KN8 of SPINNMITTEL(1) succeeded with certainty (1).
                71
1  ----------------------------------------------------------------------
                71

                 0
1  ----------------------------------------------------------------------
                71
1  -- Trying Rule AZD_KN8R of SPINNMITTEL(1) --
                44

                 0
4     If ((rs_art_sy   is not 'Polyester'
                58
10          or  not there is   rs_art_sy)
                58
4     and (rs_art_misy   is not 'Polyester'
                58
15              or not there is   rs_art_misy )
                58
4     and ((gch_bba = 'acceptable' or not there is gch_bba)
                58
4     and (gch_kri     = 'Low'   or not there is gch_kri)
                58
4     and (gch_gl is not 'Very good' or not there is gch_gl)
                58
4     and (gch_d       = 'Low'  or not there is gch_d)
                58
4     and (gch_goe     = 'no'     or not there is gch_goe)
                58
4     and (gch_wg      = 'yes'       or not there is gch_wg)
                58
4     and (gch_k       = 'Low'   or not there is gch_k)
                58
4     or esz = 'Knitting'
                58
4     or  ffh_max_sy_ch is known
                58
4     and ffh_max_sy_ch >= 2.2
                58
4     and (art_w is not 'Velours' or art_w is not known)))
                58
```

```
4     then
                58
4     azd     = 'KN 6-R'
                21

                 0
1  Premise failed because ...
                26
1  Clause #1 failed.
                17
1  Clause #2 failed.
                17
1  Clause #9 failed.
                17
1  Clause #16 failed.
                18
1  Clause #18 failed.
                18
1  ----------------------------------------------------------------
                71

                 0
1  ----------------------------------------------------------------
                71
1  -- Trying Rule AZD_KNR4 of SPINNMITTEL(1) --
                44

                 0
4     IF ((rs_art_sy   is not 'Polyester'
                58
9          or  not there is  rs_art_sy )
                58
9          and (rs_art_misy   is not 'Polyester'
                58
13             and not there is  rs_art_misy )
                58
4     and ((gch_bba = 'acceptable' or not there is gch_bba)
                58
4     and (gch_kri     = 'Low'   or not there is gch_kri)
                58
4     and (gch_gl = 'Moderately good' or not there is gch_gl)
                58
4     and (gch_goe     = 'no'     or not there is gch_goe)
                58
4     and (gch_r  is not 'Very good' or not there is gch_r)
                58
4     and (gch_wg      = 'yes'       or not there is gch_wg)
                58
4     and (gch_k       = 'Low'   or not there is gch_k)
                58
4     and (gch_h       = 'High'     or not there is gch_h)
                58
4     or  (art_w = 'Terry towel'
                58
9          and a_d_hfp_frot = 'Pile warp')
                58
4     or gch_h = 'High' ))
                58
4     then
                58
4     azd     = 'KN /R 4'
                22

                 0
1  Premise failed because ...
                26
1  Clause #1 failed.
                17
1  Clause #2 failed.
                17
1  ----------------------------------------------------------------
                71
```

```
                    0
1  ------------------------------------------------------------------
                   71
1  -- Trying Rule AZD_KN4R4 of SPINNMITTEL(1) --
                   45

                    0
4     IF ((rs_art_sy   is not 'Polyester'
                   58
10          or  not there is  rs_art_sy)
                   58
4     and (rs_art_misy   is not 'Polyester'
                   58
15              or not there is  rs_art_misy)
                   58
4     and ((gch_bba = 'acceptable'  or not there is gch_bba)
                   58
4     and (gch_kri     = 'Low'   or not there is gch_kri)
                   58
4     and (gch_gl = 'Moderately good' or not there is gch_gl)
                   58
4     and (gch_goe     = 'no'     or not there is gch_goe)
                   58
4     and (gch_r  is not 'Very good' or not there is gch_r)
                   58
4     and (gch_wg      = 'yes'       or not there is gch_wg)
                   58
4     and (gch_k       = 'Low'   or not there is gch_k)
                   58
4     and (gch_h       = 'High'     or not there is gch_h)
                   58
4     or  (art_w = 'Terry towel'
                   58
9          and a_d_hfp_frot = 'Pile warp')
                   58
4     or gch_h = 'High' ))
                   58
4     then
                   58
4     azd     = 'KN 4/R 4'
                   23

                    0
1  >>>> AZD
                    8
3    assigned = 'KN 4/R 4' (1).
                   71

                    5
1  >>>> Resulting value after assignment:
                   38
1  'KN 4' (1)
                   10
1  'KN 8' (1)
                   10
1  'KN 4/R 4' (1)
                   14
1  Premise of Rule AZD_KN4R4 of SPINNMITTEL(1) succeeded with certainty
                   69
1  (1).
                    4
1  ------------------------------------------------------------------
                   71

                    0

                    0
1  ** Processing of AZD of AUTOCORO(1) completed **
                   48

                    0
1  ** Determining ALW of AUTOCORO(1) **
                   36
```

```
                    0
1  ------------------------------------------------------------------
                   71
1  -- Trying Rule S_R_ALW_BW_H_V of SPINNMITTEL(1) --
                   50

                    0
4     if   rs_art    = 'Cotton'
                   58
4     and  verschleiss = 'Service life'
                   58
4     and  ( gfh_nm_max >= 40
                   58
5      or    rdv_trashf <= 40
                   58
5      or    sl_bw_fuenfzig >= 13 )
                   58
4     then alw = 'B 20 DN'
                   23

                    0
1  Unknown parameter(s) in the premise:
                   36
1  VERSCHLEISS of EINGABE(1) (Current State:UnProcessed, Constraint
                   65
1  Incomplete)
                   11
1  ------------------------------------------------------------------
                   71

                    0

                    0
1  ** Determining VERSCHLEISS of EINGABE(1) **
                   43

                    0
1  -- Trying to resolve constraint
                   31

                    0
4     is taken from (moegl_qualitaet)
                   34

                    0
1  Incomplete references in the constraint:
                   40
1  MOEGL_QUALITAET of EINGABE (1)
                   30

                    0
1  ** Determining MOEGL_QUALITAET of EINGABE(1) **
                   47

                    0
1  >>>> MOEGL_QUALITAET
                   20
3    assigned =
                   71
6       'Service life' (1).
                   71
6       'Quality' (1).
                   71

                    5
1  >>>> Resulting value after assignment:
                   38
1  'Service life' (1)
                   18
1  'Quality' (1)
                   13
```

```
1  -- Trying to resolve Default Constraint
                39

                 0
4     = ('Service life',
                58
7        'Quality')
                16

                 0
1  Default Constraint resolution successful
                40
1  -- Default constraint applied
                29
1  ----------------------------------------------------------------
                71
1  -- Trying Rule AUFM_FROTTIER_GKETTE of EINGABE(1) --
                52

                 0
4     if art_w        = 'Terry towel'
                58
4     and (a_d_hfp_frot  = 'Ground warp'
                58
4     or   a_d_hfp_frot= 'Ground filling')
                58
4     then
                58
4     gch_bba         = 'acceptable'            ,
                58
4     gfk_g_m_h       = 'High'              ,
                58
4     gch_d           = 'Medium'            ,
                58
4     moegl_qualitaet = ('Service life','Quality') ,
                58
4     moegl_qual_text =
                58
4     (':pp SERVICE LIFE - high durability, probably
                58
4     :br:tb5 not so high quality
                58
4     :pp QUALITY - high quality at maximum speed')
                48

                 0
1  Premise failed because ...
                26
1  Clause #1 failed.
                17
1  ----------------------------------------------------------------
                71

                 0
1  ----------------------------------------------------------------
                71
1  -- Trying Rule AUFM_VELOUR_GKET_GSCHUSS of EINGABE(1) --
                56

                 0
4     if art_w        = 'Velours'
                58
4     and
                58
4     (a_d_hfp_velour  = 'Ground warp'
                58
4     or a_d_hfp_velour  = 'Ground filling')
                58
4     then
                58
4     gch_bba         = 'acceptable'            ,
                58
```

```
4     gfk_g_m_h       = 'High'              ,
                 58
4     gch_d           = 'Medium',
                 58
4     moegl_qualitaet =('Service life','Quality') ,
                 58
4     moegl_qual_text =
                 58
4     (':pp SERVICE LIFE - high durability, probably
                 58
4     :br:tb5 not so high quality
                 58
4     :pp QUALITY - high quality at maximum speed')
                 48

                  0
1  Premise failed because ...
                 26
1  Clause #1 failed.
                 17
1  ----------------------------------------------------------------
                 71

                  0
1  ----------------------------------------------------------------
                 71
1  -- Trying Rule AUFM_ART_MASCH_FLACHSTR of EINGABE(1) --
                 55

                  0
4     IF art_maschenw  = 'Ladies outer wear - sports wear'
                 58
4     or art_maschenw  = 'Flat knits'
                 58
4     or art_maschenw  = 'Warp knitting (ground)'
                 58
4     or art_maschenw  = 'Hand knitting yarn'
                 58
4     or art_maschenw  = 'Circular knits, smooth'
                 58
4     then
                 58
4     gch_vol       =  'Great'              ,
                 58
4     gch_wg        =  'yes'                ,
                 58
4     gch_d         =  'Low'            ,
                 58
4     gch_k         =  'Low'            ,
                 58
4     moegl_qualitaet = ('Service life','Quality',
                 58
29                              'Extraquality') ,
                 58
4     moegl_qual_text =
                 58
4     (':pp SERVICE LIFE - high durability, probably
                 58
4     :br:tb5 not so high quality
                 58
4     :pp QUALITY - high quality at maximum speed
                 58
4     :pp EXTRAQUALITY - highest quality, probably at
                 58
4     :br:tb5 lower speed.')
                 25

                  0
1  Premise failed because ...
                 26
1  Clause #1 failed.
                 17
```

```
1  Clause #2 failed.
                17
1  Clause #3 failed.
                17
1  Clause #4 failed.
                17
1  Clause #5 failed.
                17
1  ----------------------------------------------------------------
                71

                 0
1  ----------------------------------------------------------------
                71
1  -- Trying Rule AUFM_DEKO_MOEBELST of EINGABE(1) --
                50

                 0
4     IF art_w       = 'Furnishing, upholstery fabrics'
                58
4     then
                58
4     gch_bba        = 'acceptable'              ,
                58
4     gfk_g_m_h      = 'High'              ,
                58
4     gch_d          = 'Medium'            ,
                58
4     moegl_qualitaet = ('Service life','Quality') ,
                58
4     moegl_qual_text =
                58
4     (':pp SERVICE LIFE - high durability, probably
                58
4     :br:tb5 not so high quality
                58
4     :pp QUALITY - high quality at maximum speed')
                48

                 0
1  Premise failed because ...
                26
1  Clause #1 failed.
                17
1  ----------------------------------------------------------------
                71

                 0
1  ----------------------------------------------------------------
                71
1  -- Trying Rule AUFM_RAUHGEWEBE_STA of EINGABE(1) --
                51

                 0
4     If (art_w = 'Napped fabrics'
                58
4     or art_w = 'Shirtings casual wear, blouses (flanelle)')
                58
4     then
                58
4     gch_bba       =  'acceptable'                ,
                58
4     gch_gl        =  'Good'                ,
                58
4     gch_r         =  'Good'                ,
                58
4     gch_vol       =  'Great'               ,
                58
4     gch_wg        =  'yes'                 ,
                58
4     gch_d         =  'Low'              ,
                58
```

```
4     moegl_qualitaet = ('Service life','Quality') ,
                    58
4     moegl_qual_text =
                    58
4     (':pp SERVICE LIFE - high durability, probably
                    58
4     :br:tb5 not so high quality
                    58
4     :pp QUALITY - high quality at maximum speed')
                    48

                     0
1  Premise failed because ...
                    26
1  Clause #1 failed.
                    17
1  Clause #2 failed.
                    17
1  ----------------------------------------------------------------
                    71

                     0
1  ----------------------------------------------------------------
                    71
1  -- Trying Rule AUFM_CORD_GKETTE_GSCHUSS of EINGABE(1) --
                    56

                     0
4     if art_w        = 'Corduroy'
                    58
4     and (a_d_hfp_cord   = 'Ground warp'
                    58
5      or a_d_hfp_cord   = 'Ground filling')
                    58
4     then
                    58
4     gch_bba         = 'acceptable'            ,
                    58
4     gfk_g_m_h       = 'High'                  ,
                    58
4     gch_d           = 'Medium'                ,
                    58
4     moegl_qualitaet = ('Service life','Quality') ,
                    58
4     moegl_qual_text =
                    58
4     ('SERVICE LIFE - high durability, probably
                    58
4     :br:tb5 not so high quality
                    58
4     :pp QUALITY - high quality at maximum speed')
                    48

                     0
1  Premise failed because ...
                    26
1  Clause #1 failed.
                    17
1  ----------------------------------------------------------------
                    71

                     0
1  ----------------------------------------------------------------
                    71
1  -- Trying Rule AUFM_ELAST_BINDEN_KREPP of EINGABE(1) --
                    55

                     0
4     if  art_w       = 'Elastic gauze'
                    58
4     or  art_w       = 'Crepe'
                    58
```

```
4     then
                    58
4     gch_bba          = 'acceptable'              ,
                    58
4     gch_kri          = 'High'                ,
                    58
4     gfk_g_m_h        = 'High'                ,
                    58
4     gch_d            = 'High'                ,
                    58
4     moegl_qualitaet = ('Service life','Quality') ,
                    58
4     moegl_qual_text =
                    58
4     (':pp SERVICE LIFE - high durability, probably
                    58
4     :br:tb5 not so high quality
                    58
4     :pp QUALITY - high quality at maximum speed')
                    48

                     0
1  Premise failed because ...
                    26
1  Clause #1 failed.
                    17
1  Clause #2 failed.
                    17
1  ----------------------------------------------------------------
                    71

                     0
1  ----------------------------------------------------------------
                    71
1  -- Trying Rule AUFM_VELOUR_POLGARN of EINGABE(1) --
                    51

                     0
4     if art_w         = 'Velours'
                    58
4     and
                    58
4     (a_d_hfp_velour = 'Pile warp'
                    58
4     or
                    58
4     a_d_hfp_velour = 'Pile filling' )
                    58
4     then
                    58
4     gch_bba          = 'Very low'        ,
                    58
4     gch_kri          = 'Low'         ,
                    58
4     gch_gl           = 'Good'            ,
                    58
4     gfk_g_m_h        = 'Medium'          ,
                    58
4     gch_goe          = 'gut'             ,
                    58
4     gch_d            = 'Low'         ,
                    58
4     moegl_qualitaet = ('Service life','Quality') ,
                    58
4     moegl_qual_text =
                    58
4     (':pp SERVICE LIFE - high durability, probably
                    58
4     :br:tb5 not so high quality
                    58
4     :pp QUALITY - high quality at maximum speed')
                    48
```

```
                    0
1  Premise failed because ...
                   26
1  Clause #1 failed.
                   17
1  ------------------------------------------------------------------
                   71

                    0
1  ------------------------------------------------------------------
                   71
1  -- Trying Rule AUFM_FLACHGEWEBE_STAND of EINGABE(1) --
                   54

                    0
4     if art_w =
                   58
7        'Sales yarn,standard fabrics,raw fabrics,mull'
                   58
4     or art_w       = 'Bed linen, smooth'
                   58
4     or art_w       = 'Linings'
                   58
4     or art_w       = 'Surgical dressing'
                   58
4     then
                   58
4     gch_bba        = 'acceptable'              ,
                   58
4     gfk_g_m_h      = 'High'                    ,
                   58
4     gch_d          = 'Medium',
                   58
4     moegl_qualitaet = ('Service life','Quality') ,
                   58
4     moegl_qual_text =
                   58
4     (':pp SERVICE LIFE - high durability, probably
                   58
4     :br:tb5 not so high quality
                   58
4     :pp QUALITY - high quality at maximum speed')
                   48

                    0
1  Premise failed because ...
                   26
1  Clause #1 failed.
                   17
1  Clause #2 failed.
                   17
1  Clause #3 failed.
                   17
1  Clause #4 failed.
                   17
1  ------------------------------------------------------------------
                   71

                    0
1  ------------------------------------------------------------------
                   71
1  -- Trying Rule AUFM_ZWIRN of EINGABE(1) --
                   42

                    0
4     if art_w     = 'Plied yarn'
                   58
4     then
                   58
4     gch_gl       =  'Good'          ,
                   58
```

```
4     gfk_g_m_h     =  'Medium'       ,
                   58
4     gch_vol       =  'Medium'       ,
                   58
4     gch_wg        =  'yes'          ,
                   58
4     gch_d         =  'Low'      ,
                   58
4     gch_k         =  'Low'          ,
                   58
4     moegl_qualitaet = ('Service life','Quality') ,
                   58
4     moegl_qual_text =
                   58
4     (':pp SERVICE LIFE - high durability, probably
                   58
4     :br:tb5 not so high quality
                   58
4     :pp QUALITY - high quality at maximum speed')
                   48

                    0
1  Premise failed because ...
                   26
1  Clause #1 failed.
                   17
1  ----------------------------------------------------------------
                   71

                    0
1  ----------------------------------------------------------------
                   71
1  -- Trying Rule AUFM_BERUFKLEIDUNG of EINGABE(1) --
                   50

                    0
4     if art_w        = 'Industrial yarns'
                   58
4     or art_w        = 'Working apparel'
                   58
4     then
                   58
4     gch_bba         = 'acceptable'            ,
                   58
4     gfk_g_m_h       = 'Very high'             ,
                   58
4     gch_d           = 'High'    ,
                   58
4     moegl_qualitaet = ('Service life','Quality') ,
                   58
4     moegl_qual_text =
                   58
4     (':pp SERVICE LIFE - high durability, probably
                   58
4     :br:tb5 not so high quality
                   58
4     :pp QUALITY - high quality at maximum speed')
                   48

                    0
1  Premise failed because ...
                   26
1  Clause #1 failed.
                   17
1  Clause #2 failed.
                   17
1  ----------------------------------------------------------------
                   71

                    0
1  ----------------------------------------------------------------
                   71
```

```
1  -- Trying Rule AUFM_CORD_POLSHUSS of EINGABE(1) --
                50

                 0
4     if art_w       = 'Corduroy'
                58
4     and  a_d_hfp_cord   = 'Pile filling'
                58
4     then
                58
4     gch_bba        = 'Very low'          ,
                58
4     gch_goe        = 'gut'               ,
                58
4     gch_d          = 'Low'          ,
                58
4     gch_d          = 'Medium'            ,
                58
4     moegl_qualitaet = ('Service life','Quality') ,
                58
4     moegl_qual_text =
                58
4     (':pp SERVICE LIFE - high durability, probably
                58
4     :br:tb5 not so high quality
                58
4     :pp QUALITY - high quality at maximum speed')
                48

                 0
1  Premise failed because ...
                26
1  Clause #1 failed.
                17
1  ----------------------------------------------------------------------
                71

                 0
1  ----------------------------------------------------------------------
                71
1  -- Trying Rule AUFM_BETTW_GERAUHT of EINGABE(1) --
                50

                 0
4     If art_w  =  'Bed linen, napped (flanelle)'
                58
4     then
                58
4     gch_bba       =  'acceptable'                ,
                58
4     gch_gl        =  'Good'                  ,
                58
4     gch_r         =  'Good'                  ,
                58
4     gch_vol       =  'Great'                 ,
                58
4     gch_wg        =  'yes'                   ,
                58
4     gch_d         =  'Low'               ,
                58
4     moegl_qualitaet = ('Service life','Quality') ,
                58
4     moegl_qual_text =
                58
4     (':pp SERVICE LIFE - high durability, probably
                58
4     :br_tb5 not so high quality
                58
4     :pp QUALITY - high quality at maximum speed')
                48

                 0
```

```
1  Premise failed because ...
                26
1  Clause #1 failed.
                17
1  ----------------------------------------------------------------
                71

                 0

                 0
1  ** Processing of MOEGL_QUALITAET of EINGABE(1) completed **
                59
1  ----------------------------------------------------------------
                71
1  -- Executing Constraint VERSCHLEISS of EINGABE(1) --
                52

                 0

                 3
1  is taken from (moegl_qualitaet)
                31

                 0
1  Constraint Resolved
                19
1  ----------------------------------------------------------------
                71

                 0

                 0
1  ** Determining VERSCHLEISS of EINGABE(1) **
                43

                 0
1  ----------------------------------------------------------------
                71
1  -- Trying Rule QUALIT_ZUWEISUNG of SPINNMITTEL(1) --
                52

                 0
4     IF currently  size of (moegl_qualitaet) = 1
                58
4     THEN verschleiss = moegl_qualitaet
                37

                 0
1  Premise failed because ...
                26
1  Clause #1 failed.
                17
1  ----------------------------------------------------------------
                71

                 0
1  ----------------------------------------------------------------
                71
1  -- Trying Rule AUFM_FUTTERWARE_GERAUHT of EINGABE(1) --
                55

                 0
4     If  art_maschenw = 'Linings, napped'
                58
4     then
                58
4     gch_bba       =  'acceptable'                ,
                58
4     gch_gl        =  'Good'                      ,
                58
4     gch_r         =  'Good'                      ,
                58
```

```
4     gch_vol       =  'Great'                ,
                   58
4     gch_wg        =  'yes'                  ,
                   58
4     gch_d         =  'Low'              ,
                   58
4     rs_art_bw = '100 %'                     ,
                   58
4     verschleiss = 'Service life'
                   31

                    0
1  Premise failed because ...
                   26
1  Clause #1 failed.
                   17
1  ----------------------------------------------------------------------
                   71

                    0
1  ----------------------------------------------------------------------
                   71
1  -- Asking user for VERSCHLEISS of EINGABE(1):
                   45
1  >>>> User response:
                   19
3    assigned = 'Quality' (1).
                   71

                    5
1  >>>> Resulting value after assignment:
                   38
1  'Quality' (1)
                   13
1  ----------------------------------------------------------------------
                   71

                    0
1  ** Processing of VERSCHLEISS of EINGABE(1) completed **
                   55

                    0
1  ** Determining ALW of AUTOCORO(1) **
                   36

                    0
1  ----------------------------------------------------------------------
                   71
1  -- Trying Rule S_R_ALW_BW_H_V of SPINNMITTEL(1) --
                   50

                    0
4     if   rs_art     = 'Cotton'
                   58
4     and  verschleiss = 'Service life'
                   58
4     and  ( gfh_nm_max >= 40
                   58
5      or    rdv_trashf <= 40
                   58
5      or    sl_bw_fuenfzig >= 13 )
                   58
4     then alw = 'B 20 DN'
                   23

                    0
1  Premise failed because ...
                   26
1  Clause #2 failed.
                   17
1  Clause #3 failed.
                   17
```

```
1 ----------------------------------------------------------------
                71

                 0
1 ----------------------------------------------------------------
                71
1 -- Trying Rule S_R_ALW_BW_N_V of SPINNMITTEL(1) --
                50

                 0
4     if  verschleiss is not 'Service life'
                58
4     and rs_art    = 'Cotton'
                58
4     and (gfh_nm_max >= 40
                58
5      or   rdv_trashf <=  40
                58
5      or   sl_bw_fuenfzig >= 13 )
                58
4     then alw = 'B 20'
                20

                 0
1  >>>> ALW
                 8
3    assigned = 'B 20' (1).
                71

                 5
1  >>>> Resulting value after assignment:
                38
1  'B 20' (1)
                10
1  Premise of Rule S_R_ALW_BW_N_V of SPINNMITTEL(1) succeeded with
                64
1  certainty (1).
                14
1  ----------------------------------------------------------------
                71

                 0

                 0
1  ** Processing of ALW of AUTOCORO(1) completed **
                48
1  ==> End of Task set for FCB SPINNMITTEL(1) TCB DETERMINE
                56
1  ==> FCB SPINNMITTEL(1) queued to pending FCB list
                49
1  ==> Control given to FCB (SPINNMITTEL)
                38
2   +++ Determine Values
                21
5      value of VERSCHLEISS (  1)(1)
                33
5      value of BESCH (  1)(1)
                27
1  --Focus On
                10
1  --Ignore
                 8
1  --Dont Ask
                10
1  --Dont Acquire
                14
1  --Dont Infer
                12
1  --Use Rules
                11
1  ==> Backward Chaining for
                25
```

```
7        value of VERSCHLEISS (  1)(1)
                35
7        value of BESCH (  1)(1)
                29

                 0
1  ----------------------------------------------------------------
                71
1  ==> Goal parameter resolved:
                28
1  VERSCHLEISS of EINGABE(1) (Current State:Resolved)
                50
1  'Quality' (1)
                13
1  ----------------------------------------------------------------
                71

                 0
1  ** Determining BESCH of AUTOCORO(1) **
                38
4     then besch    = 'D'
                22

                 0
1  >>>> BESCH
                10
3    assigned = 'D' (1).
                71

                 5
1  >>>> Resulting value after assignment:
                38
1  'D' (1)
                 7
1  Premise of Rule BESCH_D_ROTOR of SPINNMITTEL(1) succeeded with
                63
1  certainty (1).
                14
1  ----------------------------------------------------------------
                71

                 0

                 0
1  ** Processing of BESCH of AUTOCORO(1) completed **
                50
1  ==> End of Task set for FCB SPINNMITTEL(1) TCB DETERMINE
                56
1  ==> FCB SPINNMITTEL(1) queued to pending FCB list
                49
1  ==> Control given to FCB (SPINNMITTEL)
                38
2   +++ Determine Values
                21
5      value of E_P_R_HELP (  2)(1)
                32
1  --Focus On
                10
1  --Ignore
                 8
1  --Dont Ask
                10
5      value of GCH_BBA (  1)(1)
                29
5      value of GCH_R (  1)(1)
                27
5      value of GCH_VOL (  1)(1)
                29
5      value of GCH_H (  1)(1)
                27
5      value of GCH_K (  1)(1)
                27
```

```
5      value of GCH_KRI (  1)(1)
                29
5      value of GCH_P (  1)(1)
                27
5      value of GCH_WG (  1)(1)
                28
5      value of GCH_GL (  1)(1)
                28
5      value of GCH_GOE (  1)(1)
                29
5      value of GFK_G_M_H (  1)(1)
                31
5      value of GCH_D (  1)(1)
                27
5      value of WARENBILD (  1)(1)
                31
5      value of MARKENART (  1)(1)
                31
5      value of A_D_HFP_CORD (  1)(1)
                34
5      value of A_D_HFP_VELOUR (  1)(1)
                36
5      value of A_D_HFP (  1)(1)
                29
1  --Dont Acquire
                14
1  --Dont Infer
                12
5      value of GCH_BBA (  1)(1)
                29
5      value of GCH_R (  1)(1)
                27
5      value of GCH_VOL (  1)(1)
                29
5      value of GCH_H (  1)(1)
                27
5      value of GCH_K (  1)(1)
                27
5      value of GCH_KRI (  1)(1)
                29
5      value of GCH_P (  1)(1)
                27
5      value of GCH_WG (  1)(1)
                28
5      value of GCH_GL (  1)(1)
                28
5      value of GCH_GOE (  1)(1)
                29
5      value of GFK_G_M_H (  1)(1)
                31
5      value of GCH_D (  1)(1)
                27
1  SL_BW_FUENFZIG of AUTOCORO(1) (Current State:Resolved)
                54
1  13  (1)
                 7
1  ----------------------------------------------------------------------
                71
1  ==> End of Task set for FCB PLAUSIBILITAETSPRUEFUNG(1) TCB DETERMINE
                68
1  ==> FCB PLAUSIBILITAETSPRUEFUNG(1) queued to pending FCB list
                61
1  ==> Control given to FCB (PLAUSIBILITAETSPRUEFUNG)
                50
2   +++ Determine Values
                21
5      value of GDBW_A_MET (  1)(1)
                32
1  --Focus On
                10
1  --Ignore
                 8
```

```
1  --Dont Ask
                10
1  --Dont Acquire
                14
1  --Dont Infer
                12
1  --Use Rules
                11
1  ==> Backward Chaining for
                25
7        value of GDBW_A_MET (  1)(1)
                34

                 0
1  ** Determining GDBW_A_MET of EINGABE(1) **
                42

                 0
1  ----------------------------------------------------------------
                71
1  -- Trying Rule ALPHA_WEBEREI_DENIM_8_17 of PLAUSIBILITAETSPRUEFUNG(1)
                70
1  --
                 2

                 0

                 0
1  ----------------------------------------------------------------
                71
1  -- Trying Rule BESCH_B_ROTOR of SPINNMITTEL(1) --
                49

                 0
4     IF  verschleiss = 'Service life'
                58
5      or ((rs_art    =  'Cotton'
                58
5      or (rs_art    =  'Fiber blends'
                58
8         and currently mibw_proz > 0 ))
                58
5      and currently rs_bw_verschmutz =
                58
8         ('aggressive Veschmutzung (z.B. Sand)',
                58
9          'sticky (such as honeydew, seed oil)'))
                58
4     THEN besch    = 'B'
                22

                 0
1  Premise failed because ...
                26
1  Clause #1 failed.
                17
1  Clause #5 failed.
                17
1  ----------------------------------------------------------------
                71

                 0
1  ----------------------------------------------------------------
                71
1  -- Trying Rule BESCH_D_ROTOR of SPINNMITTEL(1) --
                49

                 0
4     if  verschleiss = 'Quality'
                58
4     and  besch  is not known
                58
```

```
5      value of WARENBILD (  1)(1)
                31
5      value of MARKENART (  1)(1)
                31
1  --Use Rules
                11
1  ==> Backward Chaining for
                25
7        value of E_P_R_HELP (  2)(1)
                34

                 0
1  ** Determining E_P_R_HELP of SPINNMITTEL(1) **
                46

                 0
1  ----------------------------------------------------------------------
                71
1  -- Trying Rule ROT_G_36 of SPINNMITTEL(1) --
                44

                 0
4      IF   rs_art      = 'Cotton'
                58
4      and  rdv_trashf <= 40
                58
4      and  rdv_dustf  <= 40
                58
4      and  spinnb_typ is not  'SE 7'
                58
4      and  rs_fl_mm    <= 40
                58
4      and  ffh_max_sy_ch <= 2.25
                58
4      and (gch_bba = 'acceptable'  or not there is gch_bba)
                58
4      and (gch_kri     = 'Low'    or not there is gch_kri)
                58
4      and (gch_gl is not 'Very good' or not there is gch_gl)
                58
4      and (gch_goe     = 'no'      or not there is gch_goe)
                58
4      and (gch_r       = 'no'      or not there is gch_r)
                58
4      and (gch_vol is not 'Great'  or not there is gch_vol)
                58
4      and (gch_wg      = 'yes'        or not there is gch_wg)
                58
4      and (gch_k       = 'Low'    or not there is gch_k)
                58
4      and (gch_h  is not 'High'      or not there is gch_h)
                58
4      then
                58
4      rot_f   = 'G'    ,
                58
4      rot_d   = 36     ,
                58
4      rot_b   = besch,
                58
4      rot_ts   = '-',
                58
4      rot_n_max = 90000,
                58
4      rot_n_min = 80000,
                58
4      ep_rot_gfh_max_q = 80,
                58
4      ep_rot_gfh_min_q = 28,
                58
4      ep_rot_gfh_max_s = 80,
                58
```

```
4     ep_rot_gfh_min_s = 24,
                  58
4     e_p_r_help = 1
                  17

                   0
1  Unknown parameter(s) in the premise:
                  36
1  RS_FL_MM of EINGABE(1) (Current State:UnProcessed)
                  50
1  GCH_VOL of AUTOCORO(1) (Current State:UnProcessed)
                  50
1  ----------------------------------------------------------------------
                  71

                   0

                   0
1  ** Determining RS_FL_MM of EINGABE(1) **
                  40

                   0
1  ----------------------------------------------------------------------
                  71
1  -- Trying Rule RS_FASERLAENGE_MM of SPINNMITTEL(1) --
                  53

                   0
4     If fl_chem is known
                  58
4     and fl_syn is known
                  58
4     and fl_wol is known
                  58
4     and sl_bw_fuenfzig is known
                  58
4     and fl_einheit = 'mm'
                  58
4     then rs_fl_mm = maximum of.(fl_chem,fl_syn,fl_wol,
                  58
20                    sl_bw_fuenfzig)
                  34

                   0
1  >>>> RS_FL_MM
                  13
3    assigned = 13  (1).
                  71

                   5
1  >>>> Resulting value after assignment:
                  38
1  13  (1)
                   7
1  Premise of Rule RS_FASERLAENGE_MM of SPINNMITTEL(1) succeeded with
                  67
1  certainty (1).
                  14
1  ----------------------------------------------------------------------
                  71

                   0

                   0
1  ** Processing of RS_FL_MM of EINGABE(1) completed **
                  52

                   0
1  ** Determining E_P_R_HELP of SPINNMITTEL(1) **
                  46

                   0
```

```
1 ------------------------------------------------------------------
                71
1 -- Trying Rule ROT_G_36 of SPINNMITTEL(1) --
                44

                 0
4     IF   rs_art       = 'Cotton'
                58
4     and  rdv_trashf <= 40
                58
4     and  rdv_dustf  <= 40
                58
4     and  spinnb_typ is not  'SE 7'
                58
4     and  rs_fl_mm    <= 40
                58
4     and  ffh_max_sy_ch <= 2.25
                58
4     and (gch_bba = 'acceptable'  or not there is gch_bba)
                58
4     and (gch_kri     = 'Low'    or not there is gch_kri)
                58
4     and (gch_gl is not 'Very good' or not there is gch_gl)
                58
4     and (gch_goe     = 'no'      or not there is gch_goe)
                58
4     and (gch_r       = 'no'      or not there is gch_r)
                58
4     and (gch_vol is not 'Great'  or not there is gch_vol)
                58
4     and (gch_wg      = 'yes'        or not there is gch_wg)
                58
4     and (gch_k       = 'Low'    or not there is gch_k)
                58
4     and (gch_h  is not 'High'      or not there is gch_h)
                58
4     then
                58
4     rot_f   = 'G'    ,
                58
4     rot_d   = 36     ,
                58
4     rot_b   = besch,
                58
4     rot_ts   = '-',
                58
4     rot_n_max = 90000,
                58
4     rot_n_min = 80000,
                58
4     ep_rot_gfh_max_q = 80,
                58
4     ep_rot_gfh_min_q = 28,
                58
4     ep_rot_gfh_max_s = 80,
                58
4     ep_rot_gfh_min_s = 24,
                58
4     e_p_r_help = 1
                17

                 0
1  Unknown parameter(s) in the premise:
                36
1  ** Processing of ROT_HILFSPAR of SPINNMITTEL(1) completed **
                60

                 0
1  ** Determining E_P_R_HELP of SPINNMITTEL(1) **
                46

                 0
```

```
1  ----------------------------------------------------------------
                    71
1  -- Trying Rule ROT_T_36_TST of SPINNMITTEL(1) --
                    48

                     0
4     IF  rot_hilfspar is not known
                    58
4     and  rdv_trashf  <= 35
                    58
4     and  rdv_dustf   <= 75
                    58
4     and  spinnb_typ is not  'SE 7'
                    58
4     and  rs_fl_mm    <= 40
                    58
4     and  ffh_max_sy_ch <= 2.25
                    58
4     and (gch_k is not 'Very good' or not there is gch_k)
                    58
4     and (gch_bba is not 'Very low' or not there is gch_bba)
                    58
4     and (gch_kri is not 'High'     or not there is gch_kri)
                    58
4     and (gch_goe   is not 'gut'   or not there is gch_goe)
                    58
4     and (gch_r   is not 'Very good' or not there is gch_r)
                    58
4     and (gch_vol     =    'Great' or gch_vol = 'Medium'
                    58
27                            or not there is gch_vol)
                    58
4     and (gch_wg      = 'yes'      or not there is gch_wg)
                    58
4     and (gch_h  = 'High'  and gch_d = 'Low'
                    58
5      and (azd = 'KN /R 4' or azd = 'KN 4/R 4')
                    58
5      or  gch_h    = 'Medium' or not there is gch_h)
                    58
4     then
                    58
4     rot_f   = 'T'    ,
                    58
4     rot_d   = 36     ,
                    58
4     rot_b   = besch,
                    58
4     rot_ts    = 'TS ..',
                    58
4     rot_n_max   = 90000,
                    58
4     rot_n_min   = 80000,
                    58
4     ep_rot_gfh_max_q = 90,
                    58
4     ep_rot_gfh_min_q = 26,
                    58
4     ep_rot_gfh_max_s = 90,
                    58
4     ep_rot_gfh_min_s = 20,
                    58
4     e_p_r_help = 1
                    17

                     0
1  >>>> ROT_F
                    10
3    assigned = 'T' (1).
                    71

                     5
```

```
1  >>>> Resulting value after assignment:
                    38
1  'G' (1)
                     7
1  'G' (1)
                     7
1  'U' (1)
                     7
1  'U' (1)
                     7
1  'T' (1)
                     7
1  >>>> ROT_D
                    10
3    assigned = 36  (1).
                    71

                     5
1  >>>> Resulting value after assignment:
                    38
1  36  (1)
                     7
1  33  (1)
                     7
1  ==> Control given to FCB (ABGL_ROT)
                    35
2   +++ Determine Values
                    21
5      value of AR_P_FLAG (  2)(1)
                    31
1  --Focus On
                    10
1  --Ignore
                     8
1  --Dont Ask
                    10
1  --Dont Acquire
                    14
1  --Dont Infer
                    12
5      value of ROT_F (  1)(1)
                    27
5      value of ROT_D (  1)(1)
                    27
5      value of ROT_B (  1)(1)
                    27
5      value of ROT_TS (  1)(1)
                    28
5      value of ROT_N_MAX (  1)(1)
                    31
5      value of ROT_N_MIN (  1)(1)
                    31
5      value of EP_ROT_GFH_MAX_Q (  1)(1)
                    38
5      value of EP_ROT_GFH_MIN_Q (  1)(1)
                    38
5      value of EP_ROT_GFH_MAX_S (  1)(1)
                    38
5      value of EP_ROT_GFH_MIN_S (  1)(1)
                    38
1  --Use Rules
                    11
1  ==> Backward Chaining for
                    25
7        value of AR_P_FLAG (  2)(1)
                    33

                     0
1  ** Determining AR_P_FLAG of ABGL_ROT(1) **
                    42

                     0
```

```
1  ----------------------------------------------------------------
                    71
1  -- Trying Rule AR_R_ABGL_ROT_K_TS of ABGL_ROT(1) --
                    51

                     0
4     IF  n_max          >= element a_p_nr from rot_n_max
                    58
4     and n_rot_abzug_v  >= element a_p_nr from rot_n_max
                    58
4     and (Verschleiss is not 'Service life'
                    58
4     and (gfh_nm_max <= element a_p_nr from ep_rot_gfh_max_q
                    58
4     and a_p_anz_rot = 1
                    58
5      or a_p_gfh_nm_hp  <= element a_p_nr from
                    58
34                                  ep_rot_gfh_max_q
                    58
4     and a_p_anz_rot = 2)
                    58
4     and (gfh_nm_min >= element a_p_nr from ep_rot_gfh_min_q
                    58
4     and a_p_anz_rot = 1
                    58
5      or a_p_gfh_nm_hp  >= element a_p_nr from
                    58
37                                    ep_rot_gfh_min_q
                    58
12            and a_p_anz_rot = 2)
                    58
5      or  Verschleiss = 'Service life'
                    58
4     and (gfh_nm_max <= element a_p_nr from ep_rot_gfh_max_s
                    58
4     and a_p_anz_rot = 1
                    58
5      or a_p_gfh_nm_hp  <= element a_p_nr from
                    58
34                                  ep_rot_gfh_max_s
                    58
4     and a_p_anz_rot = 2)
                    58
4     and (gfh_nm_min >= element a_p_nr from ep_rot_gfh_min_s
                    58
9          and a_p_anz_rot = 1
                    58
5      or a_p_gfh_nm_hp  >= element a_p_nr from
                    58
37                                    ep_rot_gfh_min_s
                    58
12            and a_p_anz_rot = 2))
                    58
4     Then ar_p_rot_f = element a_p_nr from rot_f
                    58
5      and ar_p_rot_d = element a_p_nr from rot_d
                    58
5      and ar_p_rot_b = element a_p_nr from rot_b
                    58
5      and ar_p_rot_ts = element a_p_nr from rot_ts
                    58
5      and ar_p_drehz  = element a_p_nr from rot_n_max
                    58
5      and ar_p_rot_ts_abgl  = '- '
                    58
5      and ar_p_flag = 1
                    58
5      and a_p_aus_f     =  element a_p_nr from rot_f
                    58
5      and a_p_aus_d     =  element a_p_nr from rot_d
                    58
```

```
5      and a_p_aus_b     =  element a_p_nr from rot_b
                  58
5      and a_p_aus_ts    =  element a_p_nr from rot_ts
                  58
5      and a_p_aus_drehz =  element a_p_nr from rot_n_max
                  54

                   0
1  Premise failed because ...
                  26
1  Clause #2 failed.
                  17
1  ----------------------------------------------------------------
                  71

                   0
1  >>>> AR_P_FLAG
                  14
3    assigned = 0  (1).
                  71

                   5
1  >>>> Resulting value after assignment:
                  38
1  0  (1)
                   6
1  -- Trying to resolve Default Constraint
                  39

                   0
4     = 0
                   6

                   0
1  Default Constraint resolution successful
                  40
1  -- Default constraint applied
                  29

                   0
1  ** Processing of AR_P_FLAG of ABGL_ROT(1) completed **
                  54
1  ** Determining AR_P_FLAG of ABGL_ROT(3) **
                  42

                   0
1  ----------------------------------------------------------------
                  71
1  -- Trying Rule AR_R_ABGL_ROT_K_TS of ABGL_ROT(3) --
                  51

                   0
4      IF  n_max          >= element a_p_nr from rot_n_max
                  58
4      and n_rot_abzug_v  >= element a_p_nr from rot_n_max
                  58
4      and (Verschleiss is not 'Service life'
                  58
4      and (gfh_nm_max <= element a_p_nr from ep_rot_gfh_max_q
                  58
4      and a_p_anz_rot = 1
                  58
5       or a_p_gfh_nm_hp  <= element a_p_nr from
                  58
34                                  ep_rot_gfh_max_q
                  58
4      and a_p_anz_rot = 2)
                  58
4      and (gfh_nm_min >= element a_p_nr from ep_rot_gfh_min_q
                  58
4      and a_p_anz_rot = 1
                  58
```

```
5      or a_p_gfh_nm_hp  >= element a_p_nr from
                   58
37                                   ep_rot_gfh_min_q
                   58
12           and a_p_anz_rot = 2)
                   58
5      or  Verschleiss = 'Service life'
                   58
4     and (gfh_nm_max <= element a_p_nr from ep_rot_gfh_max_s
                   58
4     and a_p_anz_rot = 1
                   58
5      or a_p_gfh_nm_hp  <= element a_p_nr from
                   58
34                                 ep_rot_gfh_max_s
                   58
4     and a_p_anz_rot = 2)
                   58
4     and (gfh_nm_min >= element a_p_nr from ep_rot_gfh_min_s
                   58
9         and a_p_anz_rot = 1
                   58
5      or a_p_gfh_nm_hp  >= element a_p_nr from
                   58
37                                   ep_rot_gfh_min_s
                   58
12           and a_p_anz_rot = 2))
                   58
4     Then ar_p_rot_f = element a_p_nr from rot_f
                   58
5      and ar_p_rot_d = element a_p_nr from rot_d
                   58
5      and ar_p_rot_b = element a_p_nr from rot_b
                   58
5      and ar_p_rot_ts = element a_p_nr from rot_ts
                   58
5      and ar_p_drehz  = element a_p_nr from rot_n_max
                   58
5      and ar_p_rot_ts_abgl  = '- '
                   58
5      and ar_p_flag = 1
                   58
5      and a_p_aus_f     =  element a_p_nr from rot_f
                   58
5      and a_p_aus_d     =  element a_p_nr from rot_d
                   58
5      and a_p_aus_b     =  element a_p_nr from rot_b
                   58
5      and a_p_aus_ts    =  element a_p_nr from rot_ts
                   58
5      and a_p_aus_drehz =  element a_p_nr from rot_n_max
                   54

                    0
1  >>>> AR_P_ROT_F
            15
3    assigned = 'U' (1).
                 71

                    5
1  >>>> Resulting value after assignment:
                   38
1  'U' (1)
                    7
1  >>>> AR_P_ROT_D
                 15
3    assigned = 46  (1).
                 71

                    5
1  >>>> Resulting value after assignment:
                   38
```

```
1  46  (1)
                    7
1  >>>> AR_P_ROT_B
                   15
3    assigned = 'B' (1).
                   71

                    5
1  >>>> Resulting value after assignment:
                   38
1  'B' (1)
                    7
1  >>>> AR_P_ROT_TS
                   16
3    assigned = '-' (1).
                   71

                    5
1  >>>> Resulting value after assignment:
                   38
1  '-' (1)
                    7
1  >>>> AR_P_DREHZ
                   15
3    assigned = 70000  (1).
                   71

                    5
1  >>>> Resulting value after assignment:
                   38
1  70000  (1)
                   10
1  >>>> AR_P_ROT_TS_ABGL
                   21
3    assigned = '- ' (1).
                   71

                    5
1  >>>> Resulting value after assignment:
                   38
1  '- ' (1)
                    8
1  >>>> AR_P_FLAG
                   14
3    assigned = 1  (1).
                   71

                    5
1  >>>> Resulting value after assignment:
                   38
1  1  (1)
                    6
1  >>>> A_P_AUS_F
                   14
3    assigned = 'U' (1).
                   71

                    5
1  >>>> Resulting value after assignment:
                   38
1  'U' (1)
                    7
1  >>>> A_P_AUS_D
                   14
3    assigned = 46  (1).
                   71

                    5
1  >>>> Resulting value after assignment:
                   38
1  46  (1)
                    7
```

```
1  >>>> A_P_AUS_B
                    14
3    assigned = 'B' (1).
                    71

                     5
1  >>>> Resulting value after assignment:
                    38
1  'B' (1)
                     7
1  >>>> A_P_AUS_TS
                    15
3    assigned = '-' (1).
                    71

                     5
1  >>>> Resulting value after assignment:
                    38
1  '-' (1)
                     7
1  >>>> A_P_AUS_DREHZ
                    18
3    assigned = 70000  (1).
                    71

                     5
1  >>>> Resulting value after assignment:
                    38
1  70000  (1)
                    10
1  Premise of Rule AR_R_ABGL_ROT_K_TS of ABGL_ROT(3) succeeded with
                    65
1  certainty (1).
                    14
1  46  (1)
                     7
1  40  (1)
                     7
1  36  (1)
                     7
1  >>>> ROT_B
                    10
3    assigned = 'D' (1).
                    71

                     5
1  >>>> Resulting value after assignment:
                    38
1  'D' (1)
                     7
1  'D' (1)
                     7
1  'B' (1)
                     7
1  'B' (1)
                     7
1  'D' (1)
                     7
1  >>>> ROT_TS
                    11
3    assigned = 'TS ..' (1).
                    71

                     5
1  >>>> Resulting value after assignment:
                    38
1  '-' (1)
                     7
1  '-' (1)
                     7
1  '-' (1)
                     7
```

```
1  '-' (1)
                    7
1  'TS ..' (1)
                   11
1  >>>> ROT_N_MAX
                   14
3    assigned = 90000  (1).
                   71

                    5
1  >>>> Resulting value after assignment:
                   38
1  90000  (1)
                   10
1  100000  (1)
                   11
1  70000  (1)
                   10
1  80000  (1)
                   10
1  90000  (1)
                   10
1  >>>> ROT_N_MIN
                   14
3    assigned = 80000  (1).
                   71

                    5
1  >>>> Resulting value after assignment:
                   38
1  80000  (1)
                   10
1  90000  (1)
                   10
1  40000  (1)
                   10
1  70000  (1)
                   10
1  80000  (1)
                   10
1  >>>> EP_ROT_GFH_MAX_Q
                   21
3    assigned = 90  (1).
                   71

                    5
1  >>>> Resulting value after assignment:
                   38
1  80  (1)
                    7
1  80  (1)
                    7
1  20  (1)
                    7
1  20  (1)
                    7
1  90  (1)
                    7
1  >>>> EP_ROT_GFH_MIN_Q
                   21
3    assigned = 26  (1).
                   71

                    5
1  >>>> Resulting value after assignment:
                   38
1  28  (1)
                    7
1  28  (1)
                    7
1  8  (1)
                    6
```

```
1  10  (1)
                    7
1  26  (1)
                    7
1  >>>> EP_ROT_GFH_MAX_S
                   21
3    assigned = 90  (1).
                   71

                    5
1  >>>> Resulting value after assignment:
                   38
1  80  (1)
                    7
1  80  (1)
                    7
1  34  (1)
                    7
1  34  (1)
                    7
1  90  (1)
                    7
1  >>>> EP_ROT_GFH_MIN_S
                   21
3    assigned = 20  (1).
                   71

                    5
1  >>>> Resulting value after assignment:
                   38
1  24  (1)
                    7
1  24  (1)
                    7
1  8  (1)
                    6
1  10  (1)
                    7
1  20  (1)
                    7
```

I claim:

1. A method of configuring a rotor spinning device of a textile machine and controlling its operational characteristics for the spinning of a yarn to be used in a predetermined fabric application, comprising;

providing a processing unit having the capability to prompt a user for information and to accept information inputted thereto by the user;

prompting a user for information regarding the predetermined fabric application;

in response to the inputted information concerning the predetermined fabric application, interrogating the user concerning the preferred characteristics of the predetermined fabric application;

prompting the user to provide information relating to the raw material of the yarn to be used in the predetermined fabric application;

promoting the user to provide information relating to the yarn count of the said yarn;

in response to the user's selection of the raw material, prompting the user to specify selected ones of a group of yarn characteristics including the yarn length, the yarn fineness and the debris content;

in response to the inputted information relating to the selected ones of said yarn characteristics, calculating selected dimensional values of the rotor spinning device;

prompting the user to input information relating to the sliver count;

in response to the inputting of information relating to the sliver count, calculating a drafting range based upon a predetermined sliver count;

comparing said calculated drafting range with a predetermined drafting range;

calculating a value for the number of fibers in the cross section of said yarn and comparing said calculated value with a predetermined value;

prompting the user to modify the inputted information concerning said yarn if said calculated drafting range is not in agreement with said predetermined drafting range;

prompting the user to modify the inputted information concerning said yarn in the event that said calculated value of the number of fibers in the cross section of said yarn is not in agreement with said predetermined fiber number value;

compiling an initial list of acceptable rotor spinning device components from a selected group of rotor spinning components in consideration of information relating to at least one of said calculated dimensional values of the rotor spinning device, said calculated drafting range, and said calculated fiber cross-sectional value;

identifying selected ones of said acceptable rotor spinning device components and predetermined operational characteristics thereof in consideration of information relating to at least one of said calculated dimensional values of the rotor spinning device, said calculated drafting range, and said calculated fiber cross-sectional value;

installing said selected ones of said acceptable rotor spinning device components on the rotor spinning device; and controlling the operation of the rotor spinning device in response to said selected ones of said predetermined operational characteristics.

2. The method according to claim 1 and characterized further in that said selecting predetermined ones of said acceptable rotor spinning device components includes selecting a spinning rotor in correspondence with information concerning the relative quality level of the yarn to be spun by the spinning rotor, the rotor spinning rate and the yarn count range.

3. The method according to claim 1 and characterized further in that said compiling an initial list includes identifying acceptable yarn withdrawal components in consideration of information concerning said preferred characteristics of said yarn and information relating to said raw material.

* * * * *